US009162137B2

(12) United States Patent
McDaniel

(10) Patent No.: US 9,162,137 B2
(45) Date of Patent: Oct. 20, 2015

(54) METHOD AND APPARATUS FOR CONDUCTING A COMPARING-CARD GAME BELONGING TO A FINNISH 27 FAMILY OF TABLE-CARD GAMES

(71) Applicant: Kevin Michael McDaniel, Honolulu, HI (US)

(72) Inventor: Kevin Michael McDaniel, Honolulu, HI (US)

( * ) Notice: Subject to any disclaimer, the term of this patent is extended or adjusted under 35 U.S.C. 154(b) by 0 days.

(21) Appl. No.: 14/217,378

(22) Filed: Mar. 17, 2014

(65) Prior Publication Data

US 2015/0258419 A1 Sep. 17, 2015

(51) Int. Cl.
*A63F 1/00* (2006.01)
*G07F 17/32* (2006.01)

(52) U.S. Cl.
CPC ..... *A63F 1/00* (2013.01); *G07F 17/3293* (2013.01); *A63F 2001/005* (2013.01)

(58) Field of Classification Search
USPC ..... 463/12, 13
See application file for complete search history.

(56) References Cited

U.S. PATENT DOCUMENTS

2002/0036381 A1* 3/2002 Scibetta ..... 273/292
2004/0245720 A1* 12/2004 Grauzer et al. ..... 273/149 R
2010/0227668 A1* 9/2010 Scibetta et al. ..... 463/22
2011/0115160 A1* 5/2011 Snow ..... 273/292
2012/0252560 A1* 10/2012 Alderucci et al. ..... 463/25
2014/0073385 A1* 3/2014 Alderucci et al. ..... 463/11

* cited by examiner

*Primary Examiner* — Pierre E Elisca

(57) ABSTRACT

A method and apparatus for conducting a comparing-card game belonging to the Finnish 27 family of table-card games is disclosed. Source codes of various software applications are disclosed. Said software applications provide a software means for making a set of game rules. Given a set of game rules, said software applications enable users to do the following. Find the basic strategy. Calculate an estimate of the house edge. Conduct high-speed game simulations. Identify betting, card-counting and/or playing strategies that skilled players might use to beat the game. Apply counter measures against said strategies. Test the game for vulnerability to said strategies with or without the application of said counter measures. Source codes of various software prototypes are disclosed. Each software prototype enables the user to play an optional embodiment of a comparing-card game belonging to the Finnish 27 family of table-card games in real time.

12 Claims, 10 Drawing Sheets card ranks assigned to player cards are 8 and 9 dealer cards are 5 and 10
given the user input deck composition, and user defined set of game rules, the following is a
table displaying the probabilities of all outcomes that contribute to the expect value of the player standing at 22

| | | 22 | 23 | 24 | 25 | 26 | 27 | 28 | 29 | 30 | 31 | 32 | 33 | 34 | TOTAL |
|---|---|---|---|---|---|---|---|---|---|---|---|---|---|---|---|
| | % | 12.16 | 11.82 | 11.81 | 11.77 | 12.08 | 12.09 | 12.11 | 4.31 | 3.73 | 3.11 | 2.44 | 1.68 | 0.88 | 100.00 |
| 15 | 0.00 | 0.00 | 0.00 | 0.00 | 0.00 | 0.00 | 0.00 | 0.00 | 0.00 | 0.00 | 0.00 | 0.00 | 0.00 | 0.00 | 0.00 |
| 16 | 0.00 | 0.00 | 0.00 | 0.00 | 0.00 | 0.00 | 0.00 | 0.00 | 0.00 | 0.00 | 0.00 | 0.00 | 0.00 | 0.00 | 0.00 |
| 17 | 0.00 | 0.00 | 0.00 | 0.00 | 0.00 | 0.00 | 0.00 | 0.00 | 0.00 | 0.00 | 0.00 | 0.00 | 0.00 | 0.00 | 0.00 |
| 18 | 0.00 | 0.00 | 0.00 | 0.00 | 0.00 | 0.00 | 0.00 | 0.00 | 0.00 | 0.00 | 0.00 | 0.00 | 0.00 | 0.00 | 0.00 |
| 19 | 0.00 | 0.00 | 0.00 | 0.00 | 0.00 | 0.00 | 0.00 | 0.00 | 0.00 | 0.00 | 0.00 | 0.00 | 0.00 | 0.00 | 0.00 |
| 20 | 0.00 | 0.00 | 0.00 | 0.00 | 0.00 | 0.00 | 0.00 | 0.00 | 0.00 | 0.00 | 0.00 | 0.00 | 0.00 | 0.00 | 0.00 |
| 21 | 0.00 | 0.00 | 0.00 | 0.00 | 0.00 | 0.00 | 0.00 | 0.00 | 0.00 | 0.00 | 0.00 | 0.00 | 0.00 | 0.00 | 0.00 |
| 22 | 10.19 | 0.00 | -1.20 | -1.20 | -1.20 | -1.23 | -1.23 | 1.23 | 0.44 | 0.38 | 0.32 | 0.25 | 0.17 | 0.09 | -3.19 |
| 23 | 10.47 | 1.27 | 0.00 | -1.24 | -1.23 | -1.27 | -1.27 | 1.27 | 0.45 | 0.39 | 0.33 | 0.26 | 0.18 | 0.09 | -0.77 |
| 24 | 10.49 | 1.28 | 1.24 | 0.00 | -1.23 | -1.27 | -1.27 | 1.27 | 0.45 | 0.39 | 0.33 | 0.26 | 0.18 | 0.09 | 1.71 |
| 25 | 10.15 | 1.23 | 1.20 | 1.20 | 0.00 | -1.23 | -1.23 | 1.23 | 0.44 | 0.38 | 0.32 | 0.25 | 0.17 | 0.09 | 4.05 |
| 26 | 10.14 | 1.23 | 1.20 | 1.20 | 1.19 | 0.00 | -1.23 | 1.23 | 0.44 | 0.38 | 0.32 | 0.25 | 0.17 | 0.09 | 6.47 |
| 27 | 2.68 | 0.33 | 0.32 | 0.32 | 0.32 | 0.32 | 0.00 | 0.32 | 0.12 | 0.10 | 0.08 | 0.07 | 0.05 | 0.02 | 2.36 |
| 28 | 10.44 | -1.27 | -1.23 | -1.23 | -1.23 | -1.26 | -1.26 | -1.26 | -0.45 | -0.39 | -0.32 | -0.25 | -0.18 | -0.09 | -10.44 |
| 29 | 10.44 | -1.27 | -1.23 | -1.23 | -1.23 | -1.26 | -1.26 | -1.26 | -0.45 | -0.39 | -0.32 | -0.25 | -0.18 | -0.09 | -10.44 |
| 30 | 10.46 | -1.27 | -1.24 | -1.24 | -1.23 | -1.26 | -1.27 | -1.27 | -0.45 | -0.39 | -0.33 | -0.26 | -0.18 | -0.09 | -10.46 |
| 31 | 2.70 | -0.33 | -0.32 | -0.32 | -0.32 | -0.33 | -0.33 | -0.33 | -0.12 | -0.10 | -0.08 | -0.07 | -0.05 | -0.02 | -2.70 |
| 32 | 2.12 | -0.26 | -0.25 | -0.25 | -0.25 | -0.26 | -0.26 | -0.26 | -0.09 | -0.08 | -0.07 | -0.05 | -0.04 | -0.02 | -2.12 |
| 33 | 1.47 | -0.18 | -0.17 | -0.17 | -0.17 | -0.18 | -0.18 | -0.18 | -0.06 | -0.05 | -0.05 | -0.04 | -0.02 | -0.01 | -1.47 |
| 34 | 0.76 | -0.09 | -0.09 | -0.09 | -0.09 | -0.09 | -0.09 | -0.09 | -0.03 | -0.03 | -0.02 | -0.02 | -0.01 | -0.01 | -0.76 |
| 35 | 0.00 | 0.00 | 0.00 | 0.00 | 0.00 | 0.00 | 0.00 | 0.00 | 0.00 | 0.00 | 0.00 | 0.00 | 0.00 | 0.00 | 0.00 |
| 36 | 0.00 | 0.00 | 0.00 | 0.00 | 0.00 | 0.00 | 0.00 | 0.00 | 0.00 | 0.00 | 0.00 | 0.00 | 0.00 | 0.00 | 0.00 |
| 37 | 0.00 | 0.00 | 0.00 | 0.00 | 0.00 | 0.00 | 0.00 | 0.00 | 0.00 | 0.00 | 0.00 | 0.00 | 0.00 | 0.00 | 0.00 |
| 38 | 0.00 | 0.00 | 0.00 | 0.00 | 0.00 | 0.00 | 0.00 | 0.00 | 0.00 | 0.00 | 0.00 | 0.00 | 0.00 | 0.00 | 0.00 |
| 39 | 0.00 | 0.00 | 0.00 | 0.00 | 0.00 | 0.00 | 0.00 | 0.00 | 0.00 | 0.00 | 0.00 | 0.00 | 0.00 | 0.00 | 0.00 |
| jo27 | 0.00 | 0.00 | 0.00 | 0.00 | 0.00 | 0.00 | 0.00 | 0.00 | 0.00 | 0.00 | 0.00 | 0.00 | 0.00 | 0.00 | 0.00 |
| p999 | 0.00 | 0.00 | 0.00 | 0.00 | 0.00 | 0.00 | 0.00 | 0.00 | 0.00 | 0.00 | 0.00 | 0.00 | 0.00 | 0.00 | 0.00 |
| p89T | 7.47 | 1.40 | 1.36 | 1.36 | 1.36 | 1.40 | 1.40 | 1.40 | 0.50 | 0.43 | 0.36 | 0.28 | 0.19 | 0.10 | 11.55 |
| 6c27 | 0.00 | 0.00 | 0.00 | 0.00 | 0.00 | 0.00 | 0.00 | 0.00 | 0.00 | 0.00 | 0.00 | 0.00 | 0.00 | 0.00 | 0.00 |
| 7c27 | 0.00 | 0.00 | 0.00 | 0.00 | 0.00 | 0.00 | 0.00 | 0.00 | 0.00 | 0.00 | 0.00 | 0.00 | 0.00 | 0.00 | 0.00 |
| 8c27 | 0.00 | 0.00 | 0.00 | 0.00 | 0.00 | 0.00 | 0.00 | 0.00 | 0.00 | 0.00 | 0.00 | 0.00 | 0.00 | 0.00 | 0.00 |
| 9c27 | 0.00 | 0.00 | 0.00 | 0.00 | 0.00 | 0.00 | 0.00 | 0.00 | 0.00 | 0.00 | 0.00 | 0.00 | 0.00 | 0.00 | 0.00 |
| nchw | 0.00 | 0.00 | 0.00 | 0.00 | 0.00 | 0.00 | 0.00 | 0.00 | 0.00 | 0.00 | 0.00 | 0.00 | 0.00 | 0.00 | 0.00 |
| TOTAL | 100.00 | 2.08 | -0.42 | -2.90 | -5.32 | -7.91 | -9.47 | 3.30 | 1.18 | 1.02 | 0.85 | 0.67 | 0.46 | 0.24 | -16.23 |

FIG. 10

METHOD AND APPARATUS FOR CONDUCTING A COMPARING-CARD GAME BELONGING TO A FINNISH 27 FAMILY OF TABLE-CARD GAMES

A portion of the disclosure of this patent document contains material which is subject to (copyright or mask work) protection. The (copyright or mask work) owner has no objection to the facsimile reproduction by anyone of the patent document or the patent disclosure, as it appears in the Patent and Trademark Office patent file or records, but otherwise reserves all (copyright or mask work) rights whatsoever.

CROSS-REFERENCE TO RELATED APPLICATIONS (Not Applicable)

FEDERALLY SPONSORED RESEARCH (Not Applicable)

COMPUTER-PROGRAM-LISTING APPENDIX

The applicant submitted a computer-program-listing appendix via the United States Patent and Trademark Office Electronic Filing System. The computer-program-listing appendix is included with this application and the entire contents of the computer-program-listing appendix is incorporated herein by reference. The computer-program-listing appendix consists of the following ASCII-text files.

| FILE NAME | FILE SIZE | DATE OF CREATION |
|---|---|---|
| BIGS903.txt | 90 KB on disk | Dec. 1, 2013 |
| BIGS906.txt | 70 KB on disk | Dec. 1, 2013 |
| BIGS907.txt | 299 KB on disk | Dec. 25, 2013 |
| BIGS908.txt | 516 KB on disk | Nov. 28, 2013 |
| BIGS910.txt | 53 KB on disk | Dec. 1, 2013 |
| BIGS912.txt | 45 KB on disk | Dec. 1, 2013 |
| BIGS914.txt | 233 KB on disk | Dec. 1, 2013 |
| BIGS919.txt | 287 KB on disk | Dec. 30, 2013 |
| BIGS921.txt | 106 KB on disk | Dec. 30, 2013 |
| BIGS923.txt | 131 KB on disk | Dec. 29, 2013 |
| BIGS928.txt | 74 KB on disk | Dec. 29, 2013 |
| BIGS929.txt | 70 KB on disk | Dec. 1, 2013 |
| BIGS931.txt | 16 KB on disk | Nov. 28, 2013 |
| BIGS981.txt | 78 KB on disk | Dec. 29, 2013 |
| BIGS987.txt | 319 KB on disk | Nov. 28, 2013 |
| BIGS988.txt | 514 KB on disk | Nov. 28, 2013 |
| Prototype_1.txt | 61 KB on disk | Nov. 18, 2013 |
| Prototype_3.txt | 115 KB on disk | Nov. 18, 2013 |
| Prototype_5.txt | 123 KB on disk | Nov. 18, 2013 |
| Prototype_7.txt | 123 KB on disk | Nov. 18, 2013 |
| Prototype_9.txt | 123 KB on disk | Nov. 18, 2013 |
| Prototype_10.txt | 147 KB on disk | Nov. 18, 2013 |
| Prototype_11.txt | 152 KB on disk | Nov. 18, 2013 |
| Prototype_13.txt | 123 KB on disk | Nov. 18, 2013 |
| Prototype_14.txt | 127 KB on disk | Nov. 18, 2013 |
| Prototype_16.txt | 127 KB on disk | Nov. 18, 2013 |
| Prototype_17.txt | 90 KB on disk | Nov. 18, 2013 |
| Prototype_18.txt | 94 KB on disk | Nov. 18, 2013 |
| Prototype_19.txt | 94 KB on disk | Nov. 18, 2013 |
| Prototype_20.txt | 90 KB on disk | Nov. 18, 2013 |
| Prototype_21.txt | 90 KB on disk | Nov. 18, 2013 |
| Prototype_22.txt | 94 KB on disk | Nov. 18, 2013 |
| Prototype_23.txt | 94 KB on disk | Nov. 18, 2013 |
| Prototype_24.txt | 94 KB on disk | Nov. 18, 2013 |
| Prototype_25.txt | 90 KB on disk | Nov. 18, 2013 |
| Prototype_26.txt | 94 KB on disk | Nov. 18, 2013 |
| Prototype_28.txt | 102 KB on disk | Nov. 18, 2013 |
| Prototype_29.txt | 98 KB on disk | Nov. 18, 2013 |
| Prototype_32.txt | 102 KB on disk | Nov. 18, 2013 |

-continued

| FILE NAME | FILE SIZE | DATE OF CREATION |
|---|---|---|
| Prototype_34.txt | 102 KB on disk | Nov. 18, 2013 |
| Prototype_35.txt | 102 KB on disk | Nov. 18, 2013 |
| Prototype_36.txt | 98 KB on disk | Nov. 18, 2013 |
| Prototype_37.txt | 98 KB on disk | Nov. 18, 2013 |
| Prototype_38.txt | 102 KB on disk | Nov. 18, 2013 |
| Prototype_39.txt | 102 KB on disk | Nov. 18, 2013 |
| Prototype_40.txt | 106 KB on disk | Nov. 18, 2013 |
| Prototype_42.txt | 102 KB on disk | Nov. 18, 2013 |
| Prototype_44.txt | 90 KB on disk | Nov. 18, 2013 |
| Prototype_45.txt | 94 KB on disk | Nov. 18, 2013 |
| Prototype_46.txt | 98 KB on disk | Nov. 18, 2013 |
| Prototype_47.txt | 98 KB on disk | Nov. 18, 2013 |
| Prototype_50.txt | 90 KB on disk | Nov. 18, 2013 |
| Prototype_52.txt | 90 KB on disk | Nov. 18, 2013 |
| Prototype_54.txt | 90 KB on disk | Nov. 18, 2013 |

BACKGROUND

Casino games are currently a multi-billion dollar industry. Casino operators are looking for new games. Therefore, inventors are providing new games.

A table-card game is a card game played on a table. A comparing-card game is a card game wherein players determine the outcome of the game by comparing hand values. A target-numerical-sum game is a comparing-card game wherein players find hand values by comparing hand totals to a target-numerical sum. A hand total is equal to the sum of the numerical values assigned to the cards in a hand.

Accordingly, a target-numerical-sum game is a kind of comparing-card game wherein players determine substantially the outcome of the game by comparing hand totals to a target-numerical sum. A comparing-card game belonging to the Blackjack family of table-card games is a target-numerical-sum game wherein players determine substantially the outcome of the game by comparing hand totals to a target-numerical sum of twenty-one points. A comparing-card game belonging to the Baccarat family of table-card games is a target-numerical-sum game wherein players determine substantially the outcome of the game by comparing hand totals to a target-numerical sum of nine points.

A comparing-card game belonging to the Poker family of table-card games is a card game wherein players determine substantially the outcome of the game by comparing the card combinations in each player's hand to a predetermined hierarchy of poker-hands. Accordingly, a comparing-card game belonging to the Poker family of table-card games is not a target-numerical-sum game.

Comparing-card games belonging to the Blackjack, Baccarat, and Poker families of table-card games are some of the most popular card games ever devised. Those skilled in the art know well the methods of playing at least some of these card games. The methods of play involve a predetermined set of game rules.

The predetermined set of game rules consists of a general set of game rules and a specific set of game rules. The general set of game rules is a subset of the predetermined set of game rules shared by all comparing-card games belonging to the family of table-card games. The general set of game rules specifies the steps of agreeing upon a predetermined set of game rules, identifying each of at least one player position and at least one dealer position, providing at least one deck of cards, a player making a game wager, a dealer dealing cards to form a set of hands, the dealer establishing hand values, the dealer determining the outcome of the game by comparing hand values, and the dealer resolving the game wager based on the outcome of the game.

The specific set of game rules is a subset of the predetermined set of game rules shared by one-comparing-card game belonging to the family of table-card games and all variants of the one-comparing-card game. The specific set of game rules specifies how players practice the steps specified by the general set of game rules.

In order to provide further descriptions of the conventional methods of play of card games belonging to the Blackjack, Baccarat, and Poker families of table-card games, the applicant hereby incorporates by reference each of the following United States patents. U.S. Pat. No. 7,942,418 issued May 17, 2011 to Amaitis et al discloses a card game with counting. The author of the patent divided the detail description section of the specification into a set of subsections. The author labeled each of the set of subsections using a Roman numeral and a title. In subsection XII, entitled "Rules of Card Games", the author provides a description of rules of conventional methods of playing Poker and Blackjack. U.S. Pat. No. 7,419,160 issued Sep. 2, 2008 to D'Ambrosio discloses a method of playing a baccarat variant. In the background section of the specification of the patent, the author provides a description of the rules of a conventional method of playing Baccarat.

Comparing-card games belonging to the above-described families of table-card games have the following advantages. One advantage is the popularity of the comparing-card games. Another advantage is players easily recognize the comparing-card games. People have played various versions of the comparing-card games for hundreds of years. Therefore, a third advantage is casino operators do not have to pay licensing fees to an inventor for the right to use the conventional methods of playing the comparing-card games.

However, comparing-card games belonging to new families of table-card games might also have advantages. One advantage is the comparing-card games enable casino operators to differentiate themselves from competitors in the market place. Another advantage is the comparing-card games enable casino operators to attract players to their casino that might otherwise spend their time and money at a competitor's casino. Because the comparing-card games are new, no precedent has been set regarding the predetermined set of game rules. Therefore, if the comparing-card games prove to be attractive enough to players, then a third advantage is gaming authorities can configure the predetermined sets of game rules so as to enable casino operators to profit from offering the comparing-card games to players. If offering the comparing-card games proves to be profitable enough to casino operators, then a fourth advantage is casino operators can afford to pay licensing fees to an inventor for the right to use the methods of playing the comparing-card games.

A desirable aspect of target-numerical-sum games is play that involves number adding activity. A desirable aspect of comparing-card games belonging to the Poker family of table-card games is play that involves pattern recognizing activity. However, comparing-card games can be made more attractive with play that combines the number adding activity of target-numerical-sum games with the pattern recognizing activity of comparing-card games belonging to the Poker family of table-card games.

Thus far, comparing-card games belonging to new families of table-card games have not proven to be attractive enough to players. What is needed, possibly, is Finnish 27.

SUMMARY

Finnish 27 is a new family of table-card games. Table-card games belonging to the Finnish 27 family are comparing-card games.

Each comparing-card game belonging to the Finnish 27 family of table-card games is subject to its' own predetermined set of game rules. The predetermined set of game rules corresponds substantially to a set of game rules selected from a group. The group consists of every set of game rules that could possibly be made by a software means for making the set of game rules. A set of software applications provides the software means. A computer-program-listing appendix includes source codes for the set of software applications. The computer-program-listing appendix is attached to this patent application.

Accordingly, a comparing card game belonging to the Finnish 27 family of table-card games is a target-numerical-sum game wherein players determine substantially the outcome of the game by comparing hand totals to a target-numerical sum of twenty-seven points. However, some embodiments combine the number adding activity of target-numerical-sum games with the pattern recognizing activity of comparing-card games belonging to the Poker family of table-card games. In accordance with the predetermined set of game rules of the some embodiments, players determine exceptionally the outcome of the game by comparing the combination of cards in each hand to a predetermined hierarchy of poker hand ranks and/or the dealer pays the player a bonus when the player's winning hand includes a qualifying-poker hand.

Method 1 of the claims provides a summary of a general set of game rules shared by all comparing-card games belonging to the Finnish 27 family of table-card games. Methods 2 through 12 of the claims provide a summary of a specific set of game rules shared by one comparing-card game belonging to the Finnish 27 family of table-card games and all variants of the one comparing-card game. The advantages of a comparing-card game belonging to the Finnish 27 family of table-card games will become apparent from a consideration of the ensuing description and accompanying drawings.

BRIEF DESCRIPTION OF THE DRAWINGS

FIG. 10 shows an example of a table saved to text file by the BIGS929 software application;

DETAILED DISCUSSION OF THE GENERAL SET OF GAME RULES AND RULE VARIATIONS

Figure 1:
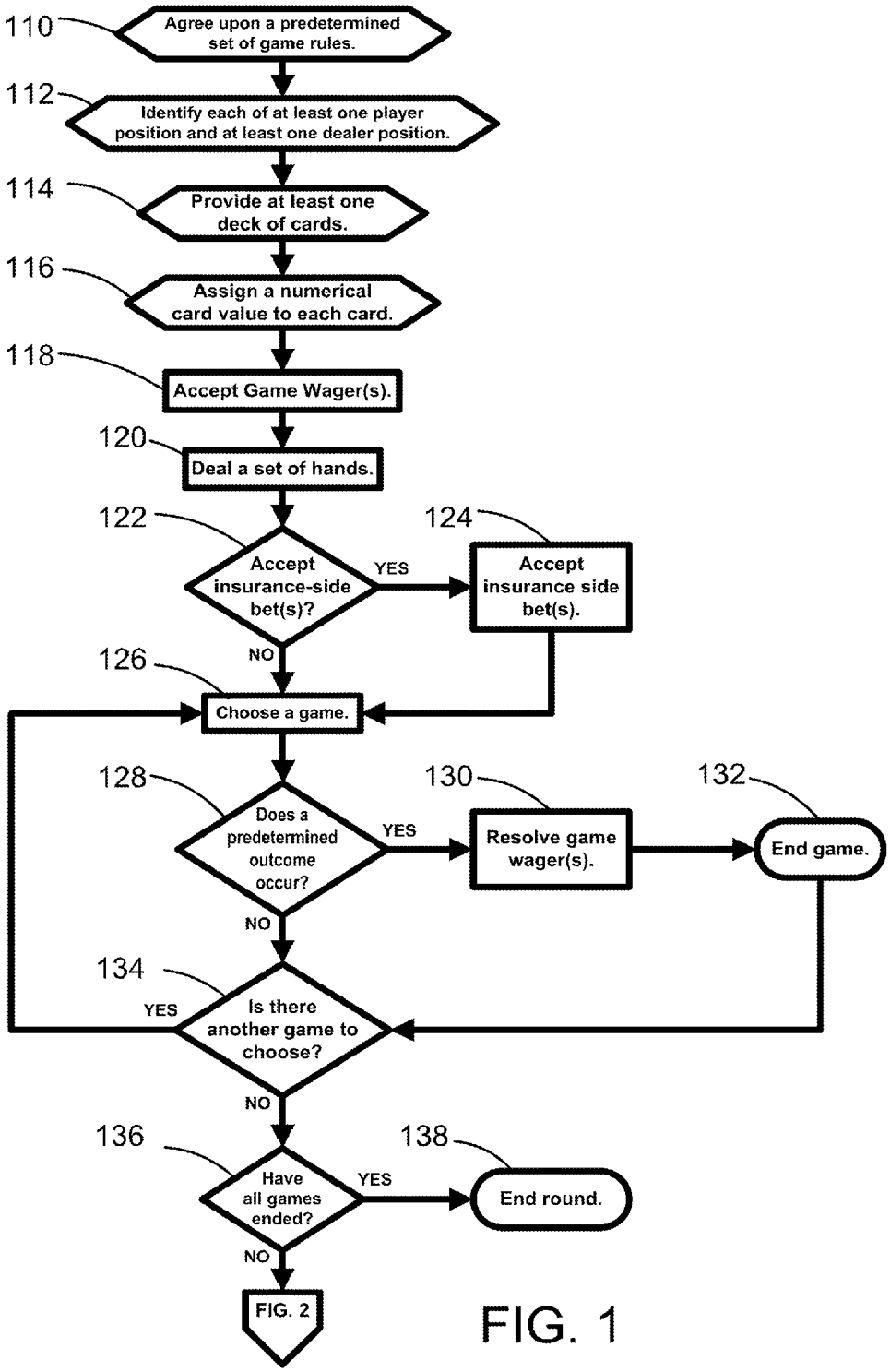
FIG. 1 is a drawing of part one of a three-part-flow chart for use in providing a schematic representation of the sequence of operations according to the predetermined set of game rules specified for any of a subset of comparing-card games belonging to the Finnish 27 family of table-card games.

The general set of game rules common to all comparing-card games belonging to the Finnish 27 family of table-card-games and rule variations common to various optional embodiments will be described herein after with reference to the accompanying drawings.

In the following description, for purposes of explanation and not limitation, specific details are set forth in order to provide a thorough understanding of the general set of game rules and rule variations. However, one skilled in the art may practice the invention in other embodiments that depart from these specific details. In other instances, the applicant has omitted detailed descriptions of well-known methods and devices in the detailed discussion in order to limit unnecessary detail.

Method of Play

Reference is now made to the figures wherein like parts are referred to by like numerals throughout. Referring generally to FIG. 1, FIG. 2, FIG. 3, FIG. 4, FIG. 5, FIG. 6, FIG. 8, and FIG. 9, the present invention is a method and apparatus 410, 510, and 610, for conducting a comparing-card game belonging to the Finnish 27 family of table-card games.

A method of play is a sequence of operations. A three-part-flow chart appears in a set of figures consisting of FIG. 1, FIG. 2, and FIG. 3. As stated in the description of drawings, the three-part-flow chart is for use in providing schematic representation of the sequence of operations according to the predetermined set of game rules specified for any of a subset of comparing-card games belonging to the Finnish 27 family of table-card games.

The three-part-flow-chart includes forty-four-flow-chart shapes. Text appears within each of the forty-four-flow-chart shapes. The text either describes an operation in the sequence of operations or describes a subset of operations within the sequence of operations. Flow-chart shapes are linked to one another by lines with arrow heads representing the direction of the sequence of operations.

The forty-four-flow-chart shapes consist of hexagonal shapes, rectangular shapes, diamond shapes, oval shapes, and irregular-pentagonal shapes. Text describing preparatory operations appears within four hexagonal shapes. Text describing process operations appears within sixteen rectangular shapes. Text describing decision operations appears within fourteen diamond shapes. Text describing end points in the sequence of operations appears within six oval shapes. Four irregular-pentagonal shapes are off-page connectors. Text appearing within the four irregular-pentagonal shapes indicates either the sequence of operations now moves to a following figure in the set of figures or the sequence of operations now continues from a preceding figure in the set of figures.

Agreeing Upon a Predetermined Set of Game Rules

A game can not be played unless the host and all players agree upon a predetermined set of game rules. Accordingly, the first operation shown in the three-part-flow chart is agree upon a predetermined set of game rules 110. In accordance with step (a) of method 1, the general set of game rules does specify agreeing upon a predetermined set of game rules, so that the predetermined set of game rules corresponds substantially to a set of game rules selected from a group consisting of every set of game rules that can possibly be made by a software means for making the set of game rules.

The software means for making the set of game rules is an integral part of a software means for simulating the play of a comparing-card game belonging to the Finnish 27 family of table-card games. Two software applications provide users with a software means for simulating the play of a comparing-card game belonging to the Finnish 27 family of table-card games. The two software applications are the BIGS908 software application and the BIGS988 software application. The computer-program-listing appendix includes the source code of each of the two software applications.

The BIGS908 software application enables the user to simulate the play of millions of rounds of the game of any of a subset of comparing-card games belonging to the Finnish 27 family of table-card games. Each game of the subset is subject to a user-defined set of game rules that includes the following three rules. The dealer forms the player's initial hand by dealing two cards. The dealer forms the dealer's initial hand by dealing two cards. The dealer reveals the point values assigned to the two cards in the dealer's initial hand before proceeding to any additional steps required to complete the player's hand.

The BIGS988 software application enables the user to simulate the play of millions of rounds of the game of any of a subset of comparing-card games belonging to the Finnish 27 family of table-card games. Each game of the subset is subject to a user-defined set of game rules that includes the following three rules. The dealer forms the player's initial hand by dealing two cards. The dealer forms the dealer's initial hand by either dealing a first card face down and a second card face up or by dealing a first card face up, proceeding through any additional steps required to complete the player's hand, and dealing a second card face up. If the dealer forms the dealer's initial hand by dealing a first card face down and a second card face up, then the dealer displays the first card face up after proceeding through any additional steps required to complete the player's hand.

Each of the two software applications is a game simulator. Each game simulator requires the user to respond to a series of prompts for user input. The series of prompts for user input enables the user to program the game simulator to make a set of game rules in accordance with various restrictions imposed upon the set of game rules by the game simulator. These various restrictions insure that all optional embodiments of a comparing-card game belonging to the Finnish 27 family of table-card games are novel.

Identifying Each of at Least One Player Position and at Least One Dealer Position The second operation shown in the three-part-flow chart is identify each of at least one player position and at least one dealer position 112. In accordance with step (b) of method 1, the general set of game rules does specify identifying each of at least one player position and at least one dealer position. The specific set of game rules does specify how step (b) of method 1 is practiced.

The comparing-card game belonging to the Finnish 27 family is a table-card game. Accordingly, the location of each of the positions is on a table. The table could be physical. For examples, see FIG. 4 and FIG. 5. The table could be computer based. For example, see FIG. 6. The table could be a hybrid using some live aspects and some electronic aspects. For example, the applicant hereby incorporates by reference the following United States patent. U.S. Pat. No. 7,775,887 issued Jul. 20, 2010 to Kuhn, et al discloses computer table systems with multiple displays and below table processor.

Providing at Least One Deck of Cards

The third operation shown in the three-part-flow chart is provide at least one deck of cards 114. In accordance with step (c) of method 1, the general set of game rules does specify providing at least one deck of cards so that the at least one deck of cards is either at least one deck of physical cards or at least one deck of cards depicted on a monitor, so that each card bears indicia representative of a rank selected from a group of ranks consisting of ace, two, three, four, five, six, seven, eight, nine, ten, jack, queen, king, and joker, and so that each card that bears a rank selected from a group consisting of ace, two, three, four, five, six, seven, eight, nine, ten, jack, queen, and king also bears indicia representative of a suit selected from a group of four suits such as a group of four suits consisting of spades, hearts, clubs, and diamonds.

However, the general set of game rules does not specify the number of the at least one deck of cards, the precise composition of each deck of cards, and the style of indicia appearing on the front side of each card. Rather, the specific set of game rules does specify how step (c) of method 1 is practiced. Accordingly, the specific set of game rules does specify the number of the at least one deck of cards, the precise composition of each deck of cards, and the style of indicia appearing on the front side of each card.

Accordingly, the number of the at least one deck of cards could be any number of decks specified by the specific set of game rules. Accordingly, the composition of each deck could be a conventional composition of fifty-two cards, a supplemented composition of more than fifty-two cards or a modified composition of less than fifty-two cards. Accordingly, the style of indicia appearing on the front side of each card could be any style specified by the specific set of game rules.

The style of indicia appearing on the front side of each card could be the ubiquitous Anglo-American style of indicia. If the Anglo-American style of indicia is the style of indicia appearing on the front of each card, then a hand consisting of an ace and a king makes a hand popularly known by the nick name "Big Slick". Accordingly, Big Slick is the preferred name of any comparing-card game belonging to the Finnish 27 family of table-card games that is played using at least one deck of cards bearing Anglo-American style indicia.

The preferred style of indicia is Finnish style indicia exemplified by Turun Linna cards circa 1960. The defining characteristic of the Finnish style indicia is the alphanumeric symbols appearing on the front side of each card. The following applies to the alphanumeric symbols appearing on cards bearing the Finnish style of indicia. No alphanumeric symbol appears on each card bearing indicia representing the rank of joker (not shown). The alphanumeric symbol "1" appears on each card bearing indicia representative of the rank of ace. For example, see 710. The alphanumeric symbol "13" appears on any card bearing indicia representative of the rank of king. For example, see 712. The alphanumeric symbol "12" appears on any card bearing indicia representative of the rank of queen. For example, see 714. The alphanumeric symbol "11" appears on any card bearing indicia representative of the rank of Jack. For example, see 716. The alphanumeric symbol appearing on each card bearing indicia representative of a rank selected from a group consisting of two, three, four, five, six, seven, eight, nine, and ten, corresponds to the rank of the card (not shown).

Other characteristics of Finnish style indicia include the following. Each card bearing indicia representative of a rank selected from a group consisting of ace, two, three, four, five, six, seven, eight, nine, ten, jack, queen, and king also bears indicia representative of a suit selected from a group consisting of spades, hearts, clubs, and diamonds. For examples, see 710, 712, 714, and 716. The back side of each Turun Linna card bears a depiction of Turku castle (not shown). Turun Linna is a castle monument of Finnish history situated in the city of Turku in Finland. The front side of each card bearing indicia representative of the rank of ace depicts an elaborate scroll-like framework with a helmet from a suit of armor at the top of the framework, with a helmet from a suit of armor at the bottom of the framework, and with the framework enclosing a symbol representative of the suit of the each card. For example, see 710. The front side of face cards depict portraits of Swedish royalty who ruled Finland in the sixteenth and seventeenth centuries when Finland was part of the Swedish Empire. For examples, see 712, 714, and 716. The front side of each joker depicts a portrait of a minstrel playing a medieval lute (not shown).

Providing at Least One Deck of Cards—Shuffling

Shuffling is the process of bringing the cards of a stack into a substantially random order. Shuffling the cards is, typically though not necessarily, included as part of the step of providing at least one deck of cards.

Assigning a Numerical Value to Each Card

The fourth operation shown in the three-part-flow chart is assign a numerical value to each card 116. In accordance with step (d) of method 1, the general set of game rules does specify assigning a numerical value to each card of the at least one deck of cards in accordance the following set of rules.

If a card bears indicia representative of the rank of ace, then the value of the card is a value selected from a group consisting of one point or fourteen points. The specific set of game rules does specify how step (d) of method 1 is practiced. Accordingly, the specific set of game rules does specify how the value of a card bearing indicia representative of the rank of ace is selected.

If a card bears indicia representative of a rank selected from a group consisting of two, three, four, five, six, seven, eight, nine, and ten, then the value of the card is the number of points the corresponds to the numerical-face value of the card. If a card bears indicia representative of the rank of jack, then the value of the card is eleven points. If a card bears indicia representative of the rank of queen, then the value of the card is twelve points. If a card bears indicia representative of the rank of king, then the value of the card is thirteen points.

If a card bears indicia representative of the rank of joker, then the value of the card is a value selected from a group consisting of zero points and any number of points required to make a hand total of twenty-seven points. The specific set of game rules does specify how step (d) of method 1 is practiced. Accordingly, the specific set of game rules does specify how the value of a card bearing indicia representative of the rank of joker is selected.

Accepting, from the Player, a Game Wager

The fifth operation shown in the three-part-flow chart is accept game wager(s) 118. In accordance with step (e) of method 1, the general set of game rules does specify accepting, from the player, a game wager corresponding to one of the at least one player position. However, the specific set of game rules does specify how step (e) of method 1 is practiced.

A wager is an agreement between two parties that the one who has made an incorrect prediction about an uncertain outcome will forfeit a stipulated item of value to the other. Accordingly, the game wager is an agreement between the player and the dealer that the party who has made an incorrect prediction about the uncertain outcome of the game will forfeit a stipulated item of value to the other.

A wager is also the stipulated item of value staked on an uncertain outcome. Accordingly, the game wager is also the stipulated item of value staked on the uncertain outcome of the game.

In the case of the game wager, the stipulated item of value is, typically though not necessarily, an item of value representative of a certain amount of currency. Casino tokens, (also known as casino or gaming chips, checks or cheques), are small disks used in lieu of currency in casinos. In live versions of table games, players, typically though not necessarily, use tokens made of a material selected from a group consisting of injection-molded plastic, and compressed molded clay. In slot machines, players, typically though not necessarily, use tokens made of metal. Casino tokens typically come in various denominations. Casino tokens are also widely used as play money in casual or tournament games.

In some casinos, players also use rectangular gaming plaques for high stakes table games. Plaques differ from chips in that they are larger, usually rectangular in shape and contain serial numbers.

Figure 4:
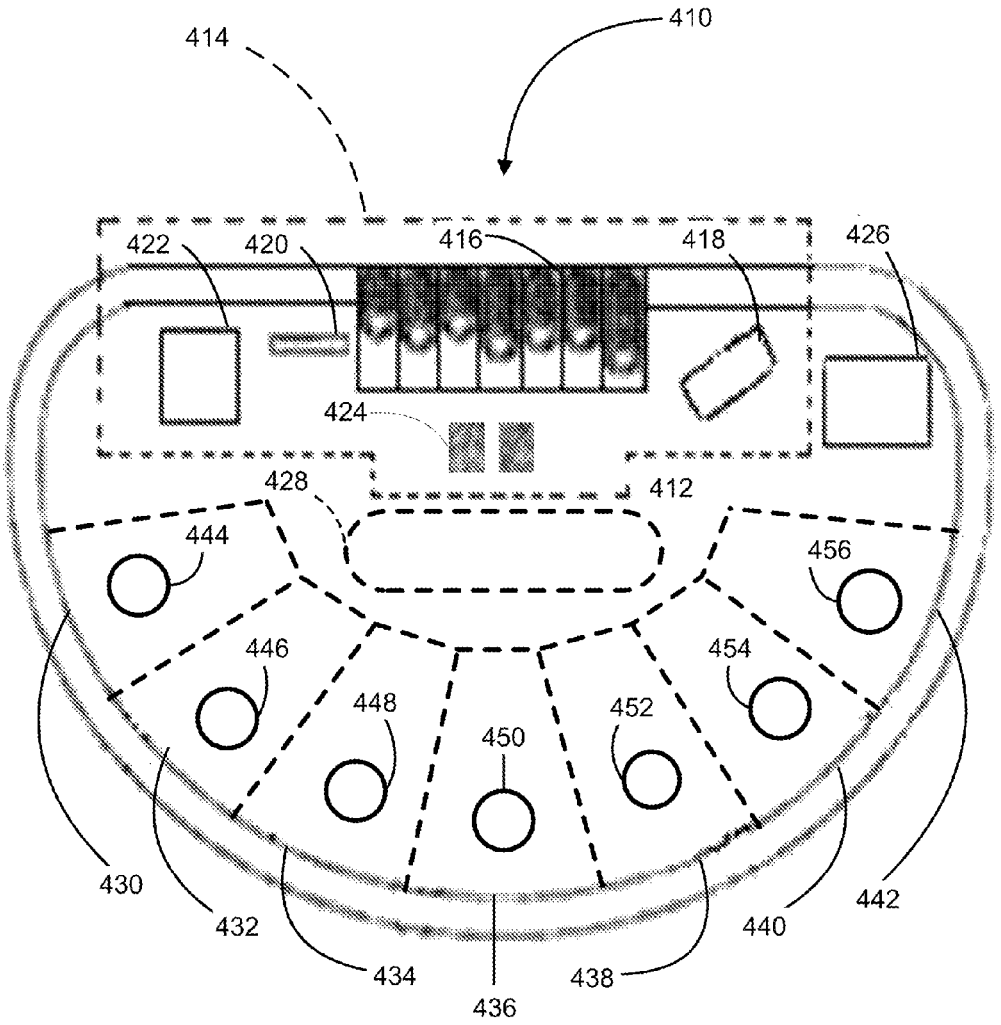
FIG. 4 is a top plan view of a table configured for use with various-optional embodiments.
Figure 5:
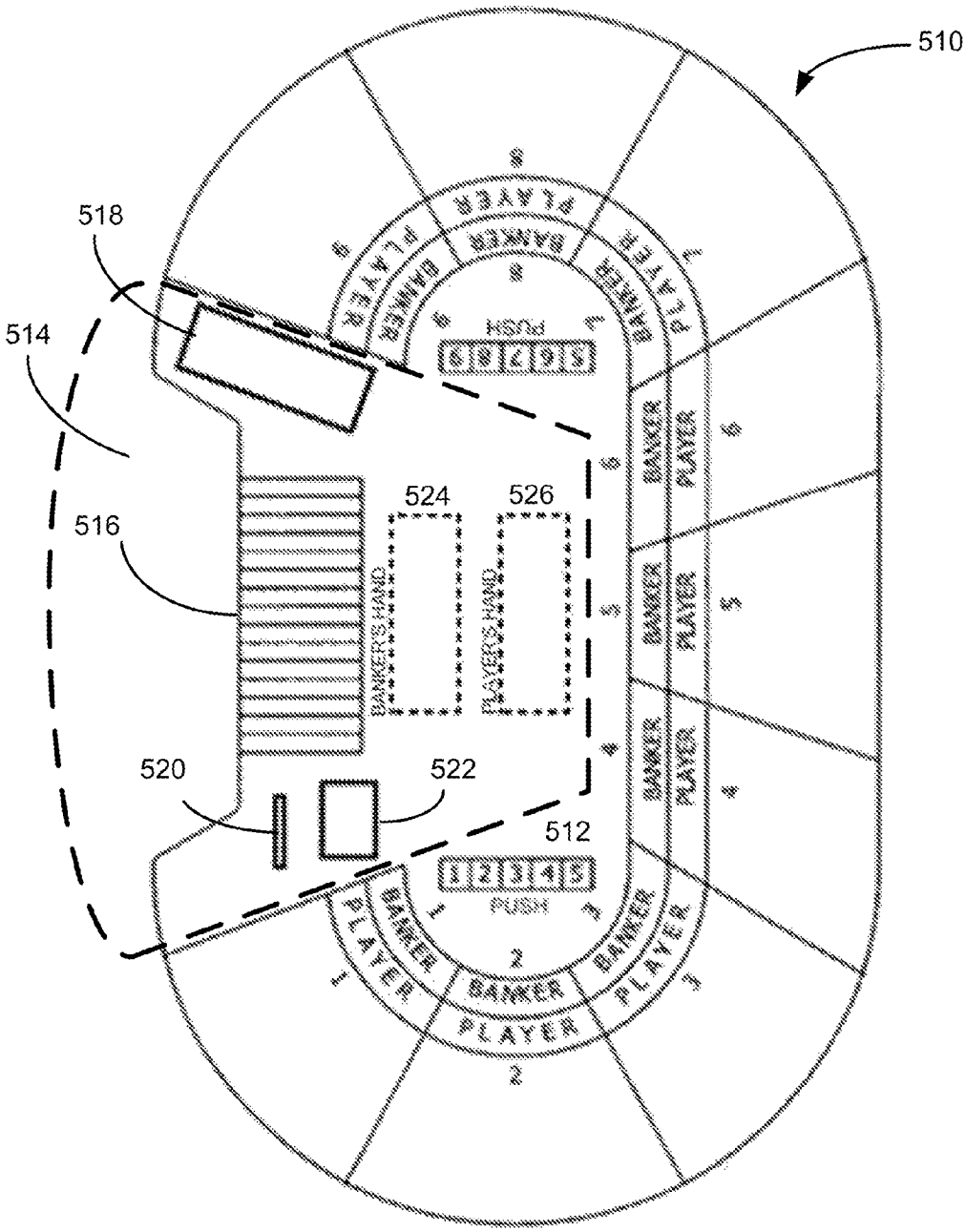
FIG. 5 is a top plan view of a table configured for use with various-optional embodiments.

Accordingly, at a table 410 such as is illustrated in FIG. 4 and at a table 510 such as is illustrated in FIG. 5, the act of accepting a game wager from the player entails the player placing a set of casino tokens in a betting area corresponding to the player position occupied by the player. Typically though not necessarily, the player can withdrawal or purchase a combination of cash and casino tokens at a cashier station using known means, for example cash, credit cards, cheques, debit cards etc. Afterward, the player can proceed to the gaming table. At the table, the player is able to use the casino tokens to place a game wager on the game present. If the player requires so, then the player will exchange cash, or perhaps casino tokens, plaques or other items of monetary value with the dealer for a number of casino tokens. Afterward, the player can use these casino tokens to place a game wager.

Figure 6:
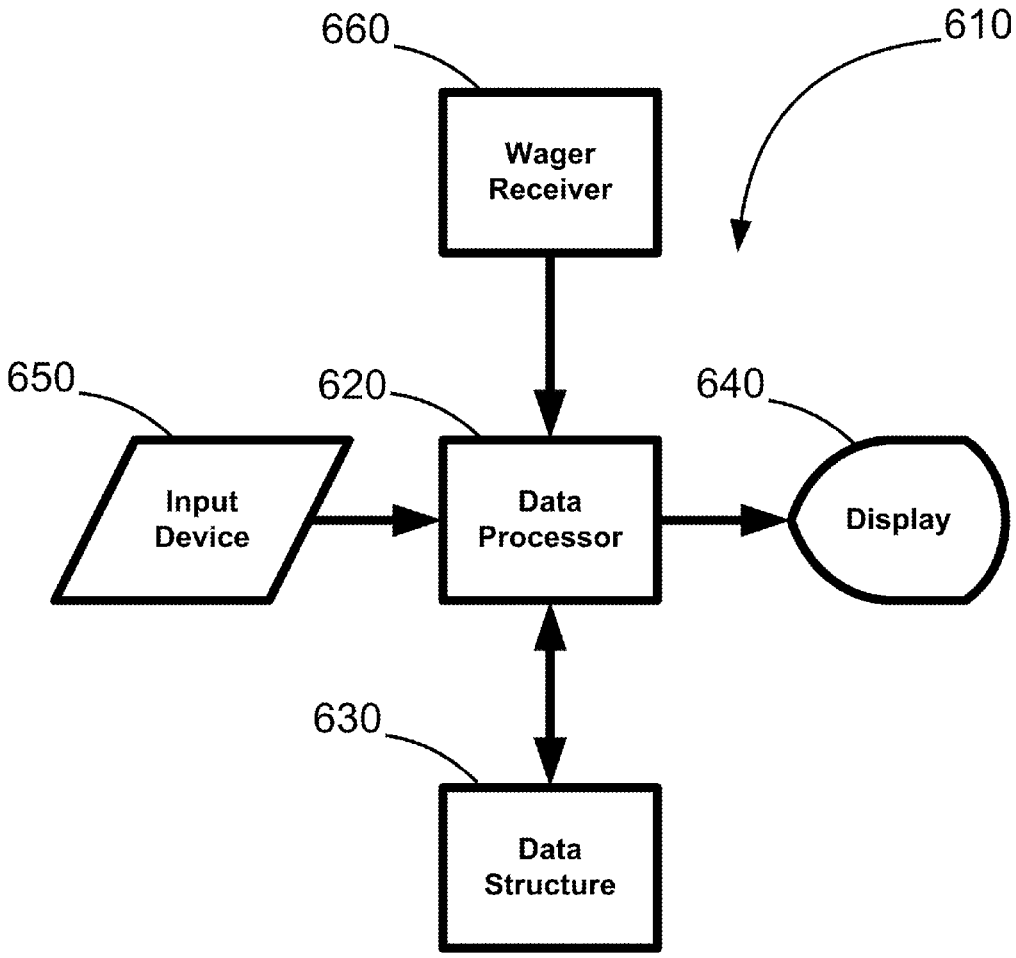
FIG. 6 is a block diagram of a device according to various-optional embodiments.
Figure 7:
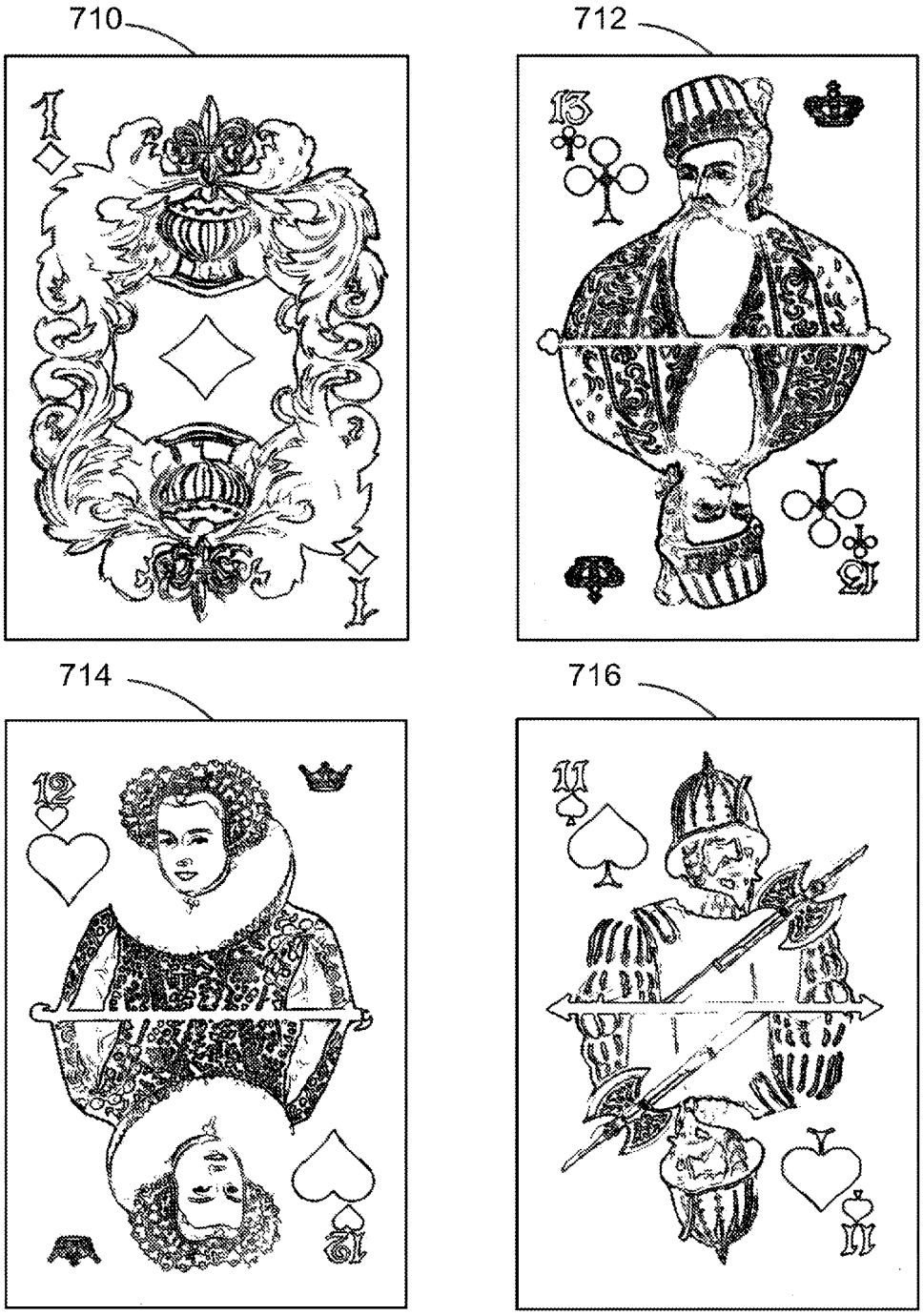
FIG. 7 is a set of drawings depicting the indicia appearing on the front side of each of a set of cards consisting of a representative sample of face cards and ace cards belonging to a deck of Turun Linna cards circa 1960.

At a computer based table such as is displayed by the device 610 illustrated in FIG. 6, the act of accepting a game wager from the player entails the player placing a game wager corresponding to one of the at least one player position via an electronic wagering system. Many casino operators have eliminated use of casino tokens in favor of electronic wagering systems. An electronic wagering system is a computer or server and any related hardware, software, or other device, such as a paper receipt or a prepaid card, that permits wagering to be conducted at a gaming table electronically.

At a hybrid table using some live aspects and some electronic aspects, the act of accepting a game wager from the player could either entail the player placing a set of casino tokens in a betting area corresponding to the player position occupied by the player, or could entail the player placing a game wager corresponding to the player position occupied by the player via an electronic wagering system.

Dealing a Set of Hands

The sixth operation shown in the three-part-flow chart is deal a set of hands 120. In accordance with step (f) of method 1, the general set of game rules does specify the step of dealing a set of hands, so that the set of hands consists of a player's hand and a dealer's hand, so that the player's hand consists of at least two cards, so that the dealer's hand consists of at least one card, so that the player's hand corresponds to a position selected from a group consisting of the one of at least one player position and one of the at least one dealer position, and so that the dealer's hand corresponds to one of the at least one dealer position.

However, the specific set of game rules does specify how step (f) of method 1 is practiced. In the case of a gaming machine, the gaming machine usually acts as the dealer. In the case of a live table game, the dealer is typically a person. In the case of a hybrid table game using some electronic aspects and some live aspects, the dealer could be a person or a data processor could act as the dealer.

If the specific set of game rules does specify dealing at least two cards to form a player's hand corresponding to one of the at least one player position, and if the player wins the game and receives a predetermined payout on the game wager by correctly betting that the outcome of the game will be the player's hand wins, then people could play the live version of the game on a table 410 as illustrated in FIG. 4. The table 410 may have a planar top surface 412. Those skilled in the art of designing tables for gaming establishments typically, though not necessarily, put the dealer position 414 on one side of the table 410. The dealer position 414 may include a place for the dealer to stand, a chip rack 416, a card shoe 418, a slot 420 for a drop box (not shown, but typically secured to the underside of the table 410), a discard collection area 422, and a dealer hand area 424. Note that not all of these elements are necessary for a dealer position 414. Likewise, the applicant presently contemplates additional elements or repositioning of these elements as being within the scope of the present disclosure.

If the specific set of game rules does specify dealing at least two cards to form a player's hand corresponding to one of the at least one dealer position, if the player wins the game and receives a predetermined payout on the game wager by correctly betting that the outcome of the game will be an outcome selected by the player from a group consisting of the player's hand wins, the dealer's hand wins, and a stalemate, then people could play the live version of the game on a table 510 as illustrated in FIG. 5. The table 510 may have a planar top surface 512. Those skilled in the art of designing tables for gaming establishments typically, though not necessarily, put the dealer position 514 on one side of the table 510. The dealer position 514 may include a place for the dealer to stand, a chip rack 516, a card shoe 518, a slot 520 for a drop box (not shown, but typically secured to the underside of the table 510), a discard collection area 522, a dealer hand area 524, and a player hand area 526. FIG. 5 shows the phrase "BANKER'S HAND" printed on the top surface and across one of the long sides of the dealer hand area 524. FIG. 5 shows the phrase "PLAYER'S HAND" printed on the top surface and across one of the long sides of the player hand area 526. Note that not all of these elements are necessary for a dealer position 514. Likewise, the applicant presently contemplates additional elements, renaming elements or repositioning of these elements as being within the scope of the present disclosure.

The chip racks 416 and 516 include tubes or slots sized to handle a number of casino tokens as is well understood. In practice, the dealer places casino tokens of differing denominations in different tubes or slots. The dealer removes casino tokens to pay winning wagers and collects casino tokens into the chip racks 416 and 516 as the dealer collects losing wagers.

The shoes 418 and 518 may include a shuffler or just dispense cards as is well understood in the casino industry. For example, the applicant hereby incorporates by reference the following United States patent. U.S. Pat. No. 6,254,096 issued Jul. 3, 2001 to Attila Gauzier, et al discloses a device and method for continuously shuffling cards. The shoes 418 and 518 may be selected as desired from a group consisting of a single-deck shoe and a plural-deck shoe, although the dealer usually only uses shoes for four or more decks.

The slots 420 and 520 provide a place for dealers to insert cash into the drop box. Typically, the dealer accepts cash from a player, provides chips to the player corresponding in value to the received cash, and inserts the received cash into the slots 420 and 520. A pit boss or other supervisory personnel may view and/or record the transaction to assist in the accounting of the gaming establishment. Table game dealers working in the casino industry understand this process well and are familiar with the use of such drop boxes.

The dealer may use the discard collection areas 422 and 522 to collect used cards after completion of a game. The cards may be stacked neatly on the table surface or passed through an aperture into a locked container for later inspection and disposal as is well understood. Other discard collection mechanisms are also possible without departing from the scope of the present disclosure.

The dealer's hand area 424 and 524 is the space into which the dealer deals his own hand. The dealer's hand area 424 and 524 may have square indicia printed on the top surface 412 and 512 so that it is clear that cards placed proximate thereto are the dealer's cards. Other techniques of denoting the dealer's hand area 424 and 524 are possible without departing from the scope of the present disclosure.

The player's hand area 526 is the space into which the dealer deals the player's hand. The player's hand area 526 may have square indicia printed on the top surface 512 so that it is clear that cards placed proximate thereto are the player's cards. Other techniques of denoting the player's hand area 524 are possible without departing from the scope of the present disclosure.

A placard 426 may indicate the minimum and maximum bets, as well as any other rules particular to the table 410. Those skilled in the art of making tables for gaming establishments may print other rule indicia 428 on the top surface 412 as is well understood.

Those skilled in the art of making tables for gaming establishments put at least one player position at the table on a curved side opposite the dealer position 414. FIG. 4 shows seven player positions labeled 430, 432, 434, 436, 438, 440, and 442. The number of player positions is not restricted to seven, but can be a lesser or greater number depending upon the preference of the host.

Each player position may have the outline of a betting area printed on the top surface 412 as is well understood. FIG. 4 shows seven betting circles labeled 444, 446, 448, 450, 452, 454, and 456. That is the outline of one betting area for each of seven player positions. Note that the outline of the betting area could be in the shape of a box, a triangle, a trapezoid, any other shape, or those skilled in the art of making tables for gaming establishments might omit the outline of the betting area all together. Additional elements or repositioning of these elements is possible without departing from the scope of the present disclosure.

FIG. 5 shows nine player positions. The number of player positions is not restricted to nine, but can be a lesser or greater number depending upon the preference of the host.

Each player position may have the outline of three areas for betting printed on the top surface 512. FIG. 5 shows nine areas for betting the outcome of the game will be the player's hand wins, nine areas for betting the outcome of the game will be the dealer's hand wins, and ten areas for betting the outcome of the game will be the hands push (a stalemate). FIG. 5 shows the word "PLAYER" printed on the top surface 512 inside each of the nine areas for betting the outcome of the game will be the player's hand wins. FIG. 5 shows the word "BANKER" printed on the top surface inside of each of the nine areas for betting the outcome of the game will be the dealer's hand wins. FIG. 5 shows the ten areas for betting the outcome of the game will be a stalemate printed on the top surface in two groups of five areas.

The first group of five areas for betting the outcome of the game will be a stalemate is printed on the top surface adjacent to positions 1, 2, 3, 4, and 5. The second group of five areas for betting the outcome of the game will be a stalemate is printed on the top surface adjacent to player positions 5, 6, 7, 8, and 9. FIG. 5 shows the word "PUSH" printed on the top surface 512 adjacent to each of the two groups of five areas. FIG. 5 shows a number printed on the top surface 512 inside each of the ten areas. The number does identify the player position corresponding to each of the ten areas for betting the outcome of the game will be a stalemate.

A table could be computer based. For example, an apparatus 610 includes a data processor 620. The data processor 620 could take any form. The data processor 620 communicates with a display 640, optionally through a display controller. The display 640 could be any form including cathode ray tube ("CRT"), liquid crystal display ("LCD"), plasma, or the like. The data processor 620 also communicates with a wager receiver 660. The wager receiver 660 could be any means for receiving a wager or wager data. For example, the wager receiver 660 could receive coins, bills, tokens, encoded vouchers, tickets, or script, account data, such as banking or credit card data, or any other form of data or media representing a wager. The data processor 620 also communicates with an input device 650. The input device 650 could include any device usable by the player to input information, such as buttons, a keypad, or keyboard, a touch screen, or any other input device.

A data structure 630 communicating with the data processor 620 stores electronic representations of cards, a set of game rules including pay outs, and instructions executable by the data processor 620 for conducting a game method. The data structure 630 could be any structure for storing data including any type of optical, magnetic, flash, electrical, or electronic memory, in any form, such as random access memory ("RAM"), read-only memory ("ROM"), or any of the many variations thereon. It is also noted that each of these elements, i.e. the data processor 620, data structure 630, display 640, input device 650, and wager receiver 660, need not be physically proximate but may be remote from one another and, in such an embodiment, could communicate via computer network, telephone line, wireless communication, the Internet, or the like.

Insurance-Side Bet

An insurance-side bet is an agreement between the player and the dealer wherein the player predicts the dealer's initial hand does consist of an ace and a king, wherein the dealer predicts the dealer's initial hand does not consist of an ace and a king, and wherein the one who has made an incorrect prediction about the uncertain combination of cards in the dealer's initial hand agrees to forfeit a stipulated item of value to the other.

If the player makes the incorrect prediction, then the stipulated item of value is the value of the insurance-side bet. If the dealer makes the incorrect prediction, then the stipulated item of value is the value of predetermined odds on the insurance-side bet.

The uncertainty of the combination of cards in the dealer's initial hand is achieved by dealing one card in the dealer's initial hand face up. In an optional embodiment wherein the dealer forms the dealer's initial hand by dealing a first card face down and a second card face up, the uncertainty of the combination of cards in the dealer's initial hand is achieved by dealing the first card face down. In an optional embodiment wherein the dealer forms the dealer's initial hand by dealing a first card face up, proceeding through any additional steps required to complete the player's hand, and dealing a second card face up, the uncertainty of the combination of cards in the dealer's initial hand is achieved by dealing the second card after proceeding through any additional steps required to complete the player's hand. In an optional embodiment wherein the dealer forms the dealer's initial hand by dealing two cards, and wherein the dealer reveals the point values assigned to the two cards before proceeding to any additional steps required to complete the player's hand, the uncertainty of the combination of cards in the dealer's initial hand is achieved by dealing the first card face down and the second card face up before deciding whether to accept the insurance-side bet(s) from the player(s) 122.

As shown in 122, the dealer decides whether to accept the insurance-side bet(s) from the player(s). In some optional embodiments, the dealer always decides not to accept the insurance-side bet(s) from the player(s) 122. If the dealer always decides not to accept the insurance-side bet(s) from the player(s), if the dealer forms the dealer's initial hand by dealing two cards, and if the dealer reveals the point values assigned to the two cards before proceeding to any additional operations required to complete the player's hand, then the dealer forms the dealer's initial hand by dealing the two cards face up.

In other optional embodiments, the dealer decides to accept the insurance-side bet(s) from the player(s) when certain-predetermined conditions are present. In those cases, the dealer only decides to accept the insurance-side bet(s) 122 from the player(s) when the certain-predetermined conditions are present, and otherwise the dealer decides not to accept the insurance-side-bet(s) from the player(s) 122.

In an optional embodiment, the certain-predetermined conditions are the dealer's initial hand includes an ace dealt face up. Accordingly, the dealer only decides to accept the insurance-side bet(s) from the player(s) when the dealer's initial hand includes an ace dealt face up, and otherwise the dealer decides not to accept the insurance-side bet(s) from the player(s).

In an optional embodiment, the certain-predetermined conditions are the dealer's initial hand includes a king dealt face up. Accordingly, the dealer only decides to accept the insurance-side bet(s) from the player(s) when the dealer's initial hand includes a king dealt face up, and otherwise the dealer decides not to accept the insurance-side bet(s) from the player(s).

In an optional embodiment, the certain-predetermined conditions are the dealer's initial hand includes a card selected from a group consisting of an ace dealt face up and a king dealt face up. Accordingly, the dealer only decides to accept the insurance-side bet(s) from the player(s) when the dealer's initial hand includes a card selected from a group consisting of an ace dealt face up and a king dealt face up, and otherwise the dealer decides not to accept the insurance-side bet(s) from the player(s).

In an optional embodiment, if the dealer does decide to accept the insurance-side bet(s) from the player(s), then the dealer requires the player(s) to make the insurance-side bet (s). If the dealer does require the player(s) to make the insurance-side bet(s), then, for each game wager, the player who made the game wager must make an insurance-side bet.

In an optional embodiment, if the dealer does decide to accept the insurance-side bet(s) from the player(s), then the dealer offers the player(s) an opportunity to make the insurance-side bet(s). If the dealer does offer the player(s) an opportunity to make the insurance-side bet(s), then, for each game wager, the player who made the game wager may either opt to make an insurance-side bet or opt not to make an insurance-side bet.

In some optional embodiments, the value of the insurance-side bet is equal to a stipulated multiple of the value of the game wager. For example, the value of the insurance-side bet is equal to the value of the game wager multiplied by one half. In other optional embodiments, the value of the insurance-side bet is any value less than or equal to a stipulated multiple of the value of the game wager. For example, the value of the insurance-side bet is any value less than or equal to the value of the game wager multiplied by one half.

If the dealer forms the dealer's initial hand by dealing a first card face down and a second card face up, then the dealer uses memory of the specific set of game rules to make a decision as to whether the dealer displays the first card face up before proceeding to operation 126 wherein: If the second card in the dealer's initial hand could be a card included in any combination of two cards that beats any player's hand consisting of at least three cards, then, without revealing any information to the player about the indicia appearing on the face of the first card in the dealer's initial hand, the dealer examines the first card in search of the any combination of two cards that beats any player's hand consisting of at least three cards wherein: If the dealer does find the any combination of two cards in the dealer's initial hand that beats any player's hand consisting of at least three cards, then the dealer does display the first card face up before proceeding to operation 126. If the dealer does not find a combination of two cards in the dealer's initial hand that beats any player's hand consisting of at least three cards, then the dealer does not display the first card face up before proceeding to operation 126.

If the dealer does accept insurance-side bet(s) from the player(s) under certain circumstances, and if the dealer does reveal the point values assigned to the two cards in the dealer's initial hand before proceeding to any additional operations required to complete the player's hand, then the dealer always displays the first card face up before proceeding to operation 126.

Establishing Hand Values

In accordance with step (g) of method 1, the general set of game rules does specify the step of establishing hand values. The specific set of game rules does specify how step (g) of method 1 is practiced.

The five basic types of hands are soft hand, hard hand, predetermined-winning-complete hand, predetermined-losing-complete hand, and predetermined-stalemating-complete hand. The four basic types of hand values are the value of a hand total, the value of a predetermined-winning-complete hand, the value of a predetermined-losing-complete hand, and the value of a predetermined-stalemating-complete hand. The closer a hand total is to the target-numerical sum of twenty-seven points the higher is the value of the hand total. A predetermined-winning-complete hand has a higher value than any hand with the value of a hand total. A predetermined-losing-complete hand has a lower value than any hand with the value of a hand total. A predetermined-stalemating-complete hand has the same value as any hand with the value of a hand total.

Hard Hands and Soft Hands

A hand consists of a set of cards. Two of the five basic types of hands are soft hands and hard hands. If a hand includes an ace counted as fourteen points, then the hand is a "soft" hand. Otherwise, the hand is a "hard" hand. If the sum of the point values assigned to the cards in a hard hand does exceed twenty-seven points, then the holder of the hand does bust. However, if the sum of the point values assigned to the cards in a soft hand does exceed twenty-seven points, then the value of the ace counted as fourteen points changes to one point, and the soft hand becomes a hard hand.

Hard Total and Soft Total

A hand total is equal to the sum of the point values assigned to the cards in a hand. There are two basic types of hand totals. A soft total is the hand total of a soft hand. For example, "soft twenty-five" is the soft total of a soft hand consisting of an ace of diamonds and a jack of diamonds. A hard total is the hand total of a hard hand. For example, "hard twenty-three" is the hard total of a hard hand consisting of an ace of spades, a nine of diamonds, and a king of clubs.

In some optional embodiments, if any hand consists of a pair of jokers, then the hand total is twenty-seven points. In some optional embodiments, if any hand consists of two cards, and if the any hand includes one joker, then the hand total is twenty-seven points. In some optional embodiments, if any hand consists of two cards, if any rank other than joker is the rank of the first card dealt to form the any hand, and joker is the rank of the second card dealt to form the any hand, then the hand total is twenty-seven points. In some optional embodiments, if any hand includes at least one joker, then the hand total is twenty-seven points.

Determine Whether a Predetermined Outcome Occurs 128

After the initial deal, the dealer uses memory of the specific set of game rules to choose a game 126. If the round of play involves a single game, then the dealer chooses the single game. If the round of play involves a plurality of games, then the dealer typically, though not necessarily, chooses the game played at the player position farthest to the left of the dealer's position, and continues to choose games in a clockwise manner until the dealer has chosen all games once.

After choosing a game, the specific set of game rules determines how the dealer proceeds. If the specific set of game rules does not include a set of rules specifying the defining characteristics of at least one hand selected from a group consisting of a predetermined-winning-complete hand, a predetermined-losing-complete hand, and a predetermined-stalemating-complete hand, then the dealer decides a predetermined outcome does not occur 128. If the specific set of game rules does include a set of rules specifying the defining characteristics of at least one hand selected from a group consisting of a predetermined-winning-complete hand, a predetermined-losing-complete hand, and a predetermined-stalemating-complete hand, then the dealer examines initial hands in search of a hand selected from a group consisting of a predetermined-winning-complete hand, a predetermined-losing-complete hand and a predetermined-stalemating-complete hand wherein: If the dealer does not find the hand, then the dealer decides a predetermined outcome does not occur 128. If the dealer does find the hand, then the dealer decides a predetermined outcome does occur 128.

In any case, the dealer eventually proceeds to operation 134 wherein: If there is at least one additional game to choose, then the dealer again proceeds to operation 126 and continues thereafter in a like manner until there is no other game to choose 134. Afterward, the dealer proceeds to operation 136 wherein: If all games have ended, then the round of play ends 138. If at least one game has not ended, then the dealer proceeds to operation 210.

Establishing Hand Values—Playing the Player's Hand

As shown in 210, the dealer again uses memory of the specific set of game rules to choose a game. If the round of play involves a single game, then the dealer chooses the single game. If the round of play involves a plurality of games, then the dealer typically, though not necessarily, chooses the game played at the player position farthest to the left of the dealer's position, and continues to choose games in a clockwise manner until the dealer has chosen all games once.

As shown in 212, after choosing a game 210, the dealer uses memory of the specific set of game rules to make a decision on whether to consult with the player for a decision on how to play the player's hand. If the dealer decides not to consult with the player for a decision on how to play the player's hand, then the dealer uses memory of a predetermined strategy for the play of the player's hand to make a decision for the player on how to play the player's hand. The predetermined strategy for the play of the player's hand specifies an operation selected from a set of operations. The set of operations includes hit 214 and stand 230 and may also include none, some or all of a subset of operations consisting of double down 218, split 222, and surrender 228.

If the dealer decides to consult with the player for the decision on how to play the player's hand, then the player makes the decision on how to play the player's hand by selecting an operation from a set of operations. The set of operations includes hit 214 and stand 230 and may also include none, some or all of a subset of operations consisting of double down 218, split 222, and surrender 228.

After an operation is selected, then the dealer executes the operation. If the player does surrender 230, then the player's hand is complete. If the player does stand 234, then the player's hand is complete. If the player does hit 214, then the dealer deals one additional card to the player's hand 216. If the player does double down 218, then the player doubles the game wager 220, and the dealer deals one additional card to the player's hand 216.

If the player does split 222, then the player makes another game wager 224, and the dealer splits the player's hand into two post-split hands 226. The two post-split hands compete against the same dealer hand during the same round of play. The controlling player does play both of the post-split hands at a single player position. The two post-split hands involve the controlling player in the play of two games. The outcome of each of the two games is independent of the outcome of the other of the two games. Accordingly, the resolution of each of the two game wagers is independent of the resolution of the other of the two game wagers.

If the dealer deals one additional card to the player's hand 216, then the dealer adds to the player's hand total, Subsequently, the dealer again uses memory of the specific set of game rules to decide whether to consult with the player for a decision on how to play the player's hand 212. The dealer continues in a like manner until the player's hand is complete. If the player's hand total exceeds twenty-six points, then the player must stand.

If the player does stand 230, then the specific set of game rules determines how the dealer proceeds. If the specific set of game rules does not include a set of rules specifying the defining characteristics of at least one hand selected from a group consisting of a predetermined-winning-complete hand, a predetermined-losing-complete hand, and a predetermined-stalemating-complete hand, then the dealer decides a predetermined outcome does not occur 232. If the specific set of game rules does include a set of rules specifying the defining characteristics of at least one hand selected from a group consisting of a predetermined-winning-complete hand, a predetermined-losing-complete hand, and a predetermined-stalemating-complete hand, then the dealer examines the player's complete hand in search of a hand selected from a group consisting of a predetermined-winning-complete hand, a predetermined-losing-complete hand and a predetermined-stalemating-complete hand wherein: If the dealer does not find the hand, then the dealer decides a predetermined outcome does not occur 232. If the dealer does find the hand, then the dealer decides a predetermined outcome does occur 232.

In any case, the dealer eventually proceeds to operation 238 wherein: If there is at least one additional game to choose, then the dealer again proceeds to operation 210 and continues thereafter in a like manner until there in no other game to choose 238. Afterward, the dealer proceeds to operation 310 wherein: If all games have ended 310, then the round of play ends 312. If at least one game has not ended, then the dealer proceeds to operation 314.

Establishing Hand Values—Playing the Dealer's Hand

As shown in 314, the dealer plays the dealer's hand. The dealer does so in accordance with a predetermined strategy.

The software means for making a set of game rules supports a set of twenty-seven of the possible strategies for the play of the dealer's hand.

In each optional embodiment, the specific set of game rules specifies a single one of the twenty-seven-supported strategies for the play of the dealer's hand as the predetermined strategy for the play of the dealer's hand. The dealer uses the predetermined strategy for the play of the dealer's hand to play all of the dealer's hands.

The predetermined strategy for the play of the dealer's hand specifies a target-numerical sum for the play of the dealer's hard hands and a target-numerical sum for the play of the dealer's soft hands. To use any given predetermined strategy for the play of the dealer's hand to make decisions on how to play the dealer's hand, the dealer does the following. If the dealer's hand total is less than the target-numerical sum specified for the type of hand the dealer has, then the dealer hits. If the dealer's hand total is at least equal to the target-numerical sum specified for the type of hand the dealer has, then the dealer stands.

If the dealer hits, then the dealer adds one additional card to the dealer's hand, thereby adding to the hand total. Subsequently, the dealer again uses memory of the predetermined strategy for the play of the dealer's hand to make a decision on how to play the dealer's hand. The dealer continues in a like manner until the dealer stands.

If the dealer stands, then the dealers hand is complete. If the dealer's hand is complete, the dealer proceeds to operation 316.

As shown in 316, after the dealer plays the dealer's hand 314, the dealer uses memory of the specific set of game rules to choose a game 316. If a plurality of games remain, then the dealer typically, though not necessarily, chooses the game at the player position farthest to the left of the dealer's station, and continues to choose games in a clockwise manner until the dealer has chosen all remaining games once.

After choosing a game, the dealer determines whether a predetermined outcome occurs. If the specific set of game rules does not include a set of rules specifying the defining characteristics of at least one hand selected from a group consisting of a predetermined-winning-complete hand, a predetermined-losing-complete hand, and a predetermined-stalemating-complete hand, then the dealer decides a predetermined outcome does not occur 318. If the specific set of game rules does include a set of rules specifying the defining characteristics of at least one hand selected from a group consisting of a predetermined-winning-complete hand, a predetermined-losing-complete hand, and a predetermined-stalemating-complete hand, then the dealer examines complete hands in search of a hand selected from a group consisting of a predetermined-winning-complete hand, a predetermined-losing-complete hand and a predetermined-stalemating-complete hand wherein: If the dealer does not find the hand, then the dealer decides a predetermined outcome 318 does not occur. If the dealer does find the hand, then the dealer decides a predetermined outcome 318 does occur.

In any case, the dealer eventually proceeds to operation 326 wherein: The dealer determines whether all games have ended. If there is at least one game that has not yet ended 326, then the dealer proceeds to choose a game 316 and continues in a like manner until all games have ended. When all games have ended, the dealer ends the round of play 328.

Determining the Outcome of the Game

In accordance with step (h) of method 1, the general set of game rules does specify the step of determining the outcome of the game. However, the specific set of game rules does specify how step (h) of method 1 is practiced.

The game is essentially a contest between the player and the dealer wherein each tries to acquire the hand with the highest value. The hand total with the highest value is twenty-seven points. The closer a hand total is to the target-numerical sum of twenty-seven points, the higher the value of the hand total. If the player's hand total exceeds twenty-seven points, then the player busts. If the dealer's hand total exceeds twenty-seven points, then the dealer busts.

Accordingly, if the hand value of the player's complete hand is a hand total, and if the hand value of the dealer's complete hand is a hand total, then play of the game results in the occurrence of one of four basic types of contests. If the player does not bust, and if the dealer does not bust, then a no-bust contest occurs. If the player does bust, and if the dealer does not bust, then a player-bust contest occurs. If the player does not bust, and if the dealer does bust, then a dealer-bust contest occurs. If the player does bust, and if the dealer does bust, then a double-bust contest occurs.

As shown in 320, if the dealer decides a predetermined outcome does not occur at steps 128, 232, and 318, then the dealer determines the outcome of the game by comparing hand totals to the target numerical sum of twenty-seven points 320 wherein: If the dealer decides a predetermined outcome does not occur at step 320, then the dealer determines the outcome of the game in accordance with the following set of rules: If the player's hand total is closer to twenty-seven points than is the dealer's hand total, then the outcome of the game is the player's hand wins. If the dealer's hand total is closer to twenty-seven points than is the player's hand total, then the outcome of the game is the dealer's hand wins. If the player's hand total is as close to twenty-seven points as is the dealer's hand total, then the outcome of the game is an outcome selected from a group consisting of the player's hand wins, the dealer's hand wins and a stalemate. Accordingly, if the dealer decides a predetermined outcome does not occur at steps 128, 232, 318, and 320, then the dealer determines the outcome of the game in accordance with the above-described set of game rules regardless of the type of contest that occurs.

However, if the dealer decides a predetermined outcome does occur at step 128, 232, 318, or 320, then the dealer determines the outcome of the game in accordance with the following set of rules. If the player's hand is a predetermined-winning-complete hand, then the outcome of the game is the player's hand wins. If the player's hand is a predetermined-losing-complete hand, then the outcome of the game is the dealer's hand wins. If the player's hand is a predetermined-stalemating-complete hand, then the outcome of the game is a stalemate. If the dealer's hand is a predetermined-winning-complete hand, then the outcome of the game is the dealer's hand wins. If the dealer's hand is a predetermined-losing-complete hand, then the outcome of the game is the player's hand wins. If the dealer's hand is a predetermined-stalemating-complete hand, then the outcome of the game is a stalemate.

No-Bust-Win Contest

In all optional embodiments, if the no-bust contest does occur, then the dealer determines the outcome of the game by comparing hand totals to the target-numerical sum of twenty-seven points in accordance with the following set of rules. If the player's hand total is closer to twenty-seven points than is the dealer's hand total, then the outcome of the game is the player's hand wins. If the dealer's hand total is closer to twenty-seven points than is the player's hand total, then the outcome of the game is the dealer's hand wins. If the player's hand total is as close to twenty-seven points as is the dealer's hand total, then the outcome of the game is an outcome selected from a group consisting of the player's hand wins, the dealer's hand wins and a stalemate.

Accordingly, the no-bust contest may be described succinctly as a no-bust-win contest. For the player, the best possible outcome in a no-bust-win contest is the player's hand wins. For the dealer, the best possible outcome in a no-bust-win contest is the dealer's hand wins.

Rule Variations: Player-Wins-Ties Contest, Dealer-Wins-Ties Contest, and Nobody-Wins-Ties Contest If the dealer decides a predetermined outcome does not occur at steps 128, 232, and 318, and if the player's hand total is as close to twenty-seven points as is the dealer's hand total, then a tie-score contest occurs 320.

In some optional embodiments, if the tie-score contest does occur, then the outcome of the game is the dealer's hand wins 320 unless a predetermined outcome does occur 320. Accordingly, the contest may be described succinctly as a dealer-wins-ties contest.

In other optional embodiments, if the tie-score contest does occur, then the outcome of the game is the player's hand wins 320 unless a predetermined outcome does occur 320. Accordingly, the contest may be described succinctly as a player-wins-ties contest.

In still other optional embodiments, if the tie-score contest does occur, then the outcome of the game is a stalemate 320 unless a predetermined outcome does occur 320. Accordingly, the contest may be described succinctly as a nobody-wins-ties contest.

Rule Variations: Player-Bust-Loss Contest, Player-Bust-Push Contest, and Player-Bust-Win Contest In some optional embodiments, if the player-bust contest occurs, then the player's hand is a predetermined-losing-complete hand, a predetermined outcome does occur 320, and the outcome of the game is the dealer's hand wins. Accordingly, the player-bust contest may be described succinctly as a player-bust-loss contest. The only possible outcome in a player-bust-loss contest is the dealer's hand wins.

In other optional embodiments, if the player bust contest occurs, then the dealer determines the outcome of the game 320 by comparing hand totals to the target-numerical sum of twenty-seven points in accordance with the following set of rules. If the player's hand total is closer to twenty-seven points than is the dealer's hand total, then the player's hand is a predetermined-stalemating-complete hand, a predetermined outcome does occur 320, and the outcome of the game is a stalemate. If the player's hand total is as close to twenty-seven points as is the dealer's hand total, and if the player-wins-ties contest does occur, then the player's hand is a predetermine-stalemating-complete hand, a predetermined outcome does occur 320, and the outcome of the game is a stalemate. If the player's hand total is as close to twenty-seven points as is the dealer's hand total, and if the nobody-wins-ties contest does occur, then the outcome of the game is a stalemate. If the player's hand total is as close to twenty-seven points as is the dealer's hand total, and if the dealer-wins-ties contest does occur, then the outcome of the game is the dealer's hand wins. If the dealer's hand total is closer to twenty-seven points than is the player's hand total, then the outcome of the game is the dealer's hand wins.

Accordingly, the player-bust contest may be described succinctly as a player-bust-push contest. For the player, the best possible outcome in a player-bust-push contest is a stalemate. For the dealer, the best possible outcome in a player-bust-push contest is the dealer's hand wins.

In still other optional embodiments, if the player-bust contest does occur, then the dealer determines the outcome of the game 320 by comparing hand totals to the target-numerical sum of twenty-seven points in accordance with the following set of rules. If the player's hand total is closer to twenty-seven points than is the dealer's hand total, then the outcome of the game is the player's hand wins. If the player's hand total is as close to twenty-seven points as is the dealer's hand total, and if the player-wins-ties contest does occur, then the outcome of the game is the player's hand wins. If the player's hand total is as close to twenty-seven points as is the dealer's hand total, and if the nobody-wins-ties contest does occur, then the outcome of the game is a stalemate. If the player's hand total is as close to twenty-seven points as is the dealer's hand total, and if the dealer-wins-ties contest does occur, then the outcome of the game is the dealer's hand wins. If the dealer's hand total is closer to twenty-seven points than is the player's hand total, then the outcome of the game is the dealer's hand wins.

Accordingly, the player-bust contest may be described succinctly as a player-bust-win contest. For the player, the best possible outcome in a player-bust-win contest is the player's hand wins. For the dealer, the best possible outcome in a player-bust-win contest is the dealer's hand wins.

Rule Variations: Dealer-Bust-Loss-Contest, Dealer-Bust-Push Contest, and Dealer-Bust-Win Contest In some optional embodiments, if the dealer-bust contest occurs, then the dealer's hand is a predetermined-losing-complete hand, a predetermined outcome does occur 320, and the outcome of the game is the player's hand wins. Accordingly, the dealer-bust contest may be described succinctly as a dealer-bust-loss contest. The only possible outcome in a dealer-bust-loss contest is the player's hand wins.

In other optional embodiments, if the dealer-bust contest does occur, then the dealer determines the outcome of the game 320 by comparing hand totals to the target-numerical sum of twenty-seven points in accordance with the following set of rules. If the dealer's hand total is closer to twenty-seven points than is the player's hand total, then the dealer's hand is a predetermined-stalemating-complete hand, a predetermined outcome does occur 320, and the outcome of the game is a stalemate. If the dealer's hand total is as close to twenty-seven points as is the player's hand total, and if the dealer-wins-ties contest does occur, then the dealer's hand is a predetermined-stalemating-complete hand, a predetermined outcome does occur 320, and the outcome of the game is a stalemate. If the dealer's hand total is as close to twenty-seven points as is the player's hand total, and if the nobody-wins-ties contest does occur, then the outcome of the game is a stalemate. If the dealer's hand total is as close to twenty-seven points as is the player's hand total, and if the player-wins-ties contest does occur, then the outcome of the game is the player's hand wins. If the player's hand total is closer to twenty-seven points than is the dealer's hand total, then the outcome of the game is the player's hand wins.

Accordingly, the dealer-bust contest may be described succinctly as a dealer-bust-push contest. For the player, the best possible outcome in a dealer-bust-push contest is the player's hand wins. For the dealer, the best possible outcome in a dealer-bust-push contest is a stalemate.

In still other optional embodiments, if the dealer-bust contest does occur, then the dealer determines the outcome of the game 320 by comparing hand totals to the target-numerical sum of twenty-seven points in accordance with the following set of rules. If the dealer's hand total is closer to twenty-seven points than is the player's hand total, then the outcome of the game is the dealer's hand wins. If the dealer's hand total is as close to twenty-seven points as is the player's hand total, and if the dealer-wins-ties contest does occur, then the outcome of the game is the dealer's hand wins. If the dealer's hand total is as close to twenty-seven points as is the player's hand total, and if the nobody-wins-ties contest does occur, then the outcome of the game is a stalemate. If the dealer's hand total is as close to twenty-seven points as is the player's hand total, and if the player-wins-ties contest does occur, then the outcome of the game is the player's hand wins. If the player's hand total is closer to twenty-seven points than is the dealer's hand total, then the outcome of the game is the player's hand wins.

Accordingly, the dealer-bust contest may be described succinctly as a dealer-bust-win contest. For the player, the best possible outcome in a dealer-bust-win contest is the player's hand wins. For the dealer, the best possible outcome in a dealer-bust-win contest is the dealer's hand wins.

Rule Variations: Double-Bust-Loss Contest, Double-Bust-Push Contest, and Double-Bust-Win Contest In some optional embodiments, if the double-bust contest does occur, then the player's hand is a predetermined-losing-complete hand, a predetermined outcome does occur 320, and the outcome of the game is the dealer's hand wins. Accordingly, the double-bust contest may be described succinctly as a double-bust-loss contest. The only possible outcome in a double-bust-loss contest is the dealer's hand wins.

In other optional embodiments, if the double-bust contest does occur, then the dealer determines the outcome of the game 320 by comparing hand totals to the target-numerical sum of twenty-seven points in accordance with the following set of rules. If the player's hand total is closer to twenty-seven points than is the dealer's hand total, then the player's hand is a predetermined-stalemating-complete hand, a predetermined outcome does occur 320, and the outcome of the game is a stalemate. If the player's hand total is as close to twenty-seven points as is the dealer's hand total, and if the player-wins-ties contest does occur, then the player's hand is a predetermined-stalemating-complete hand, a predetermined outcome does occur 320, and the outcome of the game is a stalemate. If the player's hand total is as close to twenty-seven points as is the dealer's hand total, and if the nobody-wins-ties contest does occur, then the outcome of the game is a stalemate. If the player's hand total is as close to twenty-seven points as is the dealer's hand total, and if the dealer-wins-ties contest does occur, then the outcome of the game is the dealer's hand wins. If the dealer's hand total is closer to twenty-seven points than is the player's hand total, then the outcome of the game is the dealer's hand wins.

Accordingly, the double-bust contest may be described succinctly as a double-bust-push contest. For the player, the best possible outcome in a double-bust-push contest is a stalemate. For the dealer, the best possible outcome in a double-bust-push contest is the dealer's hand wins.

In still other optional embodiments, if the double-bust contest does occur, then the dealer determines the outcome of the game 320 by comparing hand totals to the target-numerical sum of twenty-seven points in accordance with the following set of rules. If the player's hand total is closer to twenty-seven points than is the dealer's hand total, then the outcome of the game is the player's hand wins. If the player's hand total is as close to twenty-seven points as is the dealer's hand total, and if the player-wins-ties contest does occur, then the outcome of the game is the player's hand wins. If the player's hand total is as close to twenty-seven points as is the dealer's hand total, and if the nobody-wins-ties contest does occur, then the outcome of the game is a stalemate. If the player's hand total is as close to twenty-seven points as is the dealer's hand total, and if the dealer-wins-ties contest does occur, then the outcome of the game is the dealer's hand wins. If the dealer's hand-total is closer to twenty-seven points than is the player's hand total, then the outcome of the game is the dealer's hand wins.

Accordingly, the double-bust contest may be described succinctly as a double-bust-win contest. For the player, the best possible outcome in a double-bust-win contest is the player's hand wins. For the dealer, the best possible outcome in a double-bust-win contest is the dealer's hand wins.

Rule Variations: Eighty-One Different Types of Contests

The no-bust-win contest, one of the three types of player-bust contests, one of the three types of dealer-bust contests, one of the three types of double-bust contests, and one of the three types of tie-score contests combine in one of eighty-one different ways to yield one of eighty-one different types of contests.

Rule Variations: Dealer-28-Push Rule, Dealer-28-Wins Rule

In some optional embodiments, the specific set of game rules does include the following rule. If the dealer-bust contest does occur, and if the value of the dealer's hand is a hand total of twenty-eight points, then the dealer's hand is a predetermined-stalemating-complete hand, a predetermined outcome does occur 320, and the outcome of the game is a stalemate. The rule may be described succinctly as a dealer-28-push rule.

In some optional embodiments, the specific set of game rules does include the following rule. If the dealer-bust contest does occur, and if the value of the dealer's hand is a hand total of twenty-eight points, then the dealer's hand is a predetermined-winning-complete hand, a predetermined outcome does occur 320, and the outcome of the game is the dealer's hand wins. The rule may be described succinctly as a dealer-28-wins rule.

Rule Variations: Player Bust and Dealer Bust

In some optional embodiments, the specific set of game rules does include the following rule. If the player busts, then the player's hand is a predetermined-losing-complete hand, a predetermined outcome does occur 232, and the outcome of the game is the dealer's hand wins.

In some optional embodiments, the specific set of game rules does include the following rule. If the dealer busts, then the dealer's hand is a predetermined-losing-complete hand, a predetermined outcome does occur 318, and the outcome of the game is the player's hand wins.

Rule Variations: Initial Hands

In some optional embodiments, if any initial hand consists of a pair of jokers, then a predetermined outcome does occur 128 or 318. In some optional embodiments, if any initial hand consists of an ace and a king, then a predetermined outcome does occur 128 or 318. In some optional embodiments, if any initial hand includes one joker, then a predetermined outcome does occur 128 or 318. In some optional embodiments, if the first card dealt to form any initial hand is a card of any rank other than joker, and the second card dealt to form the any initial hand is a joker, then a predetermined outcome does occur 128 or 318.

Rule Variations: Surrender

In some optional embodiments, the player is allowed to surrender 228. If the player does surrender, then the outcome of the game is the player surrenders.

Rule Variations: Player-27-Wins Rule

In some optional embodiments, the specific set of game rules does include the following rule. If the player's hand consists of at least three cards with a numerical sum value of twenty-seven points, then the player's hand is a predetermined-winning-complete hand, a predetermined outcome does occur 232, and the outcome of the game is the player's hand wins. The rule may be described succinctly as a player-27-wins rule.

Rule Variations: Any Hand that Includes at Least One Joker has a Value of Twenty-Seven Points In some optional embodiments, the specific set of game rules includes the following rule. If any hand includes at least one joker, then a predetermined outcome does occur 128, 232, or 318.

Rule Variations: Qualifying-Three-Card-Poker Hands

In some optional embodiments, the specific set of game rules does include the following rule. If the player's hand consists of a card bearing indicia representative of the rank of eight, a card bearing indicia representative of the rank of nine, and a card bearing indicia representative of the rank of ten, then the player's hand is a predetermined-winning-complete hand, a predetermined outcome does occur 232, and the outcome of the game is the player's hand wins.

In some optional embodiments, the specific set of game rules does include the following rule. If the player's hand consists of three cards, and if each of the three cards bears indicia representative of the rank of nine, then the player's hand is a predetermined-winning-complete hand, a predetermined outcome does occur 232, and the outcome of the game is the player's hand wins.

Rule Variations: Qualifying-Five-Card-Poker Hands

In some optional embodiments, the specific set of game rules does include rules made for complete hands that include the five cards of a qualifying-five-card-poker hand wherein: The qualifying-five-card-poker hand is a five-card-poker hand of a rank that is at least equal to a minimum rank specified by the specific set of game rules, and wherein: The qualifying-five-card-poker hand consists of any example of the highest-ranking-five-card-poker hand that can be made from any selection of five of the at least five cards in a complete hand selected from a group consisting of the player's complete hand and the dealer's complete hand.

In order for the player's complete hand to make a qualifying-five-card-poker hand, the player's complete hand must meet the following qualifications. The player's complete hand must consist of at least five cards. The highest-ranking-five-card-poker hand that can be made from any selection of five of the at least five cards in the player's complete hand must be of a rank that is at least equal to a minimum rank specified by the specific set of game rules. If the above-described qualifications are met, then the player's complete hand makes a qualifying-five-card-poker hand consisting of the player's highest-ranking-five-card-poker hand.

In order for the dealer's complete hand to make a qualifying-five-card-poker hand, the dealer's complete hand must meet the following qualifications. The dealer's complete hand must consist of at least five cards. The highest-ranking-five-card-poker hand that can be made from any selection of five of the at least five cards in the dealer's complete hand must be of a rank that is at least equal to a minimum rank specified by the specific set of game rules. If the above-described qualifications are met, then the dealer's complete hand makes a qualifying-five-card-poker hand consisting of the dealer's highest-ranking-five-card-poker hand.

In some optional embodiments, the specific set of game rules does include the following subset of rules. If the dealer's complete hand consists of at least five cards, then the player's highest-ranking-five-card-poker hand must outrank the dealer's highest-ranking-five-card-poker hand is an additional qualification that the player's complete hand must meet in order to make a qualifying-five-card-poker hand. If the player's complete hand consists of at least five cards, then the player's highest-ranking-five-card-poker hand must not outrank the dealer's highest-ranking-five-card-poker hand is an additional qualification that the dealer's complete hand must meet in order to make a qualifying-five-card-poker hand. If the specific set of game rules does include the above-described subset of rules, then the subset of rules may be described succinctly as a "player's poker hand must outrank dealer's poker hand" subset of rules.

In some optional embodiments, the specific set of game rules does include the following rule. Only a complete hand with a numerical sum value of twenty-seven points can make a qualifying-five-card-poker hand.

In some optional embodiments, the specific set of game rules does include the following rule. Only a complete hand with a numerical sum value of less than twenty-eight points can make a qualifying-five-card-poker hand In some optional embodiments, the specific set of game rules does include the following rule. If the player's hand consists of at least five cards with a numerical-sum value of twenty-seven points, and if the player's complete hand includes the five cards of a qualifying-five-card-poker hand, then the player's hand is a predetermined-winning-complete hand, a predetermined outcome does occur 232 or 318, and the outcome of the game is the player's hand wins.

In some optional embodiments, the specific set of game rules does include the following rule. If the player's hand consists of at least five cards with a numerical-sum value of less than twenty-eight points, and if the player's hand includes the five cards of a qualifying-five-card-poker hand, then the player's hand is a predetermined-winning-complete hand, a predetermined outcome does occur 232 or 318, and the outcome of the game is the player's hand wins. The rule may be described succinctly as a poker-hand-27-wins rule. The rule may be described succinctly as the player's poker-hand-wins rule.

In some optional embodiments, the specific set of game rules does include the following rule. If the dealer's hand consists of at least five cards with a numerical sum value of less than twenty-eight points, and if the dealer's hand includes the five cards of a qualifying-five-card-poker hand, then the dealer's hand is a predetermined-winning-complete hand, a predetermined outcome does occur 318, and the outcome of the game is the dealer's hand wins. The rule may be described succinctly as the dealer's poker-hand-wins rule.

In some optional embodiments, the specific set of game rules does include a subset of rules consisting of the two-above-described rules. The subset of rules may be described succinctly as a poker-hand-wins subset of rules.

Rule Variations: Predetermined Set of Hand-Ranking Rules

If the specific set of game rules does include at least one rule made for complete hands that make qualifying-five-card-poker hands, then the specific set of game rules includes a predetermined set of hand-ranking rules. Hands are ranked first by category and second by individual cards.

The predetermined set of hand-ranking rules does specify ten categories of five-card-poker hand. The ten categories of five-card-poker hand are high card, one pair, two pair, three-of-a-kind, straight, flush, full-house, four-of-a-kind, straight-flush, and five-of-a-kind. A subset of the predetermined set of hand-ranking rules does specify the rank assigned to each of the ten categories of five-card-poker hand.

The predetermined set of hand-ranking rules does assign a rank to each-individual card, so that when arranged from lowest ranking to highest ranking the individual cards of each suit are 2, 3, 4, 5, 6, 7, 8, 9, 10, Jack, Queen, King, and Ace. The predetermined set of hand-ranking rules specifies that an ace can appear as the lowest ranking card as when part of a hand selected from a group consisting of an Ace-2-3-4-5 straight and an Ace-2-3-4-5 straight-flush. The predetermined set of hand-ranking rules specifies the use of individual card ranks to rank hands in the same category. The predetermined set of hand-ranking rules specifies the use of suits to determine whether a hand belongs to a category of five-card-poker hand selected from a group consisting of a flush and a straight-flush.

If the specific set of game rules does specify that the composition of each deck includes at least one joker, then the predetermined set of hand-ranking rules does specify the step of assigning a wild card value to each joker in a hand, so that the point value of each joker remains the same as before, and so that each joker becomes an individual card capable of performing a function.

The function performed by each joker is specified by a rule selected from a group of rules consisting of the bug rule and the fully wild rule. If the bug rule is selected, then each joker can be used to perform a function selected from a group consisting of represent an ace, complete a straight, and complete a straight-flush. If the fully wild rule is selected, then each joker can represent the rank and suit of any card.

Resolving the Game Wager

In accordance with step (i) of method 1, the general set of game rules does specify resolving the game wager. However, the specific set of game rules does specify how step (i) of method 1 is practiced.

If a predetermined outcome 128 occurs after the initial deal 120, then the dealer resolves the game wager when the dealer performs operation 130. If a predetermined outcome 232 occurs after the player's hand is complete 230, then the dealer resolves the game wager when the dealer performs operation 234. If a predetermined outcome 318 after the dealer's hand is complete 316. then the dealer resolves the game wager when the dealer performs operation 322. If the dealer determines the outcome of the game by comparing hand totals to the target-numerical sum of twenty-seven points 320, then the dealer resolves the game wager when the dealer performs operation 322.

The dealer resolves the game wager in accordance with the following set of rules. If the outcome of the game is the player's hand wins, then the dealer pays one to one odds on the game wager to the player. If the outcome of the game is the dealer's hand wins, then the dealer collects the game wager. If the outcome of the game is a stalemate, then the dealer returns the game wager to the player.

Rule Variations: Surrender

In some optional embodiments, the player is allowed to surrender. If the outcome of the game is the player surrenders 228, then the dealer resolves the game wager 234 as follows. The dealer divides the game wager into two equal parts, the dealer collects one of the two parts, and the dealer returns one of the two parts to the player.

Rule Variations: Resolution of Insurance-Side Bets

In some optional embodiments, the dealer decides to accept the insurance-side bet(s) from the player(s) when certain-predetermined conditions are present. If the player makes an insurance-side bet, and if the player has made an incorrect prediction about the uncertain combination of cards in the dealer's initial hand, then the stipulated item of value the player agrees to forfeit to the dealer is the value of the insurance-side bet. If the player makes an insurance-side bet, and if the dealer has made an incorrect prediction about the uncertain combination of cards in the dealer's initial hand, then the stipulated item of value the dealer agrees to forfeit to the player is predetermined odds on the value of the insurance-side bet. For example, the dealer agrees to forfeit eleven to one (11:1) odds on the value of the insurance-side bet.

If the player makes an insurance-side bet, then the insurance-side bet is resolved independently of the game wager corresponding to the insurance-side bet. If the dealer forms the dealer's initial hand by dealing a first card face down and a second card face up, then the dealer resolves the insurance-side bet when the dealer chooses the corresponding game 126. If the dealer forms the dealer's initial hand by dealing a first card face up, proceeding through any additional steps required to complete the player's hand, and dealing a second card face up, then the dealer resolves the insurance-side bet when the dealer chooses the corresponding game 316. If the dealer forms the dealer's initial hand by dealing two cards, and if the dealer reveals the point values assigned to the two cards before proceeding to any additional steps required to complete the player's hand, then the dealer resolves the insurance-side bet when the dealer chooses the corresponding game 126.

The dealer resolves each insurance-side bet in accordance with the following set of rules. If the dealer's initial hand does not consist of an ace and a king, then the dealer collects the insurance-side bet from the player. If the dealer's initial hand does consist of an ace and a king, then the dealer pays the player predetermined odds on the insurance-side bet. For example, if the dealer's initial hand does consist of an ace and a king, the dealer pays the player eleven to one (11:1) odds on the insurance-side bet.

Rule Variations: Predetermined Combinations of Cards and Bonus Payouts

In some optional embodiments, if the outcome of the game is the player's hand wins, and if the player's hand includes a predetermined combination of cards, then the dealer pays the player a bonus when the dealer resolves the game wager. The value of the bonus is predetermined in accordance with the specific set of game rules. The value of the bonus could be a fixed amount. For example, the value of the bonus could be nine times the table minimum. The value of the bonus could correspond to the value of the game wager. For example, the value of the bonus could be one to two odds on the game wager.

In some optional embodiments, the specific set of game rules does include the following rule. If the prediction made by the player about the uncertain outcome of the game is the player's hand wins, if the outcome of the game is the player's hand wins, and if the player's complete hand includes the five cards of a particular category of qualifying-five-card-poker hand, then the dealer pays the player a bonus. The rule may be described succinctly as a poker-hand-bonus rule.

Other Rule Variations

The above-described-rule variations are a subset of rule variations made possible by the software means for making a set of game rules. The software means for making a set of game rules makes possible a nearly limitless number, diversity and variety of combinations of rule variations.

In accordance with step (a) of method 1, the predetermined set of game rules corresponds substantially to a set of game rules selected from a group consisting of every set of game rules that can possibly be made by a software means for making the set of game rules. Accordingly, other rule variations are possible without departing from the scope of the present disclosure.

Detailed Discussion of Various Optional Embodiments

The present invention will be described herein after with reference to the prototypes, accompanying drawings and the predetermined sets of game rules which illustrate various optional embodiments. In the following description, for purposes of explanation and not limitation, specific details are set forth in order to provide a thorough understanding of various optional embodiments. However, one skilled in the art may practice the invention in other embodiments that depart from these specific details. In other instances, the applicant has omitted detailed descriptions of well-known methods and devices in the detailed discussion of the invention in order to limit unnecessary detail.

Figure 2:
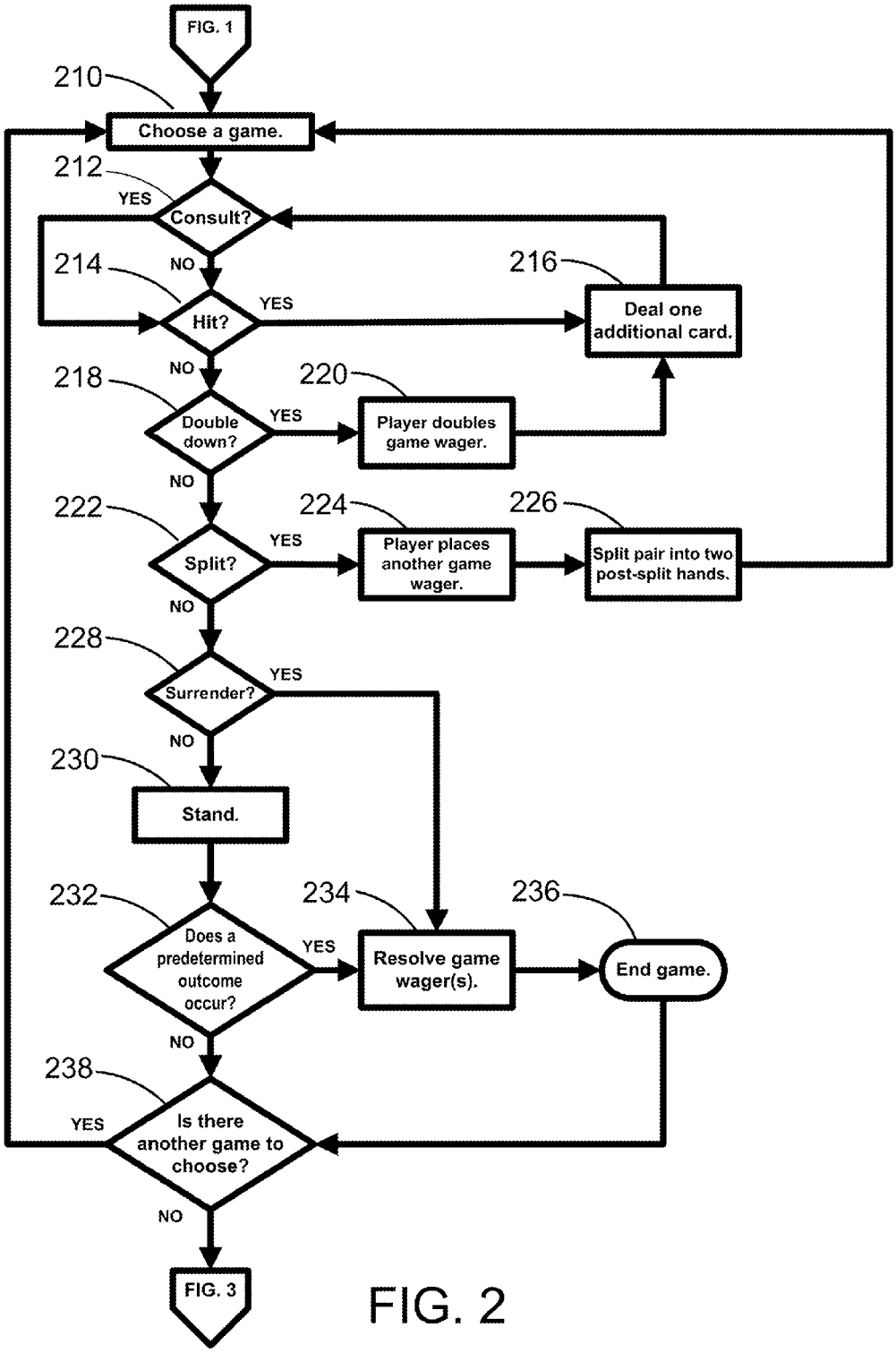
FIG. 2 is a drawing of part two of a three-part-flow chart for use in providing a schematic representation of the sequence of operations according to the predetermined set of game rules specified for any of a subset of comparing-card games belonging to the Finnish 27 family of table-card games.
Figure 3:
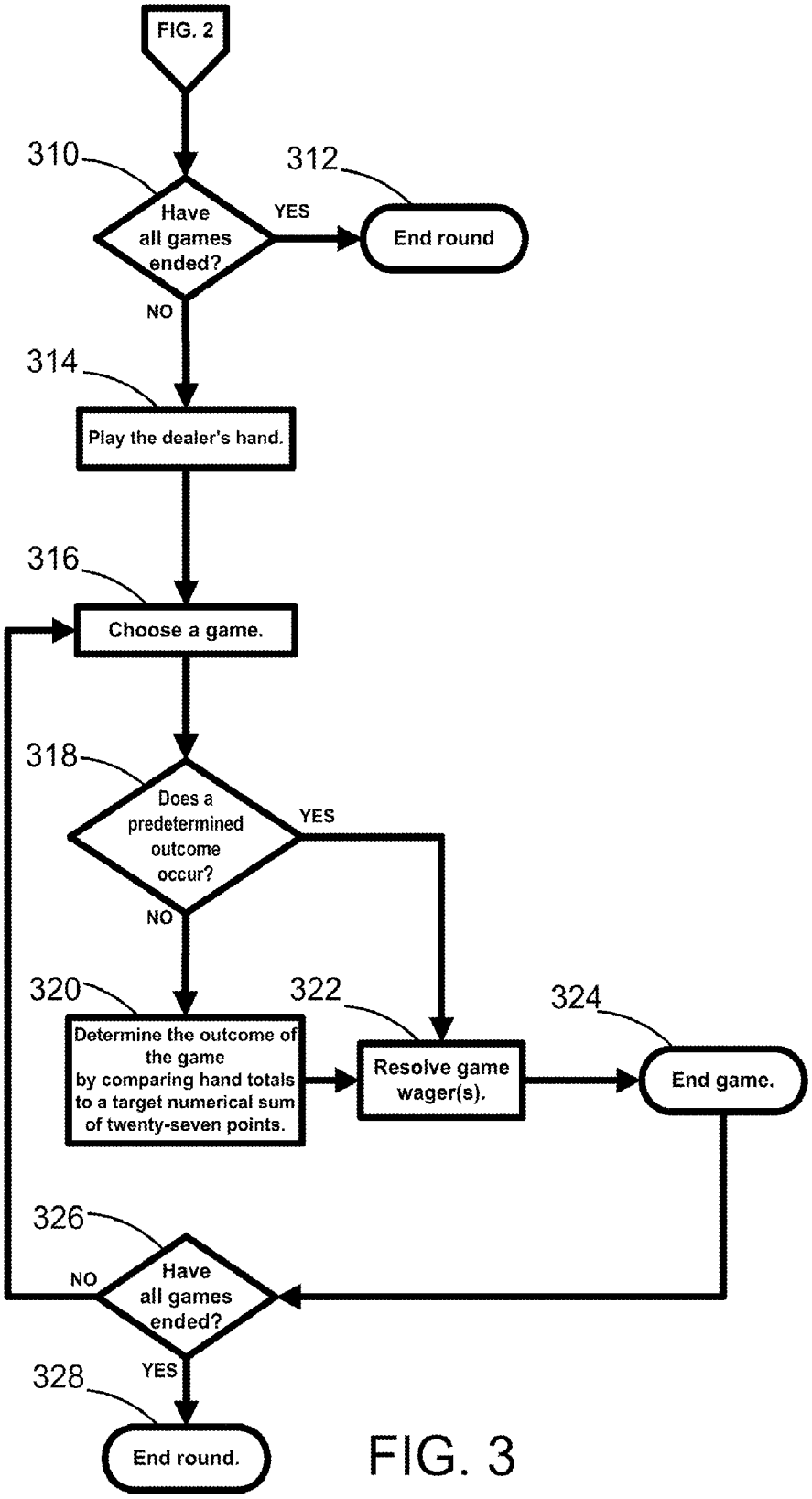
FIG. 3 is a drawing of part three of a three-part-flow chart for use in providing a schematic representation of the sequence of operations according to the predetermined set of game rules specified for any of a subset of comparing-card games belonging to the Finnish 27 family of table-card games.

Method of Play for Multiple-Player-Position Variants of the First-Optional Embodiment The three-part-flow chart of FIG. 1, FIG. 2, and FIG. 3, is for use in providing a schematic representation of the sequence of operations according to the predetermined set of game rules specified for any of a subset of comparing-card games belonging to the Finnish 27 family including multiple-player-position variants of the first-optional embodiment. Accordingly, the following is a description of multiple-player-position variants of the first-optional embodiment, wherein the use of the three-part-flow chart provides a schematic representation of the sequence of operations.

The Predetermined Set of Games Rules and the Claims

The predetermined set of game rules herein ascribed to the first-optional embodiment conforms to the general set of game rules set forth in method 1 of the claims and conforms to the specific set of game rules set forth in methods 2 through 12 of the claims.

Identifying, to a Player, Each of at Least One Player Position and at Least One Dealer Position 114.

The predetermined set of game rules herein ascribed to the first-optional embodiment does include the following subset of game rules. The dealer deals at least two cards to form a player's hand corresponding to one of the at least one player position. The player wins the game and receives a predetermined payout on the game wager by correctly betting that the outcome of the game will be the player's hand wins. Accordingly, people could play the live version of the game on a table with a top-plan view 410 as illustrated in FIG. 4. People could play the electronic version of the game using a device as illustrated in FIG. 6.

Providing at Least One Deck of Cards 114.

According to the predetermined set of game rules herein ascribed to the first-optional embodiment, the at least one deck of cards of clause (c) of method 1 is six decks of cards. Each deck of cards consists of thirteen ranks of each of four French suits plus two jokers. Each card bears Finnish style indicia exemplified by Turun Linna cards circa 1960.

The dealer shuffles the cards either manually, mechanically, or electronically so that the order of the cards is substantially random.

Assigning to Each Card a Numerical Value 116

In accordance with clause (d) of method 1, the predetermined set of game rules herein ascribed to the first-optional embodiment does specify assigning a numerical value to each card. Accordingly, any card bearing indicia representative of the rank of ace has a value selected from a group of values consisting of a value of one point and a value of fourteen points. Any card bearing indicia representative of a rank selected from a group of ranks consisting of two, three, four, five, six, seven, eight, nine, and ten, has a value of the number of points that corresponds to the numerical-face value of the any card. Any card bearing indicia representative of the rank of jack has a value of eleven points. Any card bearing indicia representative of the rank of queen has a value of twelve points. Any card bearing indicia representative of the rank of king has a value of thirteen points. Any card bearing indicia representative of the rank of joker has a value selected from a group of values consisting of a value of zero points, and a value of any number of points required to make a hand total of twenty-seven points.

In accordance with the predetermined set of game rules herein ascribed to the first-optional embodiment, the dealer selects the value assigned to any card bearing indicia representative of the rank of ace in accordance with the following set of rules. If any hand includes at least one ace, and if one ace can be assigned a value of fourteen points without causing the hand total to exceed twenty-seven points, then one ace in the any hand has a value of fourteen points, and each of any additional aces in the any hand has a value of one point. If any hand includes at least one ace, and if one ace can not be assigned a value of fourteen points without causing the hand total to exceed twenty-seven points, then each ace in the any hand has a value of one point.

In accordance with the predetermined set of game rules herein ascribed to the first-optional embodiment, the dealer selects the value assigned to any card bearing indicia representative of the rank of joker in accordance with the following set of rules. If the first card dealt to any hand is a joker, then the joker has a value of zero points. If the second card dealt to any hand is a joker, then the joker has a value of any number of points required to make the hand total equal to twenty-seven points. If any hand consists of at least three cards, and if the any hand includes at least one joker, then each joker in the any hand has a value of zero points.

Accepting Game Wager(s) 118

To begin a round, the dealer accepts from each player a game wager. If the game is played on a table with a top-view plan as illustrated in FIG. 4, then the dealer allows each player to place a game wager inside of the betting area corresponding to the player position occupied by the player. For example, if there is a player occupying position 430, then the dealer allows the player to place a game wager inside betting area 444. If there is a player occupying position 432, then the dealer allows the player to place a game wager inside of betting area 446, and so on.

The game wager may be subject to table limits. Optionally, the dealer may allow the player to change the amount of the game wager between rounds.

Optionally, the dealer may allow a plurality of players to occupy a single player position and allow each of the plurality of players to place a game wager inside of the betting area corresponding to the single player position. Optionally, the dealer may allow at least one player to occupy a plurality of player positions and to place a game wager inside a plurality of betting areas, with each of the plurality of betting areas corresponding to a different one of the plurality of player positions.

In cases wherein the dealer does allow each of a plurality of players to place a game wager inside the betting area corresponding to a single player position, the dealer deems the player who has placed the game wager at the front of the betting area to have control over the player position. If the dealer consults 212 with the player for a decision on how to play the player's hand, then the dealer will consult the controlling player. If any other players place a game wager in that betting area, then these players "play behind". Placement of at least one game wager inside the betting area of the player position makes the controlling player eligible to receive an initial hand.

Deal a Set of Hands 120

The dealer deals a player's initial hand consisting of two cards to each wagered-on player position, with each of the two cards being displayed face up. The dealer deals a dealer's initial hand consisting of two cards to one of the least one dealer position, with the first of the two cards being displayed face down, and with the second of the two cards being displayed face up.

The dealer could deal the cards to form the set of hands in any order. For example, the order could be as follows. Starting with the wagered-on player position that is furthest to the dealer's left and continuing in a clockwise manner, the dealer deals the first card of each player's initial hand. The dealer deals the first card of the dealer's initial hand. Starting again with the wagered-on player position that is farthest to the dealer's left and continuing in a clockwise manner, the dealer deals the second card to each player's initial hand. The dealer deals the second card to the dealer's initial hand.

Each player's initial hand involves the player(s) occupying the wagered-on player position in a game. The outcome of each game is independent of the outcome of all other games.

If the second card dealt to the dealer's initial hand is a joker, then the dealer arranges the first card dealt to the dealer's initial hand, so that the card is displayed face up.

If the second card dealt to the dealer's initial hand is a king, then the dealer determines whether the dealer's initial hand consists of an ace and a king without revealing to the player any information about the indicia appearing on the front side of the first card dealt to the dealer's initial hand. If the first-card dealt to the dealer's initial hand is an ace, then the dealer arranges the first-card dealt to the dealer's initial hand, so that the card is displayed face up.

Deal a Set of Hands—Insurance-Side Bet(s) 122 and 124

If the second card dealt to the dealer's initial hand is an ace, then the dealer accepts an insurance-side bet from each player who wishes to place an insurance-side bet. The insurance-side bet is equal to half of the player's game wager. If the game is played on a table with a top-plan view as illustrated in FIG. 4, then each player who wishes to place the insurance-side bet does so in a betting area (not shown) that corresponds to the player's position.

The dealer subsequently determines whether the dealer's initial hand consists of an ace and a king, without revealing to the player any information about the indicia appearing on the front side of the first-card dealt to the dealer's initial hand. If the first-card dealt to the dealer's initial hand is a king, then the dealer arranges the first-card dealt to the dealer's initial hand, so that the card is displayed face up.

Resolution of the Insurance-Side Bet(s) 126

After the initial deal, the dealer chooses a game 126 wherein: If the player made an insurance-side bet, then the dealer resolves the insurance-side bet in accordance with the following set of rules. If the dealer's initial hand does consist of an ace and a king, then the dealer pays the player eleven to one (11:1) odds on the insurance-side bet. If the dealer's initial hand does not consist of an ace and a king, then the dealer collects the insurance-side bet. The insurance-side bet yields a house edge of about ten point eight percent (10.8%).

Initial Hands that have a Value of Twenty-Seven Points

If the second card dealt to any initial hand is a joker, then the any initial hand has a value of twenty-seven points. Accordingly, the following are the three different types of initial hands that have a value of twenty-seven points:

A "Jo Jo" is an initial hand consisting of a pair of Jokers.

A "Finnish 27" is an initial hand consisting of an Ace and a King,

A "Joseca" is an initial hand that includes a joker as a second card and a first card of any rank other than joker.

Determine Whether a Predetermined Outcome Occurs 128

Subsequently, the dealer examines initial hands to determine whether a predetermined outcome occurs 128. If the player's initial hand has a value of twenty-seven points, then the player's hand is a predetermined-winning-complete hand. If the dealer's initial hand has a value of twenty-seven points, and if the player's initial hand does not have a value of twenty-seven points, then the dealer's hand is a predetermined-winning-complete hand.

If the player's hand is a predetermined-winning-complete hand, then a predetermined outcome does occur 128. The outcome of the game is the player's hand wins. The dealer resolves the game wager(s) 130 as described below. The dealer pays any applicable bonus(es) 130 as described below. Afterward, the game ends 132.

If the dealer's hand is a predetermined-winning-complete hand, then a predetermined outcome does occur 128. The outcome of the game is the dealer's hand wins. The dealer resolves the game wager(s) 130 as described below. Afterward, the game ends 132.

After either the game ends 132 or the dealer determines a predetermined outcome does not occur 128, the dealer determines whether there is another game to choose 134. If there is another game to choose, then the dealer again chooses a game 126 and continues in a like manner until the dealer determines there is no other game to choose 134.

Afterward, if all games have ended 136, then the round is over 138. If at least one game has not ended 136, then each of any remaining games continues as follows.

Form the Player's Complete Hand

The player and the dealer take turns playing their hands. The player goes first. As shown in FIG. 2, the dealer again chooses a game 210.

Afterward, the dealer uses memory of the predetermined set of game rules to determine whether the dealer consults with the player for a decision on how to play the player's hand 212. If the predetermined set of game rules requires the player to play the player's hand a certain way, then the dealer does not consult with the player for a decision on how to play the player's hand. Otherwise the dealer does consult with the player for a decision on how to play the player's hand.

If the dealer does consult with the player for a decision on how to play the player's hand, then the predetermined set of game rules does give the player the following group of options.

The player has the option to hit 214. If the player hits, then the dealer deals one additional card to the player's hand 216 thereby adding to the player's hand total. The dealer arranges the one additional card, so that the card is displayed face up.

The player has the option to stand 230. If the player stands, then the player's hand is complete.

The player must play the player's hand a certain way under the following circumstances.

If the player's hand does consist of less than five cards, and if the player's hand total is less than a hand total selected from a group consisting of hard fifteen and soft twenty-four, then the player must hit 214.

If the player's hand does consist of five cards, then the player must stand 230.

If the player's hand total is at least equal to a hand total selected from a group consisting of hard twenty-five and soft twenty-seven, then the player must stand 230.

Determine Whether a Predetermined Outcome Occurs 232

After the player's hand is complete 230, the dealer determines whether a predetermined outcome occurs 232 in accordance with the following set of rules.

If the player's hand consists of at least three cards, and if the player's hand total is equal to twenty-seven points, then the player's hand is a predetermined-winning-complete hand.

If the player's hand total is greater than twenty-seven points, then the player's hand is a predetermined-losing-complete hand.

If the player's hand is a predetermined-winning-complete hand, then a predetermined outcome does occur 232. The outcome of the game is the player's hand wins. The dealer resolves the game wager(s) 234 as described below. The dealer pays the player(s) any applicable bonus(es) 234 as described below. Afterward, the game ends 236.

If the player's hand is a predetermined-losing-complete hand, then a predetermined outcome does occur 232. The outcome of the game is the dealer's hand wins. The dealer resolves the game wager(s) 234 as described below. Afterward, the game ends 236.

If the player's hand is not a predetermined-winning-complete hand, and if the player's hand is not a predetermined-losing-complete hand, then a predetermined outcome does not occur 232.

After either the game ends 236 or the dealer determines a predetermined outcome does not occur 232, the dealer determines whether there is another game to choose 238. If there is another game to choose, then the dealer again chooses a game 210 and continues in a like manner until the dealer determines there is no other game to choose 238.

Afterward, the dealer arranges the first card dealt to form the dealer's initial hand, so that the card is displayed face up.

If all games are over before the dealer's turn to play the dealer's hand 310, then the round is over 312. If at least one game is not over before the dealer's turn to play the dealer's hand 310, then each of any remaining games continues as follows.

Form the Dealer's Complete Hand 314

The dealer must play the dealer's hand in accordance with the following predetermined strategy.

If the dealer's hand does not consist of five cards, and if the dealer's hand total is less than a hand total selected from a group consisting of hard twenty-three and soft twenty-five, then the dealer must hit.

If the dealer's hand does consist of five cards, then the dealer must stand.

If the dealer's hand total is at least equal to a hand total selected from a group consisting of hard twenty-three and soft twenty-five, then the dealer must stand.

If the dealer hits, then the dealer does deal one additional card to the dealer's hand. Thereby, the dealer adds the point value assigned to the one additional card to the dealer's hand total. The dealer arranges the one additional card, so that the card is displayed face up. If the dealer stands, then the dealer's hand is complete.

Determine the Outcome of the Remaining Game(s) 316, 318, and 320

After the dealer's hand is complete, the dealer determines the outcome of the remaining game(s). The dealer begins by choosing one of the remaining games 316.

After choosing a game 316, the dealer examines complete hands in search of a hand that includes a qualifying-five-card-poker hand in accordance with the following set of rules:

If the player's hand does consist of five cards, and if the dealer's hand does not consist of five cards, then the dealer uses a predetermined set of hand-ranking rules to identify the highest-ranking-five-card-poker hand that can be made from the five cards in the player's hand, and the player's hand includes a qualifying-five-card-poker hand consisting of the player's highest-ranking-five-card-poker hand.

If the dealer's hand does consist of five cards, and if the player's hand does not consist of five cards, then the dealer uses the predetermined set of hand-ranking rules to identify the highest-ranking-five-card-poker hand that can be made from the five cards in the dealer's hand, and the dealer's hand includes a qualifying-five-card-poker hand consisting of the dealer's highest-ranking-five-card-poker hand.

If the player's hand does consist of five cards, and if the dealer's hand does consist of five cards, then the dealer uses the predetermined set of hand-ranking rules to identify the highest-ranking-five-card-poker hand that can be made from the five cards in each hand wherein:

If the player's highest-ranking-five-card-poker hand does outrank the dealer's highest-ranking-five-card-poker hand, then the player's hand does include a qualifying-five-card-poker hand consisting of the player's highest-ranking-five-card-poker hand.

If the player's highest-ranking-five-card-poker hand does not outrank the dealer's highest-ranking-five-card-poker hand, then the dealer's hand does include a qualifying-five-card-poker hand consisting of the dealer's highest-ranking-five-card-poker hand.

The predetermined set of hand-ranking rules does specify ten categories of five-card-poker hand and assigns a rank to each so that when arranged in order from lowest ranking to highest ranking the ten categories of five-card-poker hand are high card, one pair, two pair, three-of-a-kind, straight, flush, full house, four-of-a-kind, straight-flush, and five-of-a-kind. The predetermined set of hand-ranking rules does rank individual cards so that when arranged from lowest ranking to highest ranking the individual cards of each suit are 2, 3, 4, 5, 6, 7, 8, 9, 10, Jack, Queen, King, and Ace. An Ace can appear as the lowest ranking card as when part of a hand selected from a group consisting of an Ace-2-3-4-5 straight and an Ace-2-3-4-5 straight-flush. The predetermined set of hand-ranking rules does specify the use of individual card ranks to rank hands that are in the same category. The predetermined set of hand-ranking rules does specify use of suits to determine whether a hand belongs to a category of five-card-poker hand selected from a group consisting of a flush and a straight-flush. The predetermined set of hand-ranking rules does specify the step of assigning a wild card value to each Joker in a hand so that the point value of each Joker remains zero points, and so that each Joker can be used to perform a function selected from a group consisting of represent an Ace, complete a straight, complete a flush, and complete a straight-flush.

After the dealer examines complete hands in search of a hand that includes a qualifying-five-card-poker hand, the dealer determines whether a predetermined outcome occurs in accordance with the following set of rules:

If the player's hand total is less than twenty-eight points, and if the player's hand does include a qualifying-five-card-poker hand, then the player's hand is a predetermined-winning-complete hand.

If the dealer's hand total is less than twenty-eight points, and if the dealer's hand does include a qualifying-five-card-poker hand, then the dealer's hand is a predetermined-winning-complete hand.

If the player's hand is not a predetermined-winning-complete hand, and if the dealer busts, then the dealer's hand is a predetermined-losing-complete hand.

If the player's hand is a predetermined-winning-complete hand, then a predetermined outcome does occur 318. The outcome of the game is the player's hand wins. The dealer resolves the game wagers(s) 322 as described below. Afterward, the game ends 324.

If the dealer's hand is a predetermined-winning-complete hand, then a predetermined outcome does occur 318. The outcome of the game is the dealer's hand wins. The dealer resolves the game wager(s) 322 as described below. Afterward, the game ends 324.

If the dealer's hand is a predetermined-losing-complete hand, then a predetermined outcome does occur 320. The outcome of the game is the player's hand wins. The dealer resolves the game wagers(s) 322 as described below. Afterward, the game ends 324.

If a predetermined outcome does not occur 318 or 320, then the dealer determines the outcome of the game by comparing hand totals to the target-numerical sum of twenty-seven points 320 in accordance with the following set of rules.

If the player's hand total is closer to twenty-seven points than is the dealer's hand total, then the outcome of the game is the player's hand wins 320.

If the dealer's hand total is closer to twenty-seven points than is the player's hand total, then the outcome of the game is the dealer's hand wins 320.

If the dealer's hand total is as close to twenty-seven points as is the player's hand total, then the outcome of the game is a stalemate 320.

Resolution of the Game Wager(s) 130, 236, and 322

The dealer resolves each game wager as follows.

If the outcome of the game is the player's hand wins, then the dealer pays one to one odds on the game wager.

If the outcome of the game is the dealer's hand wins, then the dealer collects the game wager.

If the outcome of the game is a stalemate, then the dealer returns the game wager to the player.

Predetermined Combinations of Cards and Bonus Payouts 130, 236 and 322

If the outcome of the game is the player's hand wins, then the dealer uses the following set of rules to determine whether the player's hand does include a predetermined combination of cards.

If the player's initial hand consists of an ace and a king, then the player's hand does include a predetermined combination of cards.

If the player's initial hand consists of a pair of jokers, then the player's hand does include a predetermined combination of cards.

If the player's hand does consist of a card assigned a value of eight points, a card assigned a value of nine points, and a card assigned a value of ten points, then the player's hand does include a predetermined combination of cards.

If the player's hand does consist of three cards, and if each of the three cards is a card assigned a value of nine points, then the player's hand does include a predetermined combination of cards.

If the outcome of the game is the player's hand wins, and if the player's hand does include a predetermined combination of cards, then the dealer pays the player a bonus 130, 236, and 322 in accordance with the following pay table.

| Predetermined Combination of Cards | Bonus Payout |
|---|---|
| Finnish 27 | 1:1 odds on the game wager |
| Jo Jo | 2:1 odds on the game wager |
| 8-9-10 mixed suits | 1:2 odds on the game wager |
| 8-9-10 hearts, clubs, or diamonds | 1:1 odds on the game wager |
| 8-9-10 spades | 2:1 odds on the game wager |
| 9-9-9 mixed suits | 9 times the table minimum |
| 9-9-9 same suit | 99 times the table minimum |
| 9-9-9 and any 9-9 dealer's initial hand | 999 times the table minimum |
| END OF ROUND | |

After the dealer determines the outcome of the game, resolves the game wager(s), and pays any applicable bonus (es), the dealer ends the game 324. After the dealer ends the game 324, if there is at least one game that has not yet ended 326, then the dealer proceeds to choose a game 316 and continues in a like manner until all games have ended. When all games have ended 326, the dealer ends the round of play 328.

Method of Play for Multiple-Player-Position Variants of the Second-Optional Embodiment The three-part-flow chart of FIG. 1, FIG. 2, and FIG. 3, is for use in providing a schematic representation of the sequence of operations according to the predetermined set of game rules specified for any of a subset of comparing-card games belonging to the Finnish 27 family including multiple-player-position variants of the second-optional embodiment. Accordingly, the following is a description of multiple-player-position variants of the second-optional embodiment, wherein the use of the three-part-flow chart provides a schematic representation of the sequence of operations.

The Predetermined Set of Games Rules and the Claims

The predetermined set of game rules herein ascribed to the second-optional embodiment conforms to the general set of game rules set forth in method 1 of the claims and, in some cases, deviates from the specific set of game rules set forth by methods 2 through 12 of the claims.

Identifying, to a Player, Each of at Least One Player Position and at Least One Dealer Position 112.

The predetermined set of game rules herein ascribed to the second-optional embodiment does include the following subset of game rules. The dealer deals at least two cards to form a player's hand corresponding to one of the at least one player position. The player wins the game and receives a predetermined payout on the game wager by correctly betting that the outcome of the game will be the player's hand wins. Accordingly, people could play the live version of the game on a table with a top-plan view 410 as illustrated in FIG. 4. People could play the electronic version of the game using a device as illustrated in FIG. 6.

Providing at Least One Deck of Cards 114.

According to the predetermined set of game rules herein ascribed to the second-optional embodiment, the at least one deck of cards of clause (c) of method 1 is six decks of cards. Each deck of cards consists of thirteen ranks of each of four French suits. Each card bears Finnish style indicia exemplified by Turun Linna cards circa 1960.

The dealer shuffles the cards either manually, mechanically, or electronically so that the order of the cards is substantially random.

Assigning a Value to Each Card 116

In accordance with clause (d) of method 1, the predetermined set of game rules herein ascribed to the second-optional embodiment does specify assigning a numerical value to each card. Accordingly, any card bearing indicia representative of the rank of ace has a value selected from a group of values consisting of a value of one point and a value of fourteen points. Any card bearing indicia representative of a rank selected from a group of ranks consisting of two, three, four, five, six, seven, eight, nine, and ten, has a value of the number of points that corresponds to the numerical-face value of the any card. Any card bearing indicia representative of the rank of jack has a value of eleven points. Any card bearing indicia representative of the rank of queen has a value of twelve points. Any card bearing indicia representative of the rank of king has a value of thirteen points.

In accordance with the specific set of game rules herein ascribed to the second-optional embodiment, the dealer selects the value assigned to any card bearing indicia representative of the rank of ace in accordance with the following set of rules. If any hand includes at least one ace, and if one ace can be assigned a value of fourteen points without causing the hand total to exceed twenty-seven points, then one ace in the any hand has a value of fourteen points, and each of any additional aces in the any hand has a value of one point. If any hand includes at least one ace, and if one ace can not be assigned a value of fourteen points without causing the hand total to exceed twenty-seven points, then each ace in the any hand has a value of one point.

Accepting Game Wager(s) 118

To begin a round, the dealer accepts from each player a game wager. If the game is played on a table with a top-view plan as illustrated in FIG. 4, then the dealer allows each player to place a game wager inside of the betting area corresponding to the player position occupied by the player. For example, if there is a player occupying position 430, then the dealer allows the player to place a game wager inside betting area 444. If there is a player occupying position 432, then the dealer allows the player to place a game wager inside of betting area 446, and so on.

Optionally, the dealer may allow at least one player to occupy a plurality of player positions and to place a game wager inside a plurality of betting areas, with each of the plurality of betting areas corresponding to a different one of the plurality of player positions.

The game wager may be subject to table limits. Optionally, the dealer may allow the player to change the amount of the game wager between rounds.

Placement of at least one casino token inside the betting area of one of the at least one player position begins a game and makes the player eligible to play a hand.

Deal a Set of Hands 120

The dealer deals a player's initial hand consisting of two cards to each wagered-on player position, with each of the two cards being displayed face up. The dealer deals a dealer's initial hand consisting of two cards to one of the least one dealer position, with each of the two cards being displayed face up.

The dealer could deal the cards to form the set of hands in any order. For example, the order could be as follows. Starting with the wagered-on player position that is furthest to the dealer's left and continuing in a clockwise manner, the dealer deals the first card of each player's initial hand. The dealer deals the first card of the dealer's initial hand. Starting again with the wagered-on player position that is farthest to the dealer's left and continuing in a clockwise manner, the dealer deals the second card to each player's initial hand. The dealer deals the second card to the dealer's initial hand.

Each player's initial hand involves the player occupying the wagered-on player position in a game. The outcome of each game is independent of the outcome of all other games.

Initial Hands that have a Value of Twenty-Seven Points

After the initial deal, if a hand consist of an ace and a king in any order, then the hand total is twenty-seven points, and the hand is called a "Finnish 27" or a "natural."

Determine Whether a Predetermined Outcome Occurs 128

After the initial deal, the dealer chooses a game 126.

After choosing a game, the dealer determines whether a predetermined outcome occurs 128 in accordance with the following set of rules.

If the player's hand is a Finnish 27, then the player's hand is a predetermined-winning-complete hand unless the dealer's hand is also a Finnish 27.

If the dealer's hand is a Finnish 27, then the dealer's hand is a predetermined-winning-complete hand unless the player's hand is also a Finnish 27.

If the player's hand is a Finnish 27, and if the dealer's hand is a Finnish 27, then the dealer's hand is a predetermined-stalemating-complete hand.

If the player's hand is a predetermined-winning-complete hand, then a predetermined outcome does occur 128. The outcome of the game is the player's hand wins. The dealer resolves the game wager 130 as described below. The dealer pays any applicable bonus 130 as described below. Afterward, the game ends 132.

If the dealer's hand is a predetermined-winning-complete hand, then a predetermined outcome does occur 128. The outcome of the game is the dealer's hand wins. The dealer resolves the game wager 130 as described below. Afterward, the game ends 132.

If the dealer's hand is a predetermined-stalemating-complete hand, then a predetermined outcome does occur 128. The outcome of the game is a stalemate. The dealer resolves the game wager 130 as described below. Afterward, the game ends 132.

After either the game ends 132 or the dealer determines a predetermined outcome does not occur 128, the dealer determines whether there is another game to choose 134. If there is another game to choose, then the dealer chooses another game 126 and continues in a like manner until the dealer determines there is no other game to choose 134.

Afterward, if all games have ended 136, then the round of play ends 138. If all games have not ended 136, then each of any remaining games continues as follows.

Form the Player's Complete Hand(s)

The player and the dealer take turns playing their hands. The player goes first. As shown in FIG. 2, the dealer again chooses a game 210.

Afterward, the dealer uses memory of the predetermined set of game rules to determine whether the dealer consults with the player for a decision on how to play the player's hand 212. If the predetermined set of game rules requires the player to play the player's hand a certain way, then the dealer does not consult with the player for a decision on how to play the player's hand. Otherwise the dealer does consult with the player for a decision on how to play the player's hand.

If the dealer does consult with the player for a decision on how to play the player's hand, then the predetermined set of game rules does give the player a set of options selected from the following group of options.

The player has the option to stand 232 unless the dealer's hand total is at least equal to a hand total selected from a group consisting of hard twenty-two and soft twenty-four, and the player's hand total is less than the dealer's hand total. If the player stands, then the player's hand is complete.

The player has the option to hit 214. If the player hits, then the dealer deals one additional card to the player's hand 216 thereby adding to the player's hand total. The dealer arranges the one additional card, so that the card is displayed face up.

If the dealer's hand total is less than a hand total selected from a group consisting of hard twenty-two and soft twenty-four, then the player has the option to double down 218. If the player opts to double down, then the player doubles the game wager 220. The dealer deals one additional card to the player's hand 216. The dealer arranges the one additional card, so that the card is displayed face up. Afterward, the player must stand 230.

If the player's hand consists of two cards assigned identical ranks, then the player has the option to split 222. If the player opts to split, then the player places another game wager 224. The dealer splits the player's hand into two post-split hands 226 with each of the two-post-split hands consisting of one card. The dealer selects a first of the two post-split hands 210. Subsequently, the player plays the first of the two-post-split hands.

The two post-split hands compete against the same dealer hand during the same round of play. The player does play both of the post-split hands at a single player position. The two post-split hands involve the player in the play of two games with each of the two game wagers corresponding to a different one of the two games. The outcome of each of the two games is independent of the outcome of the other of the two games. Accordingly, the resolution of each of the two game wagers is independent of the resolution of the other of the two game wagers.

Further splitting of post-split hands is possible as long as further splitting of post-split hands does not result in the formation of more than four post-split hands per player position per round.

If the player's hand consists of two cards, and if the player's hand is not a post-split hand, then the player has the option to surrender. If the player opts to surrender, then the player's hand is complete, the dealer resolves the game wager 236 as described below, and the game ends 238.

If the dealer's hand total is less than a hand total selected from a group consisting of hard twenty-two and soft twenty-four, then the player must play the player's hand a certain way under the following circumstances.

- If the player's hand consists of one card, then the player must hit 214.
- If the player's hand total is at least equal to a hand total selected from a group consisting of hard twenty-five and soft twenty-seven, then the player must stand 230.

If the dealer's hand total is at least equal to a hand total selected from a group consisting of hard twenty-two and soft twenty-four, then the player must play the player's hand a certain way under the following circumstances.

- If the player's hand consists of one card, then the player must hit 214.
- If the player's hand consists of two cards, if the player's hand is a post-split hand, and if the player's hand total is less than the dealer's hand total, then the player must hit 214 unless the player can split 222.
- If the player's hand consists of at least two cards, if the player hits, and if the player's hand total is subsequently less than the dealer's hand total, then the player must hit 214.
- If the player's hand is a hard hand, and if the player's hand total is equal to the dealer's hand total, then the player must stand 230 unless the player's hand consists of a pair of Jacks.
- If the player's hand total is greater than the dealer's hand total, then the player must stand 230.

Determine Whether a Predetermined Outcome Occurs 232

After the player's hand is complete 230, the dealer determines whether a predetermined outcome occurs 232 in accordance with the following set of rules.

- If the player's hand is a post-split hand, and if the player's hand consists of an ace and a king, then the player's hand is considered a Finnish 27. Accordingly, the player's hand is a predetermined-winning-complete hand.
- If the player's hand consists of a card assigned a value of eight points, a card assigned a value of nine points, and a card assigned a value of ten points, then the player's hand is a predetermined-winning-complete hand.
- If the player's hand consists of three cards, and if each of the three cards is a card assigned a value of nine points, then the player's hand is a predetermined-winning-complete hand.
- If the player's hand total exceeds hard twenty-seven, then the player's hand is a predetermined-losing-complete hand.

If the player's hand is a predetermined-winning-complete hand, then a predetermined outcome does occur 232. The outcome of the game is the player's hand wins. The dealer resolves the game wager 234 as described below. The dealer pays any applicable bonus 234 as described below. Afterward, the game ends 236.

If the player's hand is a predetermined-losing-complete hand, then a predetermined outcome does occur 232. The outcome of the game is the dealer's hand wins. The dealer resolves the game wager 234 as described below. Afterward, the game ends 236.

If the player's hand is not a predetermined-winning-complete hand, and if the player's hand is not a predetermined-losing-complete hand, then a predetermined outcome does not occur 232.

After either the game ends 236 or the dealer determines a predetermined outcome does not occur 232, the dealer determines whether there is another game to choose 238. If there is another game to choose, then the dealer chooses another game 210 and continues in a like manner until the dealer determines there is no other game to choose 238.

In cases where in a player is waiting to play another post-split hand and a player is waiting to play an initial hand, choice of the game wherein the player is waiting to play another post-split hand takes precedence over choice of the game wherein the player is waiting to play an initial hand (even if both players are the exact same player).

After the dealer determines there is no other game to choose 238, if all games have ended 310 before it is the dealer's turn to play, then the dealer's hand is complete and the round of play ends 312. If all games have not ended 310, then the round of play continues as follows.

Form the Dealer's Complete Hand 314

The dealer must play the dealer's hand in accordance with the following predetermined strategy.

- If the dealer's hand total is less than a hand total selected from a group consisting of hard twenty-two and soft twenty-four, then the dealer must hit.
- If the dealer's hand total is at least equal to a hand total selected from a group consisting of hard twenty-two and soft twenty-four, then the dealer must stand.

If the dealer hits, then the dealer does deal one additional card to the dealer's hand. Thereby, the dealer adds the point value assigned to the one additional card to the dealer's hand total. The dealer arranges the one additional card, so that the card is displayed face up. If the dealer stands, then the dealer's hand is complete.

Determine the Outcome of the Remaining Game(s)

After the dealer plays the dealer's hand 314, the dealer again chooses a game 316.

After choosing a game, the dealer determines whether a predetermined outcome occurs 320 in accordance with the following set of rules.

If the dealer busts, then the dealer's hand is a predetermined-losing-complete hand.

If the dealer's hand is a predetermined-losing-complete hand, then a predetermined outcome does occur 320. The outcome of the game is the player's hand wins. The dealer resolves the game wager 322 as described below. Afterward, the game ends 324.

If the dealer's hand is not a predetermined-losing-complete hand, then a predetermined outcome does not occur 320. In that event, the dealer determines the outcome of the game by comparing hand totals to the target-numerical sum of twenty-seven points 320 in accordance with the following set of rules.

If the player's hand total is closer to twenty-seven points than is the dealer's hand total, then the outcome of the game is the player's hand wins.

If the dealer's hand total is closer to twenty-seven points than is the player's hand total, then the outcome of the game is the dealer's hand wins.

If the dealer's hand total is as close to twenty-seven points as is the player's hand total, then the outcome of the game is a stalemate.

Resolution of the Game Wager 130, 236, and 322

After the dealer determines the outcome of the game, the dealer resolves the game wager made on the uncertain outcome of the game in accordance with the following set of rules.

If the outcome of the game is the player's hand wins, then the dealer pays one to one odds on the game wager.

If the outcome of the game is the dealer's hand wins, then the dealer collects the game wager.

If the outcome of the game is a stalemate, then the dealer returns the game wager to the player.

If the outcome of the game is the player surrenders 230, then the dealer divides the game wager into two equal halves. The dealer collects one half of the game wager. The dealer returns the remaining half of the game wager to the player. Thereby, the dealer splits the game wager with the player.

Predetermined Combinations of Cards and Bonus Payouts 130 and 236

If the outcome of the game is the player's hand wins, then the dealer determines whether the player's hand does include a predetermined combination of cards in accordance with the following set of rules.

If the player's hand consists of an ace and a king, then the player's hand does include a predetermined combination of cards.

If the player's complete hand does consist of a card assigned a value of eight points, a card assigned a value of nine points, and a card assigned a value of ten points, then the player's hand does include a predetermined combination of cards.

If the player's complete hand does consist of three cards, and if each of the three cards is a card assigned a value of nine points, then the player's hand does include a predetermined combination of cards.

If the outcome of the game is the player's hand wins, and if the player's hand does include a predetermined combination of cards, then the dealer pays the player a bonus in accordance with the following pay table.

| Predetermined Combination of Cards | Bonus Payout |
|---|---|
| Finnish 27 | 1:2 odds on the game wager |
| 8-9-10 mixed suits | 1:2 odds on the game wager |
| 8-9-10 hearts, clubs, or diamonds | 1:1 odds on the game wager |
| 8-9-10 spades | 2:1 odds on the game wager |
| 9-9-9 mixed suits | 9 times the table minimum |
| 9-9-9 same suit | 99 times the table minimum |
| 9-9-9 and any 9-9 dealer's initial hand | 999 times the table minimum |
| END OF ROUND | |

After the dealer determines the outcome of the game, resolves the game wager, and pays any applicable bonus, the dealer ends the game 324. After the dealer ends the game 324, the dealer determines whether all games have ended 326. If there is at least one game that has not yet ended 326, then the dealer proceeds to choose a game 316 and continues in a like manner until all games have ended. When all games have ended 326, the dealer ends the round of play 328.

Method of Play for Multiple-Player-Position Variants of the Third-Optional Embodiment The three-part-flow chart of FIG. 1, FIG. 2, and FIG. 3, is for use in providing a schematic representation of the sequence of operations according to the predetermined set of game rules specified for any of a subset of comparing-card games belonging to the Finnish 27 family including multiple-player-position variants of the third-optional embodiment. Accordingly, the following is a description of multiple-player-position variants of the third-optional embodiment, wherein the use of the three-part-flow chart provides a schematic representation of the sequence of operations.

The Predetermined Set of Games Rules and the Claims

The predetermined set of game rules herein ascribed to the third-optional embodiment conforms to the general set of game rules set forth in method 1 of the claims and, in some cases, deviates from the specific set of game rules set forth by methods 2 through 12 of the claims.

Identifying, to a Player, Each of at Least One Player Position and at Least One Dealer Position 112.

The predetermined set of game rules herein ascribed to the third-optional embodiment does include the following subset of game rules. The dealer deals at least two cards to form a player's hand corresponding to one of the at least one dealer position. The player wins the game and receives a predetermined payout on the game wager by correctly betting that the outcome of the game will be an outcome selected by the player from a group consisting of the player's hand wins, the dealer's hand wins, and a stalemate. Accordingly, people could play the live version of the game on a table with a top-plan view 510 as illustrated in FIG. 5. People could play the electronic version of the game using a device as illustrated in FIG. 6.

Providing at Least One Deck of Cards 114.

According to the predetermined set of game rules herein ascribed to the third-optional embodiment, the at least one deck of cards of clause (c) of method 1 is six decks of cards. Each deck of cards consists of thirteen ranks of each of four French suits plus two jokers. Each card bears Finnish style indicia exemplified by Turun Linna cards circa 1960.

The dealer shuffles the cards either manually, mechanically, or electronically so that the order of the cards is substantially random.

Assigning a Value to Each Card 116

In accordance with clause (d) of method 1, the predetermined set of game rules herein ascribed to the third-optional embodiment does specify assigning a numerical value to each card. Accordingly, any card bearing indicia representative of the rank of ace has a value selected from a group of values consisting of a value of one point and a value of fourteen points. Any card bearing indicia representative of a rank selected from a group of ranks consisting of two, three, four, five, six, seven, eight, nine, and ten, has a value of the number of points that corresponds to the numerical-face value of the any card. Any card bearing indicia representative of the rank of jack has a value of eleven points. Any card bearing indicia representative of the rank of queen has a value of twelve points. Any card bearing indicia representative of the rank of king has a value of thirteen points. Any card bearing indicia representative of the rank of joker has a value selected from a group of values consisting of a value of zero points, and a value of any number of points required to make a hand total of twenty-seven points.

In accordance with the predetermined set of game rules herein ascribed to the third-optional embodiment, the dealer selects the value assigned to any card bearing indicia representative of the rank of ace in accordance with the following set of rules. If any hand includes at least one ace, and if one ace can be assigned a value of fourteen points without causing the hand total to exceed twenty-seven points, then one ace in the any hand has a value of fourteen points, and each of any additional aces in the any hand has a value of one point. If any hand includes at least one ace, and if one ace can not be assigned a value of fourteen points without causing the hand total to exceed twenty-seven points, then each ace in the any hand has a value of one point.

In accordance with the predetermined set of game rules herein ascribed to the third-optional embodiment, the dealer selects the value assigned to any card bearing indicia representative of the rank of joker in accordance with the following set of rules. If any hand consists of two cards, and if one card dealt to the any hand is a joker, then the joker has a value equal to any number of points required to make the hand total equal to twenty-seven points. If any hand consists of two cards, and if each of the two cards is a joker, then the first card dealt to the any hand has a value of twenty-seven points and the second card dealt to the any hand has a value of zero points. If any hand consists of at least three cards, and if the any hand includes at least one joker, then each joker in the any hand has a value of zero points.

Accepting Game Wager(s) 118

To begin a round, the dealer allows each player to place a game wager. If the game is played on a table with a top-view plan as illustrated in FIG. 5, then the dealer allows each player to place a game wager inside one of three betting areas corresponding to the player position occupied by the player. For example, if there is a player occupying player position 1, then the dealer allows the player to place the game wager inside of one of three betting areas corresponding to player position 1. If there is a player occupying player position 2, then the dealer allows the player to place the game wager inside of one of three betting areas corresponding to player position 2, and so on.

Optionally, the dealer may allow the player to place a plurality of game wagers, with each game wager being placed inside of one of a plurality of the three betting areas, and with each one of the plurality of the three betting areas corresponding to the player position occupied by the player. Optionally, the dealer may allow a plurality of players to occupy a single player position and allow each of the plurality of players to place a game wager inside of one of the three betting areas corresponding to the single player position.

Deal a Set of Hands 120

The dealer deals cards to form a set of hands consisting of a player's initial hand and a dealer's initial hand. The player's initial hand consists of two cards. The dealer's initial hand consists of two cards. The dealer arranges the two cards of the player's initial hand so that the two cards are displayed face up on the table at one of the at least one dealer position. The dealer arranges the two cards of the dealer's initial hand so that the two cards are displayed face up on the table at one of the at least one dealer position.

The dealer could deal the cards to form the hands in any order. For example, the order could be as follows. The dealer deals the first card of the player's initial hand. The dealer deals the first card of the dealer's initial hand. The dealer deals the second card of the player's initial hand. The dealer deals the second card of the dealer's initial hand.

Initial Hands that have a Value of Twenty-Seven Points

Any initial hand that includes at least one joker has a value of twenty-seven points.

Accordingly, the following are the three different types of initial hands that have a value of twenty-seven points:

- A "Jo Jo" is an initial hand consisting of a pair of Jokers.
- A "Finnish 27" is an initial hand consisting of an Ace and a King,
- A "Joanca" is an initial hand that includes one joker and one card of any rank other than joker.

Determine Whether a Predetermined Outcome Occurs 128

After the initial deal, the dealer examines initial hands to determine whether a predetermined outcome occurs 128.

- Any initial hand with a value of twenty-seven points is a predetermined-winning-complete hand except as noted below.
- The predetermined set of game rules does rank the three types of initial hands that have a value of twenty-seven points in reverse order of their probabilities of occurrence.
  - The Jo Jo has the highest rank.
  - The Finnish 27 has a lower rank than the Jo Jo and a higher rank than the Joanca.
  - The Joanca has the lowest rank.
- If both the player and the dealer draw an initial hand that has a value of twenty-seven points, then the initial hand with the highest rank is a predetermined-winning-complete hand.
- If both the player and the dealer draw an initial hand that has a value of twenty-seven points, and if the initial hand drawn by the player has the same rank as the initial hand drawn by the dealer, then the dealer's hand is a predetermined-winning-complete hand.

If the player's hand is a predetermined-winning-complete hand, then a predetermined outcome does occur 128. The outcome of the game is the player's hand wins. The dealer resolves the game wager(s) 130 as described below. The dealer pays any applicable bonus(es) 130 as described below. Afterward, the game ends 134.

If the dealer's hand is a predetermined-winning-complete hand, then a predetermined outcome does occur 128. The outcome of the game is the dealer's hand wins. The dealer resolves the game wager(s) 130 based on the outcome of the game. Afterward, the game ends 132.

If the player's hand is not a predetermined-winning-complete hand, and if the dealer's hand is not a predetermined-winning-complete hand, then a predetermined outcome does not occur 128.

If the game has ended 136, then the round of play ends 138.

If the game has not ended 136, then the game continues as follows.

Form the Player's Complete Hand 212, 214, 216, and 230

The player and the dealer take turns playing their hands. The player goes first. The dealer does not consult with the player(s) for a decision on how to play the player's hand 212. The dealer must use a predetermined strategy to play the player's hand.

The predetermined strategy consists of the following ten rules.

| If the dealer's hand total is | hit to target numerical sums |
|---|---|
| any hard total from 4 to 10 | hard 23 and soft 25 (23/AJ) |
| any hard total from 11 to 14 | hard 24 and soft 25 (24/AJ) |
| any hard total from 15 to 23 | hard 23 and soft 25 (23/AJ) |
| any hard total from 24 to 26 | greater than the dealer's hand total |
| soft 25 or soft 26 | greater than the dealer's hand total |
| soft 24 | hard 24 and soft 25 (24/AJ) |
| soft 23 | hard 23 and soft 26 (23/AQ) |
| any soft total from 16 to 22 | hard 24 and soft 26 (24/AQ) |
| soft 15 | hard 25 and soft 26 (25/AQ) |

The dealer uses the rule corresponding to the dealer's hand total. Each rule specifies a set of target-numerical sums for the play of the player's hand consisting of a target-numerical sum for the play of the player's hard hands and a target numerical sum for the play of the player's soft hands. If the player's hand total is less than the target-numerical sum specified for the type of hand the player has, then the player must hit 214. If the player's hand total is equal to or greater than the target-numerical sum specified for the type of hand the player has, then the player must stand 230.

If the player hits, then the dealer does deal one additional card to the player's hand 216 thereby adding the point value assigned to the one additional card to the player's hand total. The dealer arranges the one additional card, so that the card is displayed face up. If the player stands, then the player's hand is complete.

Determine Whether a Predetermined Outcome Occurs 232

After the player's hand is complete 230, the dealer determines whether a predetermined outcome occurs 232 in accordance with the following set of rules.

If the player's hand consists of at least three cards, and if the player's hand total is equal to twenty-seven points, then the player's hand is a predetermined-winning-complete hand.

If the player's hand total does exceed thirty-five points, then the player's hand is a predetermined-losing-complete hand.

If the player's hand is a predetermined-winning-complete hand, then a predetermined outcome does occur 232. The outcome of the game is the player's hand wins. The dealer resolves the game wager(s) 234 as described below. The dealer pays any applicable bonus(es) 234 as described below. Afterward, the game ends 236.

If the player's hand is a predetermined-losing-complete hand, then a predetermined outcome does occur 232. The outcome of the game is the dealer's hand wins. The dealer resolves the game wager(s) 234 as described below. Afterward, the game ends 236.

If the game has ended 310, then the round of play ends 312.

If the game has not ended 310, then the game continues as follows.

Form the Dealer's Complete Hand 314

The dealer must play the dealer's hand in accordance with the following predetermined strategy.

If the dealer's hand total is less than a hand total selected from a group consisting of hard twenty-four and soft twenty-five, then the dealer must hit.

If the dealer's hand total is at least equal to a hand total selected from a group consisting of hard twenty-four and soft twenty-five, then the dealer must stand.

If the dealer hits, then the dealer does deal one additional card to the dealer's hand. Thereby, the dealer adds the point value assigned to the one additional card to the dealer's hand total. The dealer arranges the one additional card, so that the card is displayed face up. If the dealer does stand, then the dealer's hand is complete.

Determine the Outcome of the Game 320

After the dealer's hand is complete, then the dealer determines whether a predetermined outcome occurs 320 in accordance with the following set of rules.

If the player-bust contest does occur, and if the player's hand total is closer to twenty-seven points than is the dealer's hand total, then the dealer has a predetermined-stalemating-complete hand.

If the dealer-bust contest does occur, and if the dealer's hand total is closer to twenty-seven points than is the player's hand total, then the dealer has a predetermined-stalemating-complete hand.

If the dealer-bust contest does occur, and if the player's hand total is as close to twenty-seven points as is the dealer's hand total, then the dealer has a predetermined-stalemating-complete hand.

If the dealer has a predetermined-stalemating-complete hand, then a predetermined outcome does occur 320. The outcome of the game is a stalemate.

If a predetermined outcome does not occur 320, then the dealer determines the outcome of the game by comparing hand totals to the target-numerical sum of twenty-seven points 320 in accordance with the following set of rules.

If the player's hand total is closer to twenty-seven points than is the dealer's hand total, then the outcome of the game is the player's hand wins.

If the dealer's hand total is closer to twenty-seven points than is the player's hand total, then the outcome of the game is the dealer's hand wins.

If the dealer's hand total is as close to twenty-seven points as is the player's hand total, then the outcome of the game is the dealer's hand wins.

Resolution of the Game Wager(s) 130, 236, or 322

The dealer resolves each game wager in accordance with a set of rules selected from the following three sets of rules.

If the player bets the outcome of the game will be the player's hand wins, then the dealer resolves the game wager in accordance with the following set of rules.

If the outcome of the game is the player's hand wins, then the dealer pays the player one to one odds (1:1) on the game wager.

If the outcome of the game is the dealer's hand wins, then the dealer collects the game wager.

If the outcome of the game is a stalemate, then the dealer returns the game wager to the player.

If the player bets the outcome of the game will be the dealer's hand wins, then the dealer resolves the game wager in accordance with the following set of rules.

If the outcome of the game is the player's hand wins, then the dealer collects the game wager.

If the outcome of the game is the dealer's hand wins, then the dealer pays the player four to five odds (4:5) on the game wager.

If the outcome of the game is a stalemate, then the dealer returns the game wager to the player.

If the player bets the outcome of the game will be a stalemate, then the dealer resolves the game wager in accordance with the following set of rules.

If the outcome of the game is the player's hand wins, then the dealer collects the game wager.

If the outcome of the game is the dealer's hand wins, then the dealer collects the game wager.

If the outcome of the game is a stalemate, then the dealer pays the player seven to one odds (7:1) on the game wager.

Predetermined Combinations of Cards and Bonus Payouts 130, 236, or 322

If at least one player bets the outcome of the game will be the player's hand wins, and if the outcome of the game is the player's hand wins, then the dealer uses the following set of rules to determine whether the player's hand includes a predetermined combination of cards.

If the player's initial hand consists of an ace and a king, then the player's hand does include a predetermined combination of cards.

If the player's initial hand consists of a pair of jokers, then the player's hand does include a predetermined combination of cards.

If the player's complete hand does consist of a card assigned a value of eight points, a card assigned a value of nine points, and a card assigned a value of ten points, then the player's hand does include a predetermined combination of cards.

If the player's complete hand does consist of three cards, and if each of the three cards is a card assigned a value of nine points, then the player's hand does include a predetermined combination of cards.

If the player's hand does include a qualifying-five-card-poker hand, then the dealer finds the player's hand does include a predetermined combination of cards.

If the player's complete hand consists of at least five cards, then the dealer uses memory of a predetermined set of hand-ranking rules to identify any example of the highest-ranking-five-card-poker hand that can be made from any choice of five of the at least five cards in the player's complete hand. If the category of the any example is better than high card, then the player's hand does include a predetermined combination of cards consisting of the any example.

The predetermined set of hand-ranking rules does specify ten categories of five-card-poker hand and assigns a rank to each so that when arranged in order from lowest ranking to highest ranking the ten categories of five-card-poker hand are high card, one pair, two pair, three-of-a-kind, straight, full house, four-of-a-kind, flush, straight-flush, and five-of-a-kind. The predetermined set of hand-ranking rules does rank individual cards so that when arranged from lowest ranking to highest ranking the individual cards of each suit are 2, 3, 4, 5, 6, 7, 8, 9, 10, Jack, Queen, King, and Ace. An Ace can appear as the lowest ranking card as when part of a hand selected from a group consisting of an Ace-2-3-4-5 straight and an Ace-2-3-4-5 straight-flush. The predetermined set of hand-ranking rules does specify the use of individual card ranks to rank hands that are in the same category. The predetermined set of hand-ranking rules does specify use of suits to determine whether a hand belongs to a category of five-card-poker hand selected from a group consisting of a flush and a straight-flush. The predetermined set of hand-ranking rules does specify the step of assigning a wild card value to each joker in the player's complete hand, so that the point value of each joker remains zero points, and so that the player can use each joker to represent the rank and suit of any card.

If the outcome of the game is the player's hand wins, and if the player's hand does include a predetermined combination of cards, then the dealer pays a bonus to each player who bet the outcome of the game will be the player's hand wins in accordance with the following pay table.

| Predetermined Combination of Cards | Bonus Payout |
|---|---|
| Finnish 27 | 1:2 odds on the game wager |
| Jo Jo | 1:1 odds on the game wager |
| 8-9-10 mixed suits | 1:2 odds on the game wager |
| 8-9-10 hearts, clubs, or diamonds | 1:1 odds on the game wager |
| 8-9-10 spades | 2:1 odds on the game wager |
| 9-9-9 mixed suits | 9 times the table minimum |
| 9-9-9 same suit | 99 times the table minimum |
| 9-9-9 and any 9-9 dealer's initial hand | 999 times the table minimum |
| Pair | 1:5 odds on the game wager |
| Two Pair | 1:1 odds on the game wager |
| Three of a kind | 2:1 odds on the game wager |
| Straight | 3:1 odds on the game wager |
| Full House | 4:1 odds on the game wager |
| Four of a kind | 5:1 odds on the game wager |
| Flush | 6:1 odds on the game wager |
| Straight Flush | 7:1 odds on the game wager |
| Five of a kind | 8:1 odds on the game wager |
| END OF GAME 132, 236, or 324 AND END OF ROUND 138, 312, or 328 | |

After the dealer resolves the game wager(s) and pays any applicable bonus(es), the game ends 132, 236, or 324. There is only one game per each round of play. After the game ends, the round of play ends 138, 312, or 328

Prototypes

The applicant provides the source codes of various software prototypes as part of the computer-program-listing appendix attached to the present patent application. The various software prototypes take the form of a set of HTML 4.01 web applications. Each of the set of web applications provides the source code for a model of a single-player-position variant of a comparing-card game belonging to the Finnish 27 family of table-card games.

The single-player-position variant accommodates a single player making a game wager corresponding to a single player position. Each software prototype enables a user to play, in real time, a comparing-card game belonging to the Finnish 27 family of table-card games. Thereby, each software application enables users to generate randomly as many exemplary hands as are desired.

In addition, the source code of each of the set of web applications includes the code for various functions written in the Java Script computer language. Comments written into the code for function stackShuffle( ) include a routine for front-loading the stack with a sequence of cards. The applicant expects those skilled in the art of programming computers will be able to use the routine to cause any desired sequence of cards to appear in the hands of the player and the dealer during the first round of play. Thereby, each of the set of web applications enables users to generate, according to user-defined specifications, as many exemplary hands as are desired. Therefore, the applicant will omit any further discussion of exemplary hands from the detailed discussion of the various-optional embodiments.

Instructions on how to View the Source Code of Prototypes

The applicant saved the source codes of the various HTML 4.01 web applications to a set of text files. The text files are included in the computer-program-listing appendix that is attached to this patent application. Any text file with the word prototype in its' filename is a text file containing the source code of an HTML 4.01 web application.

If the user intends to examine the source code of any of the various HTML 4.01 web applications on a general-purpose computer running the Windows operating system, then the applicant recommends the user open the text file containing the source code using Microsoft WordPad. Microsoft Word- Pad is a basic word processor. From Windows 95 upwards, almost all versions of Microsoft Windows include a copy of WordPad.

If the user intends to examine the source code of any of the various HTML 4.01 web applications on a general-purpose computer running the Mac OS X operating system, then the applicant recommends that the user use Dash Code version 3.0.2. Dash code version 3.0.2 is a software application created by Apple Inc. Dash code version 3.0.2 is included as part of Apple's Xcode developer tools on the Mac OS X Snow Leopard DVD as an optional install. Xcode is a suite of tools developed by Apple, and used to develop software for Mac OS X and iOS operating systems.

Users could also use Amaya to examine the source code of any of the various HTML 4.01 web applications. Amaya is a free and open source what-you-see-is-what-you-get-web-authoring tool with browsing abilities, created by a structured editor project at the National Institute for Research in Computer Science and Control, a French national research institution, and later adopted by the World Wide Web Consortium. Amaya is written in the C computer program language and is available for Windows, Unix platforms, and Mac OS X. It can be downloaded and used completely free of charge for any purpose. For more information about downloading and using the Amaya Editor/Browser, visit the Amaya home page on the Internet.

Users could also use Apache OpenOffice to examine the source code of any of the various HTML 4.01 web applications. Apache OpenOffice is the leading open-source office software suite for word processing, spreadsheets, presentations, graphics, databases and more. It is available in many languages and works on all common computers. It stores all user data in an international open standard format and can also read and write files from other common office software packages. It can be downloaded and used completely free of charge for any purpose. For more information about downloading and using the Apache OpenOffice, visit the Open Office home page on the Internet.

Instructions on how to Use a Prototype to Play a Game in Real Time

To use each web application, users will need a general-purpose computer capable of executing software instructions including a hard drive, a motherboard with a central processing unit, at least one random access memory chip, a monitor, a keyboard, and a mouse. Users must format the hard drive of the general-purpose computer using one operating system selected from a group consisting of Windows and Mac OS X. Users must install the one operating system on the hard drive. Subsequently, users must install an Internet browser.

Opera version 11.01 is the preferred browser on the Windows operating system platform. Safari version 5.1.7 is the preferred browser on the Mac OS X operating system platform.

To use each web application, the user will also need to change the text file containing the source code into an HTML file containing the source code. The user can do so by renaming the text file as follows. Replace the ".txt" file name suffix with a ".html" file name suffix.

The applicant also recommends the user connect the general-purpose computer to the Internet while using each prototype as each web application downloads the graphics used to display face cards and ace cards of each suit from a remote website. However, if an Internet connection is unavailable to the user, then each prototype will still be able to function as a web application albeit without the benefit of the graphics used to display face cards and ace cards of each suit.

Prototype of the First-Optional Embodiment

Prototype_36. txt provides the source code for a model of a single-player-position variant of the first-optional embodiment.

Prototype of the Second-Optional Embodiment

Prototype_9.txt provides the source code for a model of a single-player-position variant of the second-optional embodiment.

Prototype of the Third-Optional Embodiment

Prototype_45. txt provides the source code for a model of a single-player-position variant of the third-optional embodiment.

Function of the Various Optional Embodiments

In general, the intended function of each of the various optional embodiments described in this detailed discussion is to provide an entertaining experience to players while providing a reasonable return to the host on the investment of energy, space and time required to make the entertaining experience available to players.

However, regulatory bodies control gaming. A new game must go through an approval process before people can play the new game in gaming establishments. That approval process includes proving the mathematical basis of the probabilities used to calculate payout tables and predict the house edge.

Accordingly, besides a description of the present invention in full, clear, concise, and exact terms, those skilled in the art require an estimation of the house edge to gain the approval from gaming authorities necessary to be able to make and use the various-optional embodiments of the game of the present invention in gaming establishments.

The house edge is the casino operator's average profit from a player's wager. The house edge is expressed as a percentage of the player's wager the casino operator will retain in the long term with strictly average luck.

Casino operators and gaming regulators generally base estimates of house edge for a new game on the following two assumptions. The first assumption is: Most players will play the new game using a "basic strategy". The basic strategy is a way of playing the game that will lose the least amount of money to the house in the long term with strictly average luck. The second assumption is: Most players do not systematically change the size of the game wager in response to changes in the composition of the cards remaining in the stack. Therefore, in order to estimate the house edge of an optional embodiment of the game of the present invention, it is necessary to find the basic strategy players would likely use to lose the least amount of money to the house in the long term with strictly average luck.

The drop is a term that refers to the money that is taken in at a table in exchange for casino tokens or credits. The hold is the percentage of the drop that the house retains when the table is closed. The attractiveness of a game to gamblers is what produces the hold. Typically, though not necessarily, gaming establishments assess the attractiveness of a new game by offering the new game in selected locations on a trial basis.

Various Other Software Applications

The computer program-listing appendix also includes the source codes of various other software applications. The applicant wrote the source codes of these various other software applications in a programming language known as QBasic. The applicant saved the source codes of these various other software applications in text files. Each text file has BIGS as the first four characters of the file name. Hereafter, the applicant will refer to these various other software applications as the software applications in the BIGS collection.

Hardware and Software Required to Use the Various Software Applications in the BIGS Collection To use each of the various software applications in the BIGS collection, users will need a general-purpose computer capable of executing software instructions including a hard drive, a motherboard with a central processing unit, at least one gigabyte of RAM, a monitor, a keyboard, and a mouse. Users must format the hard drive of the general-purpose computer using an operating system selected from a group consisting of the Microsoft Windows operating system and the Mac OS X operating system. Users must install the operating system on the hard drive. Subsequently, the users must load the source codes of the various software applications in the BIGS collection on to the hard drive of the general purpose computer.

Subsequently, the user must compile the source code of the software applications in the BIGS collection into object code. The user can do so using QB64. QB64 is a self-hosting BASIC compiler. QB64 runs on a general-purpose computer with the Microsoft Windows operating system installed on the hard drive. Alternatively, QB64 runs on a general-purpose computer with the Mac OS X operating system installed on the hard drive. Rob Galleon of Sidney Australia developed QB64 to be compatible with the Microsoft QBasic and QuickBASIC programming languages. QB64 is a C++ emitter integrated with a C++ compiler to provide compilation via C++ code and GCC optimization.

In order to obtain a copy of the QB64 compiler, users must install any compatible Internet browser on the hard drive. Users must use the Internet browser and an Internet connection to do the following. Do a search on the Internet using the search term "QB64". Find the QB64 website. Download a copy of the QB64 compiler that corresponds to the operating system installed on the hard drive. Install the QB64 compiler. Once installed on the hard drive of the general purpose computer, it is possible to use the QB64 compiler to compile the source code of each of the various software applications in the BIGS collection into object code.

Recommended Procedure for Acquiring and Using the Qb64 Compiler

The following describes the recommended procedure for acquiring and using the QB64 compiler to compile the source code of each of the various software applications in the BIGS collection into object code. A directory or folder is a location on a disk drive for storing information about files. The terms directory and folder are interchangeable. A directory tree is a hierarchy of directories consisting of a single directory called a root directory and all levels of sub-directories. A diagram (not shown) of a directory tree resembles an inverted tree, or a branch thereof, usually with a series of directories branching off from a single directory, more directories branching off from some or all of them, etc. Virtually all modern computer operating systems use directory trees for organizing files.

Upon installation, modern operating systems automatically build a directory tree on the hard drive. A sub-directory containing application files, typically though not necessarily, branches off from the directory tree. If the Microsoft Windows operating system built the directory tree on the hard drive, then the sub-directory containing applications is named "programs". If the Mac OS X operating system built the directory tree on the hard drive, then the sub-directory containing applications is named "applications".

Start by using the operating system installed on the hard drive to do the following. Find the sub-directory containing applications. Make a new folder named "QB64" inside of the sub-directory. Inside of the folder named "QB64" make another new folder. Name this new folder "BIGS". Put the text files containing the source codes of the various software applications in the BIGS collection into the folder named "BIGS".

Next, use an Internet connection to get on the Internet. Use any compatible Internet browser to do the following. Search for, find, and go to the QB64 website. Locate and go to their download page. Locate the link enabling the user to download a zip file containing the set of files required to run the QB64 compiler, click on the link, and download the zip file containing the set of files required to run the QB64 compiler. Put the zip file into the folder named "QB64" and unzip the contents.

If the user unzips the zip file on a general-purpose computer with the Microsoft Windows operating system installed on the hard drive, then afterward an icon representing an application named "qb64" will appear inside of the folder named "QB64". Find the icon. Click on the icon to start the application. The user will see a window open up. This is the console style graphic user interface provided by the QB64 compiler.

If the user unzips the zip file on a general-purpose computer with the Mac OS X operating system installed on the hard drive, then afterward two icons will appear in the folder named "QB64". A first of the two icons is labeled "qb64". A second of the two icons is labeled qb64_start.command. Find the second icon of the two icons. Click on the second of the two icons to start the application. The user will see a window open up. This is the console style graphic user interface provided by the QB64 compiler.

Across the top of the window, the user will see a menu of options. Click on the menu option named file. A sub menu will open up. Click on the word "open" in the sub menu. A sub window will open up. Inside of the sub window two columns will appear. The word 'files' appears as a label at the top of a left column. The column to the left displays the names of all files named with a '.BAS' extension. The word 'paths' appears as a label at the top of a right column. The column to the right displays the names of all folders located within the folder named 'QB64'. At the bottom of the sub window, the phrase ".BAS only" appears. To the left of the phrase is a capital letter x enclosed in square brackets. This is a button. Click on this button one time so that the button looks like a space enclosed in square brackets. Doing so will enable the QB64 compiler to display the names of all of the files including text files.

Click on the folder named "BIGS" and the qb64 application will display the names of a list of the text files contained in the folder named "BIGS". The text files contain the source codes of the various software applications in the BIGS collection. The file name at the top of the list is 'BIGS903.txt'. The text file named BIGS903.txt contains the source code of the BIGS903 software application. Click on the phrase "BIGS903.txt" and the qb64 compiler will load the source code of the BIGS903 software application into program memory and the sub window will close.

Click on the menu option named "Run" and a sub menu will open. Click on the sub menu option "start" and the "qb64" application will compile the source code of the BIGS903 software application into object code. The object code takes the form of an executable application written in C++.

If the user compiles the source code of the BIGS903 software application into object code on a general-purpose computer with the Windows operating system installed on the hard drive, then an icon named BIGS903 will appear in the folder named QB64. If the user intends to use the BIGS903 software application on a general-purpose computer with the Windows operating system installed on the hard drive, then click on the icon to start the executable application.

If the user compiles the source code of the BIGS903 software application into object code on a general-purpose computer with the Mac OS X operating system installed on the hard drive, then two icons will appear in the folder named QB64. One icon is labeled BIGS903 and the other icon is labeled BIGS903_start.command. If the user intends to use the BIGS903 software application on a general-purpose computer with the Mac OS X operating system installed on the hard drive, then click on the icon labeled BIGS903_start.command to start the executable application.

Repeat as necessary to compile the source code of each of the software applications in the BIGS collection into object code. When finished, a set of icons representing the various software applications in the BIGS collection will appear in the folder named "qb64". The various software applications in the BIGS collection do not require the presence of the "qb64" compiler to function. As long as the set of dynamic link libraries accompanying the "qb64" compiler are stored in the same folder as the applications, each application in the set will be capable of operating as a stand-alone executable application.

Viewing the Source Code of the Various Software Applications in the Bigs Collection The user can examine the source codes of any of the various software applications in the BIGS collection by opening the text file containing the source codes with a word processing program appropriate to the operating system in use on the user's general-purpose computer. For example, if a user's general-purpose computer is running the Windows operating system, then the user can use Microsoft WordPad. If a user's general-purpose computer is running the Mac OS X operating system, then the user can use the TextEdit application. The "TextEdit" application is a simple, open source, word processor distributed with Mac OS X.

Instructions for Use and Detailed Description of the Function of Each of the Various Software Applications in the BIGS Collection.

In order to perform its' function, each executable application prompts the user for input. The applicant has added comments to the source code of each of the various software applications in the BIGS collection. The comments consists of any text following a single-character-quotation mark. The 'qb64' compiler ignores comments when compiling the source code into object code. The comments give the user further instructions as to how to respond when prompted for input. The comments give the user insight into the use and function of each software application in the BIGS collection.

Each software application in the BIGS collection functions as a component. Each component saves at least one text file. Text files contain data about application output and/or a record of user responses to prompts for user input made by the software application. Some components also save at least one data file. Data files contain data about application output. Data files enable the user to load data about the application output of one component into the program memory of other components. The user uses components in a sequence to perform a desired function. Accordingly, data flows from data files saved by one component into the program memory of other components in a sequence to perform a desired function.

Figure 8:
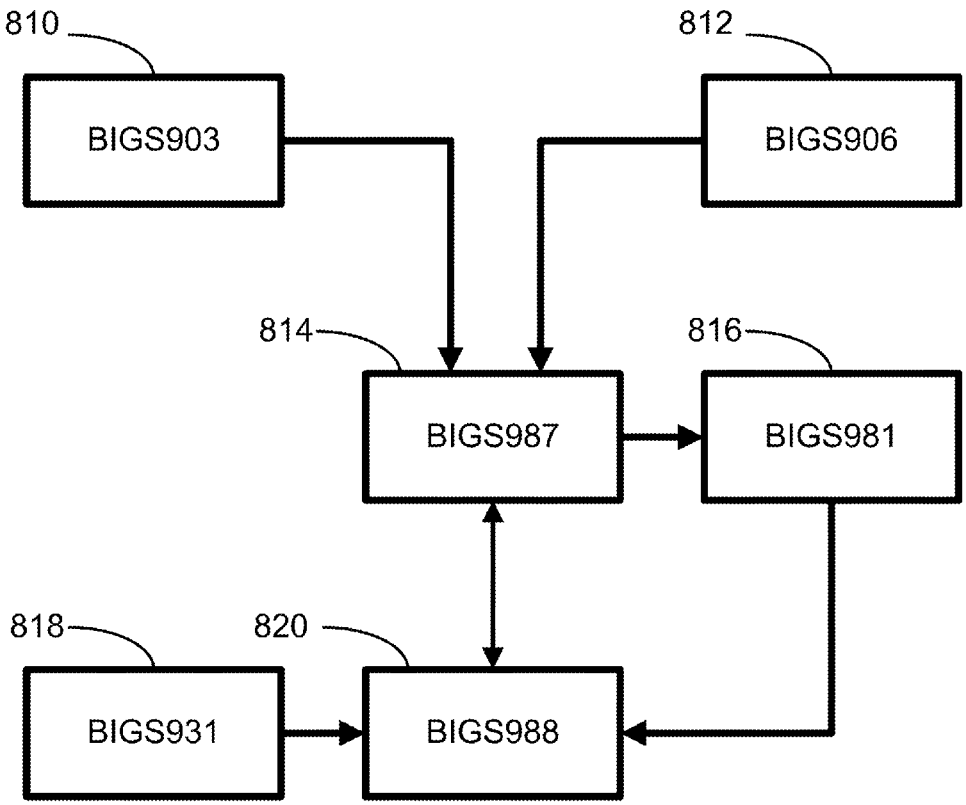
FIG. 8 shows a diagram depicting the direction data flows through the components of a first subset of software applications belonging to the BIGS collection.

FIG. 8 shows a diagram depicting the direction data flows through the components of a first subset of software applications belonging to the BIGS collection. The first subset of software applications facilitates an evaluation of any of a subset of comparing-card games belonging to the Finnish 27 family of table-card games that is subject to the following subset of rules. The dealer forms the player's initial hand by dealing two cards. The dealer forms the dealer's initial hand by either dealing a first card face down and a second card face up or by dealing a first card face up, proceeding through any additional steps required to complete the player's hand, and dealing a second card face up. If the dealer forms the dealer's initial hand by dealing a first card face down and a second card face up, then the dealer does not reveal the point value assigned to the second card of the dealer's initial hand until after proceeding through any additional steps required to complete the player's hand. Any of a subset of comparing-card games belonging to the Finnish 27 family of table-card games that is subject to the above-described subset of rules will hereafter be referred to as a single-exposure game.

Figure 9:
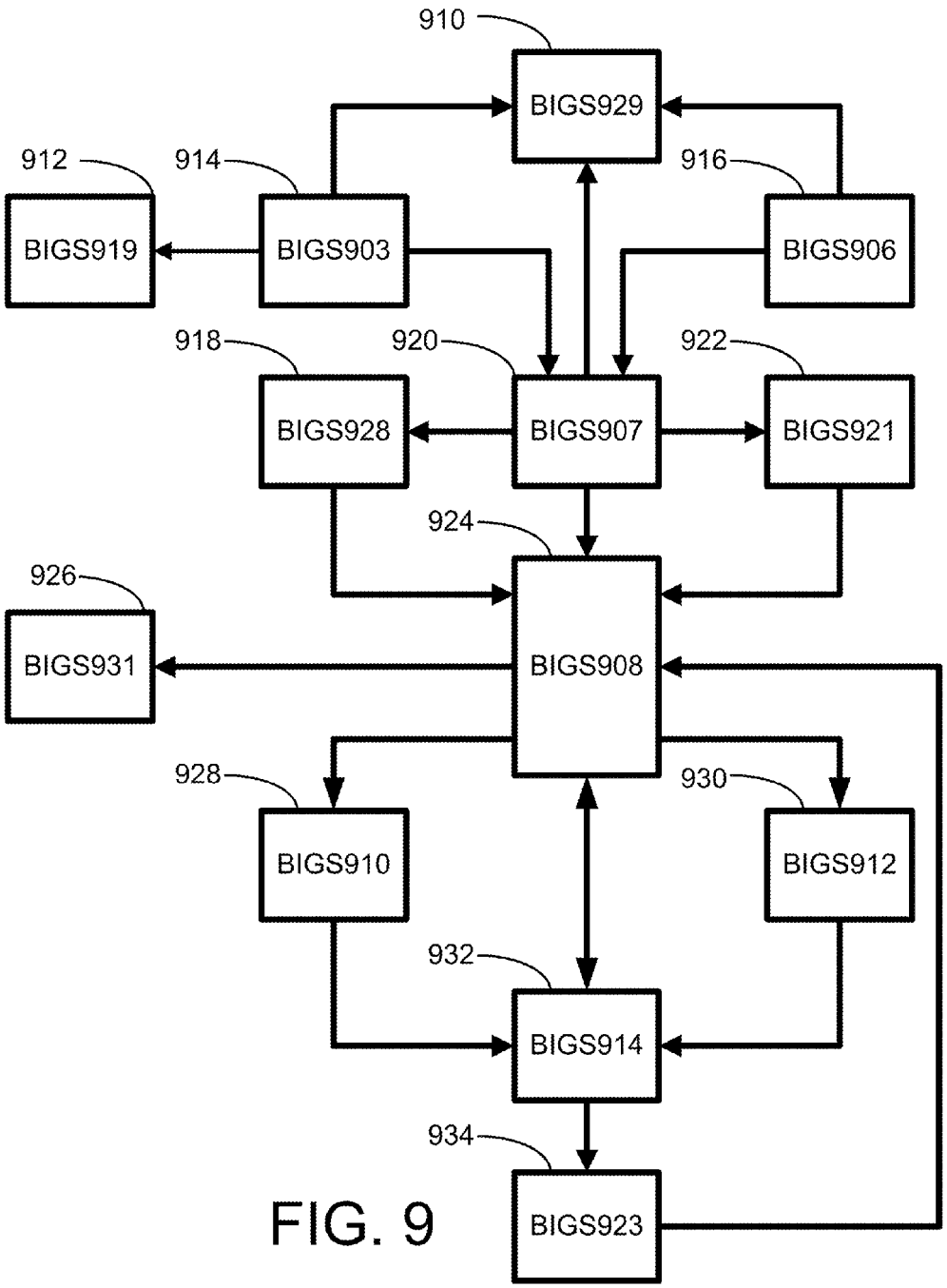
FIG. 9 shows a diagram depicting the direction data flows through the components of a second subset of software applications belonging to the BIGS collection.

FIG. 9 shows a diagram depicting the direction data flows through the components of a second subset of software applications belonging to the BIGS collection. The second subset of software applications facilitates an evaluation of any of a subset of comparing-card games belonging to the Finnish 27 family of table-card games that is subject to the following subset of rules. The dealer forms the player's initial hand by dealing two cards. The dealer forms the dealer's initial hand by dealing two cards. The dealer reveals to the player the point value assigned to each of the two cards in the dealer's initial hand before the dealer does consult with the player for a decision on how to play the player's hand. Any of a subset of comparing-card games belonging to the Finnish 27 family of table-card games that is subject to the above-described subset of rules will hereafter be referred to as a double-exposure game.

Player-Finish-Probabilities

The BIGS903 software application 810 and 914 enables the user to input a user-defined subset of game rules. The user-defined subset of game rules specifies the composition of each deck, and the number of decks in the stack. If each deck includes at least one joker, then the user-defined subset of game rules includes a rule selected by the user from a group of two rules wherein: The first of the group of two rules is each and every joker has a value of zero points. The second of the group of two rules is each and every joker has a value of any number of points required to make a hand total of twenty-seven points. Given the user-defined subset of game rules, the BIGS903 software application builds a set of databases of player-finish probabilities. The BIGS903 software application saves the set of databases and data about the user-defined subset of game rules to a set of data files.

A strategy for the player's use of the hit option specifies a set of target-numerical sums consisting of a target-numerical sum for the play of the player's soft hands and a target-numerical sum for the play of the player's hard hands. To use any given strategy for the player's use of the hit option to make decisions on how to play the player's hand, the player does the following. If the player's hand total is less than the target-numerical sum specified for the type of hand the player has, then the player hits. If the player's hand total is at least equal to the target-numerical sum specified for the type of hand the player has, then the player stands.

The BIGS collection of software applications supports eighty-one strategies for the player's use of the hit option. Each of the eighty-one-supported strategies for the player's use of the hit option does specify one of the following eighty-one sets of target-numerical sums.

15/A5, 15/A6, 15/A7, 15/A8, 15/A9, 15/AT, 15/AJ, 15/AQ, 15/AK, 16/A5, 16/A6, 16/A7, 16/A8, 16/A9, 16/AT, 16/AJ, 16/AQ, 16/AK, 17/A5, 17/A6, 17/A7, 17/A8, 17/A9, 17/AT, 17/AJ, 17/AQ, 17/AK, 18/A5, 18/A6, 18/A7, 18/A8, 18/A9,

18/AT, 18/AJ, 18/AQ, 18/AK, 19/A5, 19/A6, 19/A7, 19/A8, 19/A9, 19/AT, 19/AJ, 19/AQ, 19/AK, 20/A6, 20/A7, 20/A8, 20/A9, 20/AT, 20/AJ, 20/AQ, 20/AK, 21/A7, 21/A8, 21/A9, 21/AT, 21/AJ, 21/AQ, 21/AK, 22/A8, 22/A9, 22/AT, 22/AJ, 22/AQ, 22/AK, 23/A9, 23/AT, 23/AJ, 23/AQ, 23/AK, 24/AT, 24/AJ, 24/AQ, 24/AK, 25/AJ, 25/AQ, 25/AK, 26/AQ, 26/AK, and 27/AK.

The number of strategies evaluated varies in accordance with the player's initial-hand total as follows. If it is possible for the player to form a soft hand with a soft total that is less than the target-numerical sum for the play of the player's soft hands specified by a given strategy, then that given strategy is evaluated. If a given strategy is evaluated, then that given strategy is described below as one of a set of strategies for the player's use of the hit option that has at least a chance of being optimal.

A player-finish probability is the probability that the player's complete hand will have a particular hand total given a strategy for the player's use of the hit option that has at least a chance of being optimal, and given all combinations of card ranks that are possible for a set of hands consisting of the player's complete hand and the dealer's initial hand. A subset of player-finish-probabilities consists of a player-finish probability for each of a set of hand totals that are possible for the player's complete hand. A set of player-finish probabilities consists of a subset of player-finish probabilities for each of a set of strategies for the player's use of the hit option that have at least a chance of being optimal. A database of player finish probabilities consists of the set of player-finish probabilities for each of the combinations of card ranks that could be the combination of card ranks assigned to the cards removed from the stack and dealt face up to form a set of hands consisting of the player's initial hand and the dealer's initial hand.

The two types of player's initial hand are a player's primary-initial hand and a player's post-split-initial hand. Both types of player's initial hand consist of two cards.

The set of databases of player-finish probabilities consists of three databases. The first database is built for the set of hands consisting of the player's primary-initial hand and the dealer's initial hand. The second and third databases are built for the set of hands consisting of the player's post-split-initial hand and the dealer's initial hand.

The BIGS919 software application 912 enables the user to load into program memory a database of player-finish probabilities built for the set of hands consisting of the player's primary-initial hand and the dealer's initial hand. Subsequently, the BIGS919 software application enables the user to input data about the combination of card ranks assigned to the cards removed from the stack and dealt face up to form the set of hands consisting of the player's initial hand and the dealer's initial hand. The BIGS919 software application uses the data to produce a set of tables (not shown). The set of tables displays the set of player-finish probabilities that corresponds to the user-defined combination of card ranks assigned to the cards removed from the stack and dealt face up to form the set of hands consisting of the player's primary-initial hand and the dealer's initial hand. The BIGS919 software application saves the set of tables in a text file.

The user can open the text file and view the set of tables contained therein. Doing so may enable the user to gain a better understanding of the set of player-finish probabilities calculated by the BIGS903 application.

Dealer-Finish-Probabilities

The BIGS906 software application 812 and 916 enables the user to input a user-defined subset of game rules. The user-defined subset of game rules specifies the composition of each deck, and the number of decks in the stack. If each deck includes at least one joker, then the user-defined subset of game rules includes a rule selected by the user from a group of two rules wherein: The first of the group of two rules is each and every joker has a value of zero points. The second of the group of two rules is each and every joker has a value of any number of points required to make a hand total of twenty-seven points. Given the user-defined subset of game rules, the BIGS906 software application builds a set of databases of dealer-finish probabilities. The BIGS906 software application saves the set of databases to a set of data files.

A strategy for the play of the dealer's hand specifies a set of target-numerical sums consisting of a target-numerical sum for the play of the dealer's soft hands and a target-numerical sum for the play of the dealer's hard hands. To use any given strategy for the play of the dealer's hand to make decisions on how to play the dealer's hand, the dealer does the following. If the dealer's hand total is less than the target-numerical sum specified for the type of hand the dealer has, then the dealer hits. If the dealer's hand total is at least equal to the target-numerical sum specified for the type of hand the dealer has, then the dealer stands.

The BIGS collection of software applications supports twenty-seven strategies for the play of the dealer's hand. Each of the twenty-seven-supported strategies for the play of the dealer's hand does specify one of the following twenty-seven sets of target-numerical sums.

19/A5, 19/A6, 19/A7, 19/A8, 19/A9, 19/AT, 19/AJ, 20/A6, 20/A7, 20/A8, 20/A9, 20/AT, 20/AJ, 21/A7, 21/A8, 21/A9, 21/AT, 21/AJ, 22/A8, 22/A9, 22/AT, 22/AJ, 23/A9, 23/AT, 23/AJ, 24/AT, and 24/AJ.

A dealer-finish probability is the probability that the dealer's complete hand will have a particular hand total given a particular strategy for the play of the dealer's hand, and given all combinations of card ranks that are possible for a set of hands consisting of the player's initial hand and the dealer's complete hand. A subset of dealer-finish-probabilities consists of a dealer-finish probability for each of a set of hand totals that are possible for the dealer's complete hand. A set of dealer-finish probabilities consists of a subset of dealer-finish probabilities for each of the twenty-seven-supported strategies for the play of the dealer's hand. A database of dealer-finish probabilities consists of the set of dealer-finish probabilities for each of the combinations of card ranks that could be the combination of card ranks assigned to the cards removed from the stack and dealt face up to form a set of hands consisting of the player's initial hand and the dealer's initial hand The set of databases of dealer-finish probabilities consists of three databases. The first database is built for the set of hands consisting of the player's primary-initial hand and the dealer's initial hand. The second and third databases are built for the set of hands consisting of the player's post-split-initial hand and the dealer's initial hand.

Set of Combination-Dependent-Playing-Strategy Tables

A playing strategy is a strategy for the play of the player's hand. The BIGS collection of software applications supports eighty-four playing strategies. The eighty-four-supported-playing strategies consist of the eighty-one-supported strategies for the player's use of the hit option, and a set of three additional playing strategies consisting of double down, split, and surrender.

A combination-dependent-playing strategy is the best playing strategy for the play of the player's hand given the user-defined set of game rules, and given the combination of card ranks assigned to the cards removed from the stack and dealt face up to form the set of hands consisting of the player's initial hand and the dealer's initial hand. A combination-dependent-playing-strategy table provides a combination-dependent-playing strategy for each of the combinations of card ranks that could be the combination of card ranks assign to the cards removed from the stack and dealt face up to form the set of hands consisting of the player's initial hand and the dealer's initial hand.

If the user-defined set of game rules does not give the option to split to the player, then a set of combination-dependent-playing-strategy tables consists of one combination-dependent-playing-strategy table found for the set of hands consisting of the player's primary-initial hand and the dealer's initial hand. If the user-defined set of game rules does give the option to split to the player, then the set of combination-dependent-playing-strategy tables consists of one combination-dependent-playing-strategy table found for the set of hands consisting of the player's primary-initial hand and the dealer's initial hand, and two combination-dependent-playing-strategy tables found for the set of hands consisting of the player's post-split-initial hand and the dealer's initial hand.

Under most circumstances, the player refers to the set of combination-dependent-playing-strategy tables one time per each player's initial hand.

The BIGS907 software application 920 enables the user to do the following. Load into program memory a set of databases of player-finish probabilities saved to a set of data files by the BIGS903 software application 914. Load into program memory a set of databases of dealer-finish probabilities saved to a set of data files by the BIGS906 software application 916. Load into program memory data about a user-defined subset of game rules saved to a data file by the BIGS903 software application. Input a user-defined set of game rules consisting of the user-defined subset of game rules and the remaining game rules required to play a double-exposure game. Find the set of combination-dependent-playing-strategy tables for a double-exposure game that is subject to the user-defined set of game rules. Calculate an estimate of the expected value of the game wager for the double-exposure game that is subject to the user-defined set of game rules.

The BIGS987 software application 814 enables the user to do the following. Load into program memory a set of databases of player-finish probabilities saved to a set of data files by the BIGS903 software application 810. Load into program memory a set of databases of dealer-finish probabilities saved to a set of data files by the BIGS906 software application 812. Load into program memory data about the user-defined subset of game rules saved to a data file by the BIGS903 software application. Input a user-defined set of game rules consisting of the subset of game rules and the remaining game rules required to play a single-exposure game. Find the set of combination-dependent-playing-strategy tables for a single-exposure game that is subject to the user-defined set of game rules. Calculate an estimate of the expected value of the game wager for the single-exposure game that is subject to the user-defined set of game rules.

Abbreviated-Combinatorial Analysis

The BIGS929 software application 910 enables the user to do the following. Load into program memory a database of player-finish probabilities built for the set of hands consisting of the player's primary-initial hand and the dealer's initial hand and saved to a data file by the BIGS903 software application 914. Load into program memory a database of dealer-finish probabilities built for the set of hands consisting of the player's primary-initial hand and the dealer's initial hand and saved to a data file by the BIGS906 software application 916. Load into program memory data about a user-defined set of game rules saved to a data file by the BIGS907 software application 920. Input the combination of card ranks assigned to the cards removed from the stack and dealt face up to form the set of hands consisting of the player's primary-initial hand and the dealer's initial hand.

The BIGS929 software application also enables the user to load into program memory a database saved to a data file by the BIGS907 software application. The database contains data about the expected value of the game wager, given each of a set of possible strategies for the play of the player's hand, and given each of the combinations of card ranks that could be the combination of card ranks assigned to the cards removed from the stack and dealt face up to form the set of hands consisting of the player's primary-initial hand and the dealer's initial hand.

The BIGS929 software application uses the above-described data to produce a set of tables. The set of tables consists of three different types of tables.

The first type of table presents a summary of the subset of dealer-finish probabilities given the strategy for the play of the dealer's hand specified by the user-defined set of game rules, and given the user-defined combination of card ranks assigned to the cards removed from the stack and dealt face up to form the set of hands consisting of the player's primary-initial hand and the dealer's initial hand. The first type of table also presents an estimate of the expected value of the game wager given the best strategy for the player's use of the hit option. The first type of table also presents an estimate of the expected value of the game wager for each of any combination of strategies that the user-defined set of game rules makes available to the player selected from a group consisting of double down, split, and surrender.

The BIGS929 software application compares estimates of the expected value of the game wager calculated for each of the set of strategies for the player's use of the hit option that has at least a chance of being optimal and identifies the strategy for the player's use of the hit option that yields the highest estimate of the expected value of the game wager. The strategy that yields the highest estimate of the expected value of the game wager is the best strategy for the player's use of the hit option. Data loaded into program memory from data files saved by The BIGS907 software application provides an estimate of the expected value of the game wager for each of any other available strategies for the play of the player's hand selected from a group consisting of double down, surrender, and split.

The BIGS929 software application compares the best strategy for the player's use of the hit option to each of any other available strategies for the play of the player's hand and identifies the strategy for the play of the player's hand that yields the highest estimate of the expected value of the game wager. The strategy that yields the highest estimate of the expected value of the game wager is the best strategy for the play of the player's hand.

The following is an example of the first type of table. The user-defined set of game rules is the user-defined set of game rules herein ascribed to the second-optional embodiment.

card ranks assigned to player cards are 8 and 9 dealer cards are 5 and 10 given the user input stack composition, and user defined set of game rules, here are the dealer finish probabilities, and expected value of the available player response strategies

| 22 | 23 | 24 | 25 | 26 | 27 | bust |
|---|---|---|---|---|---|---|
| 12.16 | 11.82 | 11.81 | 11.77 | 12.08 | 12.09 | 28.27 |

total hands accounted for are 100.000% of all possible

22/A8 stand strategy yields a win minus loss expectation of −0.1623 double down strategy yields a win minus loss expectation of −0.3854 surrender strategy yields a win minus loss expectation of −0.5000

22/A8 stand strategy is found to be the optimal strategy.

The numbers 22 through 27 and the word bust represent the hand totals that are possible for the dealer's complete hand. The decimal number appearing below each of the hand totals that are possible for the dealer's complete hand represents the percentage value for the probability of the occurrence of that particular hand total. The decimal number given for each win minus loss expectation represents a multiple of the game wager that the player can expect to win or lose in the long run with strictly average luck when using the corresponding strategy to play the player's hand. Accordingly, the meaning of the phrase 'the win minus loss expectation' is the same as the meaning of the phrase 'the expected value of the game wager'.

The optimal strategy is the best strategy for the play of the player's hand. Various of the software applications in the BIGS collection make the above-described comparison to identify the best strategy for the play of the player's hand. Accordingly, one of the intended functions of the BIGS929 software application is to provide the user with a better understanding of how the above-described comparison is made.

FIG. 10 shows an example of the second type of table.

As shown in FIG. 10, the hand totals that are possible for the player's complete hand appear in the far left column of the table and serve as labels of the rows of the table. The probability of the occurrence of each of the hand totals that are possible for the player's complete hand appear in the column to the immediate right. These probabilities of occurrence are the subset of player-finish probabilities calculated by the BIGS903 software application 910 for the user-defined combination of card ranks assigned to the four cards in the set of hands consisting of the player's primary-initial hand and the dealer's initial hand.

As shown in FIG. 10, the cell at the bottom left corner of the table contains a decimal number. The decimal number gives the value for a summation made of the probabilities of the occurrence of all of the hand totals that are possible for the player's complete hand.

To establish the set of hand totals that are possible for the player's complete hand, the applicant assumed the following and did write various of the BIGS collection of software applications accordingly. If the player's-hand total is less than fifteen points then under all circumstances the player will hit. If the player's hand total is greater than twenty-six points, then under all circumstances the player will stand. Thirteen points is the highest card value that the player can draw to a hard total of hard twenty-six. Twenty-six points plus thirteen points equals thirty-nine points. Accordingly, the set of hand totals that are possible for the player's complete hand consists of all point values from fifteen points to thirty-nine points.

The probabilities of the occurrence of 8-9-10 hands, 9-9-9 hands, and six, seven, eight, and nine card hands with numerical sum values of twenty-seven points, are stored separately by the BIGS903 application from the probability of the occurrence of other hands totaling twenty-seven points. Doing so makes it possible to calculate the expected value of the game wager should the user-defined set of game rules make bonus payouts on any of these card combinations available to players. The probability of the occurrence of a hand consisting of nine cards with a numerical sum total of less than twenty-eight points is also stored separately for the same reason. If the user-defined subset of game rules used by the BIGS903 software application includes a rule specifying that any hand that includes a joker has a hand total of twenty-seven points, then the probability of the occurrence of a player's hand that includes at least one joker is store separately.

The eight rows of the table labeled with four-character labels represent a set of eight combinations of cards that may be possible for a player's complete hand. The meaning of each of the four-character labels is as follows. The meaning of the label 'jo27' is the player's hand includes a joker, and as such the player's hand total is twenty-seven points. The meaning of the label 'p999' is the player's hand consists of three nines. The meaning of the label 'p89T' is the player's hand consists of an eight, a nine, and a ten. The meaning of the label '6c27' is the player's hand consists of six cards with a numerical sum value of twenty-seven points. The meaning of the label '7c27' is the player's hand consists of seven cards with a numerical sum value of twenty-seven points. The meaning of the label '8c27' is the player's hand consists of eight cards with a numerical sum value of twenty-seven points. The meaning of the label '9c27' is the player's hand consists of nine cards with a numerical sum value of twenty-seven points. The meaning of the label 'nchw' is the player's hand consists of nine cards with a numerical sum value of less than twenty-eight points.

As shown in FIG. 10, the hand totals that are possible for the dealer's complete hand appear in the top row of the table and serve as the labels of the columns on the table. The probability of the occurrence of each of the hand totals that are possible for the dealer's complete hand appear in the row immediately beneath. These probabilities of occurrence are the subset of dealer-finish probabilities calculated by the BIGS906 software application 912 for the user-defined combination of card ranks assigned to the four cards in the set of hands consisting of the player's primary-initial hand and the dealer's initial hand.

As shown in FIG. 10, the cell at the top right corner of the table contains a decimal number. The decimal number gives the value for a summation made of the probabilities of the occurrence of all of the hand totals that are possible for the dealer's complete hand.

The target-numerical sum for the dealer's hard hands specified by the predetermined strategy for the play of the dealer's hand causes the dealer to finish at one of a set of possible hand totals. The lowest possible hand total that the dealer could finish with is a number of points equal to the target-numerical sum specified for the play of the dealer's hard hands by the user-defined set of game rules. As long as the dealer has a soft hand, the dealer cannot bust. If the dealer has a hard hand, then the highest possible hand total that the dealer could finish with is twelve points more than the target-numerical sum specified for the play of the dealer's hard hands, because while holding a hard hand, the highest hard total that the dealer can draw to is one point less than the target-numerical sum specified for the play of the dealer's hard hands, and thirteen points is the highest number of points the rules could possibly assign to any card the dealer could draw. Accordingly, thirteen hand totals are possible for the dealer's complete hand.

The user-defined set of game rules is the user-defined set of game rules herein ascribed to the second-optional embodiment. Accordingly, the predetermined strategy for the play of the dealer's hard hands is the dealer must stand on hard twenty-two. Accordingly, the set of hand totals that are possible for the dealer's complete hand consists of all hand totals from twenty-two points to thirty-four points.

As shown in FIG. 10, the cells located at the intersection of the rows labeled with each of the hand totals possible for the player's complete hand and the columns labeled with each of the hand totals possible for the dealer's complete hand contain decimal numbers. Each decimal number is equal to the product of the probability of the occurrence of the player's hand total multiplied by the probability of the occurrence of the dealer's hand total multiplied by the return wherein: The return is equal to the quotient of the value of the gain or loss that occurs as a result of the occurrence of the hand totals divided by the value of the game wager.

For example, the probability of the occurrence of a player's hand total of twenty-six points is 10.14%. The probability of the occurrence of a dealer's hand total of twenty-seven points is 12.09%. The outcome of the game given that combination of hand totals is the dealer's hand wins. If the outcome of the game is the dealer's hand wins, then the dealer collects the game wager. If the dealer collects the game wager, then the return is equal to −1. Accordingly, the cell located at the intersection of the row and column corresponding to those hand totals contains the following product. 10.14 percent multiplied by 12.09 percent multiplied by a return of −1 for a product of −1.23 percent. The product of −1.23 percent represents the contribution of this possible combination of hand totals to the expected value of the game wager given the set of target-numerical sums specified by that particular strategy for the player's use of the hit option, given the user-defined set of game rules, and given the user-defined combination of card ranks assigned to the cards removed from the stack and dealt face up to form the set of hands consisting of the player's initial hand and the dealer's initial hand.

As shown in FIG. 10, the column on the far right is labeled with the word 'total'. A set of cells in that column intersect with the rows labeled by the set of hand totals possible for the player's complete hand. Each cell in the set of cells contains a summation of all of the contributions to the expected value of the game wager made by a particular one of the set of hand totals that are possible for the player's complete hand.

As shown in FIG. 10, the bottom row is labeled with the word 'total'. A set of cells in that row intersect with the columns labeled with the set of hand totals that are possible for the dealer's complete hand. Each cell in the set of cells contains a summation of all of the contributions to the expected value of the game wager made by a particular one of the set of hand totals that are possible for the dealer's complete hand.

As shown in FIG. 10, the cell at the bottom right corner of the table contains a decimal number. The decimal number is the expected value of the game wager, given the set of target-numerical sums specified by that particular strategy for the player's use of the hit option, given the user-defined set of game rules, and given the user-defined combination of card ranks assigned to the combination of cards removed from the stack and dealt face up to form the set of hands consisting of the player's initial hand and the dealer's initial hand.

The BIGS929 software application calculates the expected value of the game wager by making a summation of all contributions to the expected value of the game wager made by all sets of hand totals that are possible for the set of hands consisting of the player's complete hand and the dealer's complete hand. This method of calculating the expected value of the game wager is called 'abbreviated-combinatorial analysis'. The BIGS907 software application 920, the BIGS914 software application 932, the BIGS928 software application 918, and the BIGS987 software application 814 use this process to calculate the expected value of each strategy for the player's use of the hit option that has at least a chance of being optimal.

For each of the set of strategies for the player's use of the hit option that has at least a chance of being optimal, the BIGS929 software application provides one of these second types of tables. Studying these tables and the source code should give the user some insight into the mathematical processes that go into performing an abbreviated-combinatorial analysis.

The BIGS929 software application provides a third type of table. Below is an example of the third type of table.

card ranks assigned to player cards are 8 and 9 dealer cards are 5 and 10 given the user input stack composition, and user defined set of game rules, a summary of results of an abbreviated combinatorial analysis of a set of possible strategies for the play of the player's initial hand reads as follows:

| | | |
|---|---|---|
| stand at 15 | strategy has an expected value of | −43.46% |
| stand at 16 | strategy has an expected value of | −43.46% |
| stand at 17 | strategy has an expected value of | −43.46% |
| stand at 18 | strategy has an expected value of | −19.27% |
| stand at 19 | strategy has an expected value of | −18.08% |
| stand at 20 | strategy has an expected value of | −17.14% |
| stand at 21 | strategy has an expected value of | −16.48% |
| stand at 22 | strategy has an expected value of | −16.23% |
| stand at 23 | strategy has an expected value of | −17.77% |
| stand at 24 | strategy has an expected value of | −22.89% |
| stand at 25 | strategy has an expected value of | −32.38% |
| stand at 26 | strategy has an expected value of | −46.74% |
| stand at 27 | strategy has an expected value of | −67.25% |

The table provides a summary of the results detailed in the set of tables of the second type. The table consist of a listing of the expected value of the game wager given each of a set of strategies for the player's use of the hit option that has at least a chance of being optimal, given the user-defined set of game rules, and given the user-defined combination of card ranks assigned to the cards removed from the stack and dealt face up to form the set of hands consisting of the player's initial hand and the dealer's initial hand. Studying this table and the source code should give the user some insight into the mathematical processes that go into finding the best strategy for the player's use of the hit option.

The BIGS929 software application 910 saves the set of tables to a text file. Users can open the text file and view the set of tables contained therein. Doing so, may enable the user to gain a better understanding of how the BIGS907 software application 920 performs an abbreviated combinatorial analysis to calculate an estimate of the expected value of the game wager, given the user-defined set of game rules, and given the user-defined combination of card ranks assigned to the combination of cards removed from the stack and dealt face up to form the set of hands consisting of the player's initial hand and the dealer's initial hand. Doing so may also enable the user to gain a better understanding of how the BIGS907 software application identifies the best strategy for the player's use of the hit option, given the user-defined set of game rules, and given the user-defined combination of card ranks assigned to the combination of cards removed from the stack and dealt face up to form the set of hands consisting of the player's initial hand and the dealer's initial hand.

Total-Dependent-Basic Strategies

The main draw back of the set of combination-dependent-playing-strategy tables is the vast number of combinations of card ranks that are possible for the cards removed from the stack and dealt face up to form the set of hands consisting of the player's initial hand and the dealer's initial hand. The vast number of possible combinations of card ranks makes it difficult for skilled players to memorize and/or make use of the set of combination-dependent-playing-strategy tables.

A total-dependent-basic strategy is the best option for the play of the player's hand given the user-defined set of game rules, and given a set of hand totals consisting of the player's hand total and the dealer's hand total. A total-dependent-basic-strategy table provides a total-dependent-basic strategy for each set of hand totals that is possible for the set of hands consisting of the player's hand and the dealer's hand. In a single-exposure game, the set of hand totals that are possible for the dealer's hand consists of all hand totals that are possible for the dealer's up card. In a double-exposure game, the set of hand totals that are possible for the dealer's hand consists of all hard totals that are possible for the dealer's initial hand and all soft totals that are possible for the dealer's initial hand. The set of hand totals that are possible for the player's hand consists of all non-pair-hard totals that are possible for the player's hand, all non-pair-soft totals that are possible for the player's hand, and all pair-hand totals that are possible for the player's hand wherein: A pair is an initial hand consisting of two cards assigned identical ranks.

The player refers to the total-dependent-basic-strategy table each time the player makes a decision on how to play the player's hand.

The main advantage of the total-dependent-basic-strategy table is the number of sets of hand totals that are possible for the set of hands consisting of the player's hand and the dealer's hand is far smaller than the number of combinations of card ranks that are possible for the cards removed from the stack and dealt face up to form the set of hands consisting of the player's initial hand and the dealer's initial hand. The far smaller number of sets of hand totals makes it easier for skilled players to memorize and/or make use of the total-dependent-basic-strategy table than it is for skilled players to memorize and/or make use of the set of combination-dependent-playing-strategy tables.

For each of the combination of card ranks that could be the combination of card ranks assigned to the three cards removed from the stack and dealt face up to form the two cards in the player's initial hand and the dealer's up card, the BIGS987 software application 814 does all of the following. The BIGS987 software application calculates an estimate of the expected value of the game wager given each of the strategies for the play of the player's hand that has at least a chance of being optimal, and saves the results of these calculations to a data file with a 't' character as the file name suffix. The BIGS987 software application calculates the probability of the occurrence of the combination of card ranks and saves the results of these calculations to a data file with a 'p' character as the file name suffix.

The BIGS981 software application 816 uses the data contained in these files to convert the set of combination-dependent-playing-strategy tables into a total-dependent-basic-strategy table. Accordingly, the BIGS981 software application is capable of producing a set of files containing data about the total-dependent-basic-strategy table for a single exposure game.

For each of the combination of card ranks that could be the combination of card ranks assigned to the cards removed from the stack and dealt face up to form the set of hands consisting of the player's initial hand and the dealer's initial hand, the BIGS907 software application 920 does all of the following. The BIGS907 software application performs an abbreviated-combinatorial analysis to calculate the expected value of the game wager for each of the strategies for the play of the player's hand that has at least a chance of being optimal, and saves the results of these calculations to a data file with a 't' character as the file name suffix. The BIGS907 software application calculates the probability of the occurrence of the combination of card ranks and saves the results of these calculations to a data file with a 'p' character as the file name suffix.

The BIGS921 software application 922 uses the data contained in these files to convert the set of combination-dependent-playing-strategy tables into a total-dependent-basic-strategy table. Accordingly, the BIGS921 software application is capable of producing a set of files containing data about the total-dependent-basic-strategy table for a double exposure game.

Using Game Simulation Results to go Beyond the Limitations of Abbreviated Combinatorial Analysis Abbreviated combinatorial analysis yields data about the expected value of the game wager based on the probabilities of the occurrence of each of a set of hand totals that are possible for the player's complete hand and based on the probabilities of the occurrence of each of a set of hand totals that a possible for the dealer's complete hand. The probabilities of the occurrence of each of a set of hand totals that are possible for the player's complete hand are calculated by the BIGS903 software application and do not include the probabilities of the occurrence of five-card-poker hands. The probabilities of the occurrence of each of a set of hand totals that are possible for the dealer's complete hand are calculated by the BIGS906 software application and do not include the probabilities of the occurrence of five-card-poker hands. However, game simulators can provide data about the probabilities of the occurrence of five-card-poker hands.

If an optional embodiment is subject to a predetermined set of game rules that specifies any of the following, then data about the probabilities of the occurrence of each category of five-card-poker hand is needed in order to be able to calculate the expected value of the game wager and find the combination-dependent-playing-strategy table for the optional embodiment. The user-defined set of game rules specifies that the dealer pays the player bonuses for winning-player hands that also make qualifying-five-card-poker hands. The user-defined set of game rules specifies that if the player's complete hand includes the five cards of a qualifying-five-card-poker hand, and if the player's hand total is less than hard twenty-eight, then a predetermined outcome does occur. The user-defined set of game rules specifies that if the dealer's complete hand includes the five cards of a qualifying-five-card-poker hand, and if the dealer's hand total is less than hard twenty-eight, then a predetermined outcome does occur.

If data about the probabilities of the occurrence of each category of five-card-poker hand is needed to calculate the expected value of the game wager and find the combination-dependent-playing-strategy table for an optional embodiment, then the results of a series of game simulations are required. The series of game simulations consists of at least one game simulation for each of a set of strategies for the player's use of the hit option that has at least a chance of being optimal.

Obtaining the required results of the series of game simulations involves using various applications of the BIGS collection in accordance with the steps of a procedure. The procedure for a double exposure game is discussed in detail in the comments written into the source code of the BIGS907 software application. The procedure for a single exposure game is discussed in detail in the comments written into the source code of the BIGS987 software application.

Game Simulators

The BIGS908 software application 924 is a game simulator. The component enables the user to do the following. Load into program memory a user-defined set of game rules saved to a data file by a software application selected from a group consisting of the BIGS907 software application 920 and the BIGS921 software application 922. Load into program memory a matching-strategy table selected from a group consisting of a set of combination-dependent-playing-strategy tables saved to a data file by the BIGS907 software application 920 and a total-dependent-basic-strategy table saved to a data file by the BIGS921 software application 922. Use the matching-strategy table to make decisions on how to play the player's hand. Use the predetermined strategy for the play of the dealer's hand specified by the user-defined set of game rules to make decisions on how to play the dealer's hand. Simulate millions of rounds of play of the double exposure game in accordance with the user-defined set of game rules.

The BIGS988 software application 820 is a game simulator. The component enables the user to do the following. Load into program memory a user-defined set of game rules saved to a data file by a software application selected from a group consisting of the BIGS987 software application 814 and the BIGS981 software application 816. Load into program memory a matching-strategy table selected from a group consisting of a set of combination-dependent-playing-strategy tables saved to a data file by the BIGS987 software application and a total-dependent-basic-strategy table saved to a data file by the BIGS981 software application. Use the matching-strategy table to make decisions on how to play the player's hand. Use the predetermined strategy for the play of the dealer's hand specified by the user-defined set of game rules to make decisions on how to play the dealer's hand. Simulate millions of rounds of play of the single exposure game in accordance with the user-defined set of game rules.

Various optional embodiments are subject to predetermined sets of game rules that do specify a method of play wherein the dealer does shuffle the cards manually before the first round of play and subsequently reshuffles the cards manually each time less than a certain percentage of the stack remains in the shoe. If the predetermined set of game rules herein ascribed to an optional embodiment does specify the above-described method of play, then skilled players might be able to gain a theoretical advantage over the house by using various card counting, betting, and playing strategies.

Modeling the Behavior of Human Card Counters:

The Running Count

Both the game simulators enable users to model the behavior of human card counters by programming the computer-controlled player to use a card-counting strategy and by programming the computer-controlled player to use a betting strategy to vary the size of the game wager in response to changes in the card count. A typical card-counting strategy assigns a count value to each rank of card. The count value assigned to each rank of card is roughly equal to the change in the expected value of the game wager caused by the removal of one card of that particular rank from the stack.

Whenever a card is exposed, a counter adds the count value of that particular rank of card to a running total, known as the 'running count'. The running count gives the card counter a measure of the expected value of the game wager.

The higher the running count is the higher the expected value of the game wager. If a particular rank of card is assigned a negative count value, then the removal of one card of that particular rank from the shoe causes a change in the expected value of the game wager that is favorable to the dealer. If a particular rank of card is assigned a count value of zero, then the removal of one card of that particular rank from the shoe causes no change in the expected value of the game wager. If a particular rank of card is assigned a positive count value, then the removal of one card of that particular rank from the shoe causes a change in the expected value of the game wager that is favorable to the player.

If the house has a significant edge over the player, then most of the time the running count will indicate that the expected value of the game wager favors the house. Whenever the running count is high enough to indicate that the expected value of the game wager favors the player, then the card counter raises the game wager.

The card counter usually does so in accordance with a betting strategy. A bet spread is equal to the quotient of the size of the large game wagers the card counter makes when the running count is high enough to indicate that the expected value of the game wager favors the player divided by the size of the small game wagers the card counter makes when the running count is low enough to indicate that the expected value of the game wager is unfavorable to the player. If the bet spread is large enough and if the built-in house edge of a game is low enough, then under the right circumstances skilled players can use a card-counting strategy and a betting strategy to overcome the built-in house edge of a game and in the long term win more from the house than is lost to the house.

The size of the effect of the removal of any given rank of card is inversely proportional to the number of cards remaining in the stack. That is. The greater the number of cards remaining in the stack the smaller the effect of the removal of a single card to the discard pile. The smaller the number of cards remaining in the stack the larger the effect of removal of a single card to the discard pile. This fact makes the running count an inaccurate measure of the expected value of the game wager. A more accurate measure of the expected value of the game wager is desirable. Two kinds of card-counting strategies follow from two ways of achieving a more accurate measure of the expected value of the game wager.

Modeling the Behavior of Human Card Counters:

Balanced-Card-Counting Strategies

Balanced-card-counting strategies call for players to assign count values to each rank of card such that when added together these count values equal zero. For example, the following is a balanced-card-counting strategy that works well for the computer-controlled player in a simulation of the second-optional embodiment wherein: Each deck of cards consists of thirteen ranks of each of Four French suits. The count values assigned individually to the cards by rank are as follows. Each card bearing indicia representative of the rank of ace, counts as negative one. Each card bearing indicia representative of a rank selected from a group of ranks consisting of two, three, four, five, six, and seven, counts as positive one. Each card bearing indicia representative of the rank of eight, counts as zero. Each card bearing indicia representative of a rank selected from a group of ranks consisting of nine, ten, jack, queen, and king, counts as negative one.

The following table shows that the sum of all count values assigned to all ranks of cards present in each fifty-two card deck is equal to zero. There is a balance of positive count values and negative count values and as such, this card-counting strategy is a balanced-card-counting strategy.

| Rank | Count Value | Number Of Cards | TOTAL |
|---|---|---|---|
| Ace | −1 | 4 | −4 |
| Two | +1 | 4 | +4 |
| Three | +1 | 4 | +4 |
| Four | +1 | 4 | +4 |
| Five | +1 | 4 | +4 |
| Six | +1 | 4 | +4 |
| Seven | +1 | 4 | +4 |
| Eight | 0 | 4 | 0 |
| Nine | −1 | 4 | −4 |
| Ten | −1 | 4 | −4 |
| Jack | −1 | 4 | −4 |
| Queen | −1 | 4 | −4 |
| King | −1 | 4 | −4 |
| Summations | 0 | 52 | 0 |

At the beginning of the shoe, if the card counter is using a balanced-card-counting strategy, then the card counter generally starts counting with an initial-running count of zero. Whenever a card is exposed, a counter adds the count value of that rank of card to a running total, known as the 'running count'.

At the beginning of each subsequent round of play, the card counter divides the running count by their own estimate of the number of decks remaining in the stack. Card counters refer to this action as performing a true-count conversion.

By performing the true-count conversion, the card counter converts the running count into a true count. In so doing, the card counter mathematically adjusts for the fact that the size of the effect of the removal of any given card is inversely proportional to the number of cards remaining in the stack. The true count provides to the card counter a more accurate measure of the expected value of the game wager than does the running count. For that reason, many card counters use the true count to make betting and playing decisions rather than using the running count.

If the bet spread is large enough, and if the house edge is low enough, then card counters are able to turn the overall odds of the game in favor of the player by systematically varying the size of the game wager in response to the true count as follows. If the true count is high enough to indicate that the expected value of the game wager favors the player, then the card counter places a large game wager and otherwise the card counter places a minimal game wager. However, if a card counter uses an unbalanced-card-counting strategy, then the card counter can avoid the added step of making the true-count conversion.

Modeling the Behavior of Human Card Counters: Unbalanced-Card-Counting Strategies Unbalanced-card-counting strategies call for players to assign count values to each rank of card such that when added together these count values do not equal zero. For example, the following is an unbalanced-card-counting strategy that works well for the computer-controlled player in a simulation of the second-optional embodiment wherein: Each deck of cards consists of thirteen ranks of each of Four French suits. The count values assigned individually to the cards by rank are as follows. Each card bearing indicia representative of the rank of ace, counts as negative one. Each card bearing indicia representative of a rank selected from a group of ranks consisting of two, three, four, five, and six, counts as positive one. Each card bearing indicia representative of the rank of seven, counts as positive zero-point-five. Each card bearing indicia representative of a rank selected from a group of ranks consisting of eight and nine, counts as zero. Each card bearing indicia representative of a rank selected from a group of ranks consisting of ten, jack, queen, and king, counts as negative one.

The following table shows that the sum of all count values assigned to all of the ranks of cards in each fifty-two card deck is not equal to zero. The sum is equal to positive two. There is not a balance of positive point counts and negative point counts and as such, this card-counting strategy is an unbalanced-card-counting strategy.

| Rank | Count Value | Number Of Cards | TOTAL |
|---|---|---|---|
| Ace | −1 | 4 | −4 |
| Two | +1 | 4 | +4 |
| Three | +1 | 4 | +4 |
| Four | +1 | 4 | +4 |
| Five | +1 | 4 | +4 |
| Six | +1 | 4 | +4 |
| Seven | +0.5 | 4 | +2 |
| Eight | 0 | 4 | 0 |
| Nine | 0 | 4 | 0 |
| Ten | −1 | 4 | −4 |
| Jack | −1 | 4 | −4 |
| Queen | −1 | 4 | −4 |
| King | −1 | 4 | −4 |
| Totals | +0.5 | 52 | +2 |

There are two surplus count points per each fifty-two-card deck in play. On average, this causes the running count to drift upward during the course of dealing a significant portion of the stack from a shoe. When the running count reaches a certain "key count", then the running count indicates to the card counter that on average the expected value of the game wager is favorable to the player. The card counter knows it is time to increase the size of the game wager. The key count is a significantly higher number than the initial-running count. In practice, if a card counter is using an unbalanced-card-counting strategy, then the card counter can use any number as an initial-running count.

The important thing is that the difference of the key count minus the initial-running count be correct given the predetermined set of game rules. On average, as the running count drifts upward during the course of dealing a significant portion of the stack from a shoe, it becomes easier for the card counter to attain a running count that is equal to or greater than the key count. This adjusts for the fact that the size of the effect of the removal of any given rank of card is inversely proportional to the number of cards remaining in the stack. In this way, unbalanced card-counting strategies make the running count a more accurate measure of the expected value of the game wager than it would otherwise be.

Using an E-Z-Count Strategy to Identify the Best-Card-Counting Strategies that a Human Player could Use An E-Z-count strategy is a balanced-card counting strategy. The E-Z-count strategy assigns a decimal-count value to each rank of card in the stack. Each decimal-count value is equal to a measurement made of the change in the expected value of the game wager caused by the removal of one card of the corresponding rank from each complete deck in the stack. There are two ways of making the above-described measurement.

One way to make the above-described measurement is to do so individually for each rank of card by performing an abbreviated-combinatorial analysis. The BIGS928 software application 918 uses this approach. This approach is capable of generating the E-Z-count strategy for an optional embodiment of the game of the present invention under the following conditions. The game is a double exposure game. The user-defined set of game rules does not include rules made for complete hands that also make qualifying-five-card-poker hands.

The other way to make the above-described measurements is to do so simultaneously for each rank of card by using summations of various ongoing simulation results. The BIGS908 software application 924 and the BIGS988 software application 820 use this approach. This approach is capable of generating an E-Z-count strategy for any of a subset of optional embodiments of the game of the present invention regardless of whether or not the predetermined set of game rules includes rules made for complete hands that also make qualifying-five-card-poker hands. This approach is also capable of generating an E-Z count strategy with decimal-count values that are nearly optimal for the betting strategy employed by the computer-controlled player.

Most if not all human players would be unable to use the decimal-count values of an E-Z-count strategy to count cards during the course of a live game. However, some human players would be able to use integer-count values to count cards during the course of a live game. A person skilled in the art could choose the integer-count values that best approximate the decimal-count values of the E-Z-count strategy. Using these integer-count values, a person skilled in the art could derive unbalanced-card-counting strategies and balanced-card-counting strategies that work well with the betting strategy employed by the computer-controlled player.

the player counts cards using an unbalanced-card-counting strategy, then the card count is the running count. To avoid ambiguity when operating on half-integers, a rounding rule must be chosen. On most computer implementations including those of the BIGS collection of software applications, the selected rule is to round half-integers to the nearest-even integer.

The BIGS908 software application 924 is a game simulator capable of saving a data file containing data about the average-stack composition that occurred at each of a set of count levels during a game simulation. The BIGS988 software application 820 is a game simulator capable of saving a data file containing data about the average-stack composition that occurred at each of a set of count levels during a game simulation. The BIGS931 software application 818 and 926 processes this data and saves to a text file a table displaying the percentages of each card denomination found in the average-stack compositions that occurred at each of a set of count levels during a game simulation.

The following is a table display of the percentages of each card denomination found in the average stack compositions that occurred at various count levels during a Finnish 27 game simulation given a user-defined-card-counting strategy, given a user-defined set of game rules, and given a user-defined set of game simulation parameters.

| samples | | percentage of each denomination | | | | | | | | | | | | | count |
|---|---|---|---|---|---|---|---|---|---|---|---|---|---|---|---|
| % and # | | 1 | 2 | 3 | 4 | 5 | 6 | 7 | 8 | 9 | 10 | 11 | 12 | 13 | level |
| 1.2 | 1245047 | 6.7 | 8.7 | 8.6 | 8.7 | 8.6 | 8.6 | 8.6 | 7.7 | 6.7 | 6.7 | 6.7 | 6.7 | 6.7 | −6 |
| 2.0 | 2000898 | 6.9 | 8.5 | 8.5 | 8.5 | 8.5 | 8.5 | 8.5 | 7.7 | 6.9 | 6.9 | 6.9 | 6.9 | 6.9 | −5 |
| 3.3 | 3334896 | 7.1 | 8.3 | 8.3 | 8.3 | 8.3 | 8.3 | 8.3 | 7.7 | 7.1 | 7.1 | 7.1 | 7.1 | 7.0 | −4 |
| 5.5 | 5549573 | 7.2 | 8.2 | 8.2 | 8.2 | 8.2 | 8.2 | 8.2 | 7.7 | 7.2 | 7.2 | 7.2 | 7.2 | 7.2 | −3 |
| 9.3 | 9340943 | 7.4 | 8.0 | 8.0 | 8.0 | 8.0 | 8.0 | 8.0 | 7.7 | 7.4 | 7.4 | 7.4 | 7.4 | 7.4 | −2 |
| 16.5 | 16514217 | 7.6 | 7.8 | 7.8 | 7.8 | 7.8 | 7.8 | 7.8 | 7.7 | 7.5 | 7.5 | 7.5 | 7.5 | 7.5 | −1 |
| 22.9 | 22916679 | 7.7 | 7.7 | 7.7 | 7.7 | 7.7 | 7.7 | 7.7 | 7.7 | 7.7 | 7.7 | 7.7 | 7.7 | 7.7 | 0 |
| 15.5 | 15529395 | 7.9 | 7.6 | 7.5 | 7.5 | 7.5 | 7.5 | 7.5 | 7.7 | 7.8 | 7.8 | 7.8 | 7.8 | 7.8 | 1 |
| 8.8 | 8816446 | 8.0 | 7.4 | 7.4 | 7.4 | 7.4 | 7.4 | 7.4 | 7.7 | 8.0 | 8.0 | 8.0 | 8.0 | 8.0 | 2 |
| 5.2 | 5246345 | 8.2 | 7.2 | 7.2 | 7.2 | 7.2 | 7.2 | 7.2 | 7.7 | 8.2 | 8.2 | 8.2 | 8.2 | 8.2 | 3 |
| 3.1 | 3149818 | 8.3 | 7.1 | 7.1 | 7.1 | 7.1 | 7.1 | 7.1 | 7.7 | 8.3 | 8.3 | 8.3 | 8.3 | 8.3 | 4 |
| 1.9 | 1894063 | 8.5 | 6.9 | 6.9 | 6.9 | 6.9 | 6.9 | 6.9 | 7.7 | 8.5 | 8.5 | 8.5 | 8.5 | 8.5 | 5 |
| 1.2 | 1178262 | 8.7 | 6.7 | 6.7 | 6.7 | 6.7 | 6.7 | 6.7 | 7.7 | 8.6 | 8.7 | 8.6 | 8.6 | 8.6 | 6 |

Accordingly, the BIGS988 software application provides those skilled in the art with an easy way of identifying the card counting, and betting strategies that human players might attempt to use to gain a theoretical advantage over the house while playing a single-exposure game. Accordingly, the BIGS908 software application provides those skilled in the art with an easy way of identifying the card counting, and betting strategies that human players might attempt to use to gain a theoretical advantage over the house while playing a double-exposure game.

Card-Counting Strategies, Count Levels, Average-Stack Compositions, and Play-Variation Indices Card-counting strategies cannot reveal the exact number of cards of each rank remaining in the stack. Card-counting strategies can reveal an average-stack composition at each of a range of count levels that occurs during the course of a game. The average-stack composition at any particular count level is the average number of each rank of card remaining in the stack at that particular count level.

A count level is the card count rounded to the nearest integer wherein: If the player counts cards using a balanced-card-counting strategy, then the card count is the true count. If The numbers one through thirteen appear as column labels beneath the phrase 'percentage of each denomination'. The numbers represent ranks of playing card. The number zero (not shown) represents the joker. The number one represents the ace of each suit. The numbers two through ten represent the two through ten of each suit respectively. The number eleven represents the jack of each suit. The number twelve represents the queen of each suit. The number thirteen represents the king of each suit.

The user-defined-deck composition is thirteen ranks of each of the four French suits. The user-defined number of decks in the stack is six. The given user-defined set of game rules is the user-defined set of game rules herein ascribed to the second-optional embodiment. The given user-defined-card-counting strategy is the balanced-card-counting system described above wherein: The count values assigned individually to the cards by rank are as follows. Each card bearing indicia representative of the rank of ace, counts as negative one. Each card bearing indicia representative of a rank selected from a group of ranks consisting of two, three, four, five, six, and seven, counts as positive one. Each card bearing indicia representative of the rank of eight, counts as zero.

Each card bearing indicia representative of a rank selected from a group of ranks consisting of nine, ten, jack, queen, and king, counts as negative one.

The exact-stack composition is the exact number of each rank of card remaining in the stack. One hundred million samples of the exact-stack composition were taken during the course of the game simulation that produced the values seen in the cells of the table shown above. These samples were sorted by count level. The percentage of any given rank of card at any given count level is equal to the product of one-hundred percent multiplied by the quotient of a summation of all samples of the exact number of the given rank of card at the given count level divided by a summation of all samples of the exact number of cards remaining in the stack at the given count level. The table shows data about the percentage of each rank of card in the stack at each count level wherein at least one million samples of the exact-stack composition were taken during the course of the game simulation.

The percentage of each of the thirteen ranks in a complete stack of six decks is about seven-point-seven percent (7.7%). As shown in the table above, the percentage of each of the thirteen ranks is about seven-point-seven percent (7.7%) in the average-stack composition at a count level of zero. The percentage of each of the thirteen ranks that are assigned a non-zero count value changes in the average-stack compositions at all non-zero count levels. The size of the change in the percentage is proportional to the product of the count value assigned to any given rank of card multiplied by the count level multiplied by negative one.

Accordingly, a non-zero count level indicates a change in the average-stack composition. The change in the average-stack composition is responsible for the change in the expected value of the game wager indicated by the non-zero count level. The change in the average-stack composition is also responsible for any change in the best strategy for the play of the player's hand indicated by the non-zero count level. Changes in the best strategy for the play of the player's hand indicated by the non-zero count level are the basis of play-variation indices. Play-variation indices tell the card counter how to vary playing strategy with changes in the count level.

Combination-Dependent-Play-Variation Indices

The BIGS910 software application 928 enables the user to load into program memory data about a set of average-stack compositions saved to a data file by the BIGS908 software application 924. The BIGS910 software application uses the data about the average-stack compositions to build a set of databases of player-finish probabilities for each count level that accumulated at least a user-defined minimum number of samples of the exact-stack composition. The BIGS910 software application builds databases of player-finish-probabilities in much the same way as the BIGS903 software application 914 builds databases of player-finish probabilities.

The BIGS912 software application 930 enables the user to load into program memory data about a set of average-stack compositions saved to a data file by the BIGS908 software application 924. The BIGS912 software application uses the data about the average-stack compositions to build a set of databases of dealer-finish probabilities for each count level that accumulated at least a user-defined minimum number of samples of the exact-stack composition. The BIGS912 software application builds databases of dealer-finish probabilities in much the same way as the BIGS906 software application 916 builds databases of dealer-finish probabilities.

The BIGS914 software application 932 enables the user to load into program memory a database of average-stack compositions saved to a data file by the BIGS908 software application 924, databases of player-finish probabilities saved to a set of data files by the BIGS910 software application 928, and databases of dealer-finish probabilities saved to a set of data files by the BIGS912 software application 930. The BIGS914 software application uses this data and a user-defined set of game rules to calculate the expected value of the game wager and find a set of composition-dependent-playing-strategy tables for each of a set of count levels that accumulated at least a user-defined-minimum number of samples of the exact-stack composition during the game simulation that produced the data about the set of average-stack compositions. The BIGS914 software application uses data about how the composition-dependent-playing-strategy table changes with changes in the count level to assemble a set of composition-dependent-play-variation-index tables.

At present, the BIGS914 software application 932 is capable of assembling the set of combination-dependent-play-variation-index tables for a double-exposure game under the following conditions. The user-defined set of game rules does not include rules made for complete hands that also include the five cards of a qualifying-five-card-poker hand. Data about the probability of the occurrence of each category of five-card-poker hand is not required to calculate the expected value of the game wager and find a set of combination-dependent-playing-strategy tables for the double-exposure game.

A combination-dependent-play-variation index provides a strategy for the play of the player's hand given each of a set of count levels that have accumulated at least a user-defined-minimum number of samples of the exact-stack composition during the game simulation that produced the data about the set of average-stack compositions. A combination-dependent-play-variation-index table provides a combination-dependent-play-variation index for each of the combinations of ranks that could be the combination of ranks assigned to the cards removed from the stack and dealt face up to form the set of hands consisting of the player's initial hand and the dealer's initial hand.

If the user-defined set of game rules does not give the option to split to the player, then the set of combination-dependent-play-variation-index tables consists of one combination-dependent-play-variation-index table assembled for the set of hands consisting of the player's primary-initial hand and the dealer's initial hand. If the user-defined set of game rules does give the option to split to the player, then the set of combination-dependent-play-variation-index tables consists of three tables. The first of the three tables is a combination-dependent-play-variation-index table assembled for the set of hands consisting of the player's primary-initial hand and the dealer's initial hand. The second and third of the three tables are combination-dependent-play-variation-index tables assembled for the set of hands consisting of the player's post-split-initial hand and the dealer's initial hand.

The smaller the user-defined-minimum number of samples of the exact-stack composition is in comparison to the total number of samples of the exact-stack composition taken during the game simulation that produced the data about the set of average-stack compositions, the greater is the number of count levels that will have accumulated at least the user-defined-minimum number of samples of the exact-stack composition. The greater the number of count levels is, the greater is the number of combination-dependent-play-variation indices that call for the player to vary playing strategies with changes in the count level.

The lower the probability of the occurrence of a given count level, the smaller is the change in the expected value of the game wager produced by a combination-dependent-play-variation index that calls for the player to vary playing strategy at that particular count level. Accordingly, all count levels with a low probability of occurrence can safely be ignored when assembling a set of combination-dependent-play-variation-index tables.

The BIGS914 software application saves data about the set of composition-dependent-play-variation-index tables to a data file. The BIGS908 software application enables the user to load into program memory the data about the set of combination-dependent-play-variation-index tables contained in this data file. If the user does so, then the BIGS908 software application enables the computer-controlled player(s) to use the set of combination-dependent-play-variation-index tables to vary playing strategy with changes in the count level during a game simulation.

Most combination-dependent-play-variation indices call for the player to play the player's hand in the same way regardless of the count level. However, some combination-dependent-play-variation indices call for the player to vary playing strategy with changes in the count level.

The following is an example of a combination-dependent-play-variation index that calls for the player to vary playing strategy with changes in the count level.

| | |
|---|---|
| | A6 |
| AT | STAND |
| | −4 |
| | 23/AJ |

The combination-dependent-play-variation index is an excerpt of a combination-dependent-play-variation-index table assembled for the set of hands consisting of the player's primary-initial hand and the dealer's initial hand, and saved to a data file by the BIGS914 software application. The game to be played while using the combination-dependent-play-variation-index table is the double-exposure game of the second-optional embodiment. The card-counting strategy to be employed by the player while using the combination-dependent-play-variation-index table is the balanced-card-counting system described above wherein: The count values assigned individually to the cards by rank are as follows. Each card bearing indicia representative of the rank of ace, counts as negative one. Each card bearing indicia representative of a rank selected from a group of ranks consisting of two, three, four, five, six, and seven, counts as positive one. Each card bearing indicia representative of the rank of eight, counts as zero. Each card bearing indicia representative of a rank selected from a group of ranks consisting of nine, ten, jack, queen, and king, counts as negative one.

The user-defined-minimum number of samples of the exact-stack composition was one-million samples. The total number of samples of the exact-stack composition taken during the course of the game simulation that produced the data about the set of average-stack compositions was one-hundred-million samples. Thirteen count levels accumulated at least one million samples of the exact-stack composition. In ascending order, the thirteen count levels are negative six, negative five, negative four, negative three, negative two, negative one, zero, positive one, positive two, positive three, positive four, positive five, and positive six.

The characters "A6" represent a dealer's initial hand consisting of an ace and a six. The characters "AT" represent a player's initial hand consisting of an ace and a ten. The characters "STAND" represent the option to stand. The characters "23/AJ" represent a strategy for the player's use of the hit option. The strategy for the player's use of the hit option is one of the eighty-one-supported strategies for the player's use of the hit option. The strategy for the player's use of the hit option specifies a set of target-numerical sums. The set of target-numerical sums consists of a target-numerical sum for the play of the player's hard hands, and a target-numerical sum for the play of the player's soft hands. The characters "23" indicate that the target-numerical sum specified for the play of the player's hard hands is hard twenty-three. The characters "AJ" indicate that the target-numerical sum specified for the play of the player's soft hands is soft twenty-five. The number negative four (−4) represents the count level at which the combination-dependent-play-variation index calls for the player to vary playing strategy.

To use the combination-dependent-play-variation index to make decisions about how to vary playing strategy with changes in the count level, the player does all of the following. At the beginning of the player's turn to play, the player determines the count level. The player examines the combination-dependent-play-variation index in search of the strategy for the play of the player's hand that corresponds to the count level wherein: If the count level is at least equal to negative four, then the player opts to use the stand option to play the player's hand. If the count level is less than negative four, than the player opts to use the strategy for the player's use of the hit option indicated by the characters "23/AJ" to play the player's hand.

To use the strategy for the player's use of the hit option to play the player's hand, the player makes decisions on how to play the player's hand in accordance with the following steps. The player determines the player's hand total. If the player's hand total is less than the target-numerical sum specified for the type of hand the player has, then the player hits. If the player's hand total is at least equal to the target-numerical sum specified for the type of hand the player has, then the player stands. The player repeats the above-described steps until the player stands.

The player refers to the set of combination-dependent-play-variation-index tables one time per each player's initial hand.

Total-Dependent-Play-Variation Indices

The BIGS923 software application 934 enables the user to load into program memory data about a set of combination-dependent-play-variation-index tables saved to a set of files by the BIGS914 software application 932. The BIGS923 software application enables the user to load into program memory data about a set of average-stack compositions saved to a data file by the BIGS908 software application. The BIGS923 software application uses this data to derive a total-dependent-basic-strategy table for each of a set of count levels that accumulated at least a user-defined-minimum number of samples of the exact-stack composition during the course of the game simulation that produced the data about the set of average-stack compositions. The BIGS923 software application uses data about how the total-dependent-basic-strategy table changes with changes in the count level to assemble a total-dependent-play-variation-index table.

A total-dependent-play-variation index provides the best option for the play of the player's hand given each of a set of count levels that have accumulated at least a user-defined-minimum number of samples of the exact-stack composition during the course of the game simulation that produced the data about the set of average-stack compositions. A total-dependent-play-variation-index table provides a total-dependent-play-variation index for each of the set of hand totals that could be the set of hand totals calculated for a set of hands consisting of the player's current hand and the dealer's initial hand.

The smaller the user-defined-minimum number of samples of the exact-stack composition is in comparison to the total number of samples of the exact-stack composition taken during the course of the game simulation that produced the data about the set of average-stack compositions, the greater is the number of count levels that will have accumulated at least the user-defined-minimum number of samples of the exact-stack composition. The greater the number of count levels is, the greater is the number of total-dependent-play-variation indices that call for the player to vary playing strategies with changes in the count level.

The lower the probability of the occurrence of a given count level, the smaller is the change in the expected value of the game wager produced by a total-dependent-play-variation index that calls for the player to vary playing strategy at that particular count level. Accordingly, all count levels with a low probability of occurrence can safely be ignored when assembling a total-dependent-play-variation-index table.

The BIGS923 software application saves data about the total-dependent-play-variation-index table to a data file. The BIGS908 software application enables the user to load into program memory the data about the total-dependent-play-variation-index table contained in this data file. If the user does so, then the BIGS908 software application enables the computer-controlled player(s) to use the total-dependent-play-variation-index table to vary playing strategy with changes in the count level during a game simulation.

To use the total-dependent-play-variation-index table, the player proceeds as follows. At or before the beginning of the player's turn to play, the player calculates the set of hand totals consisting of the player's hand total and the dealer's hand total. Each time the player begins the play of an initial hand, the player calculates the count level. Subsequently, the player examines the total-dependent-play-variation-index table in search of the total-dependent-play-variation index that corresponds to the set of hand totals consisting of the player's hand total and the dealer's hand total. If the player finds it, then the player examines the total-dependent-play-variation index in search of the option for the play of the player's hand that corresponds to the count level. If the player finds it, then the player chooses the option. Each option tells the player how to make a single decision about how to play the player's hand. Accordingly, the player recalculates the player's hand total, and reexamines the total-dependent-play-variation-index table each time the player makes another decision on how to play the player's hand.

The BIGS923 software application also saves a table (not shown) containing data about the total-dependent-play-variation-index table to a text file. The user can open this text file, study the data about the total-dependent-play-variation-index table contained in the cells of the table, and thereby learn how to vary playing strategy in response to changes in the count level during a live version of the double-exposure game that corresponds to the total-dependent-play-variation-index table.

Most total-dependent-play-variation indices call for the player to play the player's hand in the same way regardless of the count level. However, some total-dependent-play-variation indices call for the player to vary playing strategy with changes in the count level.

The following is an example of a total-dependent-play-variation index that calls for the player to vary playing strategy with changes in the count level.

| | |
|---|---|
| | 19<br>S<br>4 |
| 17 | H |

The total-dependent-play-variation index is an excerpt of a total-dependent-play-variation-index table assembled and saved to a text file by the BIGS923 software application. The game to be played while using the total-dependent-play-variation-index table is the double-exposure game of the second-optional embodiment. The card-counting strategy to be employed by the player while using the total-dependent-play-variation-index table is the balanced-card-counting system described above wherein: Each card bearing indicia representative of the rank of ace, counts as negative one. Each card bearing indicia representative of a rank selected from a group of ranks consisting of two, three, four, five, six, and seven, counts as positive one. Each card bearing indicia representative of the rank of eight, counts as zero. Each card bearing indicia representative of a rank selected from a group of ranks consisting of nine, ten, jack, queen, and king, counts as negative one.

The user-defined-minimum number of samples of the exact-stack composition was one-million samples. The total number of samples of the exact-stack composition taken during the course of the game simulation that produced the data about the set of average-stack compositions was one-hundred-million samples. Thirteen count levels accumulated at least one million samples of the exact-stack composition. In ascending order, the thirteen count levels are negative six, negative five, negative four, negative three, negative two, negative one, zero, positive one, positive two, positive three, positive four, positive five, and positive six.

The characters "19" represent a dealer's hand total of hard nineteen. The characters "17" represent a player's hand total of hard seventeen. The letter H represents the option to hit. The letter S represents the option to stand. The number four (4) represents the count level at which the total-dependent-play-variation index calls for the player to vary playing strategy.

To use the total-dependent-play-variation index to vary playing strategy with changes in the count level, the player determines the count level. The player examines the total-dependent-play-variation index in search of the strategy for the play of the player's hand that corresponds to the count level wherein: If the count level is at least equal to positive four, than the player opts to stand. If the count level is less than positive four, then the player opts to hit.

Conclusions about the BIGS Collection of Software Applications

In conclusion, the various software applications in the BIGS collection are capable of enabling users to do all of the following. Input a user-defined set of game rules for any of a subset of comparing-card games belonging to the Finnish 27 family of table-card games. Calculate an estimate of the expected value of the game wager and find the basic strategies for any of a subset of comparing-card games belonging to the Finnish 27 family of table-card games. Find card-counting strategies skilled players would likely use to determine when the card count indicates the composition of the cards remaining to be dealt likely favors the player. Find betting strategies skilled players would likely use to win more money. Find play-variation indices skilled players would likely use to win more hands. Program a computer-controlled player to use a card-counting strategy, a betting strategy, and a play variation strategy in a high-speed game simulation. Enable users to examine the results of billions of rounds of simulated play and thereby to estimate the vulnerabilities of various optional embodiments to skilled players. If the vulnerability of an optional embodiment warrants it, then various of the software applications in the BIGS collection enable users to identify effective countermeasures the house could use to insure the house has an edge over skilled players.

The various optional embodiments described in this detailed description have all been studied extensively using the various software applications in the BIGS collection. The results of these studies are beyond the scope of this detailed discussion. However, the source code of each of the software prototypes included in the computer-program-listing appendix provides a description of the basic strategy for and corresponding house edge of the optional embodiment modeled by that particular software prototype. If the reader runs any of the software prototypes as described above, then a set of buttons will appear at the bottom of the internet browser window. If the reader clicks on the button with the words "Show Rules" written on it, then a block of text will appear beneath the set of buttons. If the reader scrolls down to near the bottom of the block of text, then the reader will find the description of the basic strategy and corresponding estimate of the house edge.

Skilled players might employ card counting, and betting strategies in an attempt to gain a theoretical advantage over the house. Card counting and betting strategies have already been identified and extensively studied for each of the various optional embodiments discussed in this detailed discussion. In cases wherein the vulnerability of an optional embodiment to skilled players who might employ these strategies warrants it, effective countermeasures have already been identified and extensively studied. The results of these studies are also beyond the scope of this detailed discussion. However, I expect those skilled in the art should be able to use the various software applications in the BIGS collection to reproduce the results of the studies independently.

Skilled players might employ play-variation indices in an attempt to gain an advantage over the house. Total-dependent-play-variation indices for the second-optional embodiment have already been assembled. Use of these total-dependent-play-variation indices has already been extensively studied. The results of these studies are also beyond the scope of this detailed discussion. However, I expect those skilled in the art should be able to use the various software applications in the BIGS collection to reproduce the results of the studies independently.

CONCLUSIONS, RAMIFICATIONS, AND SCOPE

Thus, the reader will see that various optional embodiments may benefit from numerous advantages. One or more optional embodiments might benefit from some, none, or most of the advantages discussed below.

Accordingly, several advantages of one or more aspects are as follows: To provide games that are new. Thereby, to enable casino operators to attract players who love all things new. To provide games that enable the casino operators to differentiate themselves from their competition in the market place. Thereby, to enable casino operators to attract players that might otherwise spend their time and money at a competitor's casino. To provide games that employ cards bearing Finnish style indicia. Thereby, to provide games that are easily recognizable. To provide games tied to known game patterns. Thereby, to provide games with a quick-learning curve. To provide games that significantly reduce the amount of consulting that takes place. Thereby, to provide fast-paced games. To provide games that include features such as bonus payouts for winning-player hands that also make qualifying-five-card-poker hands, escalating-pay tables, and jackpots. Thereby, to attract those gamblers who find such exciting features appealing. To provide games that give a special weight and importance to cards assigned a value of nine points such as by awarding a large bonus payout to players who build various 9-9-9 hands. Thereby, to attract those gamblers who consider the number nine to be a lucky number. To provide double exposure games featuring predetermined sets of game rules that assign any one of as many as eleven-thousand and twenty-five unique combination of card ranks to a set of four cards consisting of the two cards in the player's initial hand and the two cards in the dealer's initial hand. Thereby, to attract those gamblers who find games featuring a lively non-repetitiveness and/or an abundance of variety appealing. To provide games that require the player to play the player's hand in accordance with a predetermined strategy. Thereby, to attract those gamblers who find easily accessible games appealing.

While my above description and the accompanying prototypes contain many specificities, these should not be construed as limitations on the scope, but rather as an exemplification of several embodiments thereof. Many other variations are possible. Accordingly, the scope should be determined not by the embodiments illustrated, but by the appended claims and their legal equivalents.

The invention claimed is:

1. Method for conducting a comparing-card game belonging to a Finnish 27 family of table-card games, said method comprising:

(a) agreeing upon a predetermined set of game rules so that said predetermined set of game rules corresponds substantially to a set of game rules selected from a group consisting of every set of game rules that can possibly be made by a software means for making said set of game rules;

(b) identifying, to a player and a dealer, each of at least one player position, and at least one dealer position;

(c) providing at least one deck of cards, so that said at least one deck of cards is either at least one physical deck of cards or at least one deck of cards depicted on a monitor, so that each card of said at least one deck of cards bears indicia representative of a rank selected from a group of ranks consisting of ace, two, three, four, five, six, seven, eight, nine, ten, jack, queen, king, and joker, so that any card of said at least one deck of cards that bears indicia representative of a rank selected from a group of ranks consisting of ace, two, three, four, five, six, seven, eight, nine, ten, jack, queen, and king, also bears indicia representative of a suit selected from a group of four suits such as a group of four suits consisting of spades, hearts, clubs, and diamonds, and so that each deck of said at least one deck of cards consists of the same complement of cards, and thereby has the same deck composition;

(d) assigning, to each card in said at least one deck of cards, a value in accordance with a subset of said predetermined set of game rules consisting of;

(r1) if a card bears indicia representative of the rank of ace, then the value of said card is selected from a group consisting of one point and fourteen points;

(r2) if a card bears indicia representative of a rank selected from a group of ranks consisting of two, three, four, five, six, seven, eight, nine, and ten, then the value of said card is the number of points that corresponds to the numerical-face value of said card;

(r3) if a card bears indicia representative of the rank of jack, then the value of said card is eleven points;

(r4) if a card bears indicia representative of the rank of queen, then the value of said card is twelve points;

(r5) if a card bears indicia representative of the rank of king, then the value of said card is thirteen points;

(r6) if a card bears indicia representative of the rank of joker, then the value of said card is selected from a group consisting of zero points, and any number of points required to make a hand total of twenty-seven points;

(e) accepting, from the player, a game wager, so that said game wager corresponds to one of said at least one player position;

(f) dealing a set of hands, so that said set of hands consists of a player's hand and a dealer's hand, so that said player's hand consists of at least two cards, so that said dealer's hand consists of at least one card, so that said player's hand corresponds to a position selected from a group of positions consisting of said one of said at least one player position, and one of said at least one dealer position, and so that said dealer's hand corresponds to one of said at least one dealer position;

(g) establishing hand values;

(h) determining the outcome of the game based on said hand values;

(i) resolving the game wager based on said outcome of the game.

2. Method of claim 1 wherein step (c) is practiced by:

(c1) providing six decks of cards, with each deck consisting of thirteen ranks of each of four French suits plus two jokers, and with each card bearing Finnish style indicia exemplified by Turun Linna cards circa 1960;

(c2) shuffling said cards either manually, mechanically, or electronically, so that the order of said cards is substantially a random order.

3. Method of claim 1 wherein step (d) is practiced by:

(d1) if a card bears indicia representative of the rank of ace, selecting the value assigned to said card wherein:

(d1-i) if a hand selected from a group consisting of the player's hand and the dealer's hand includes at least one ace, and if one ace in said hand can be assigned a value of fourteen points without causing the hand total of said hand to exceed twenty-seven points, assigning to one ace in said hand a value of fourteen points, and assigning to each of any additional aces in said hand a value of one point;

(d1-ii) if a hand selected from a group consisting of the player's hand and the dealer's hand includes at least one ace, and if one ace in said hand can not be assigned a value of fourteen points without causing the hand total of said hand to exceed twenty-seven points, assigning to each ace in said hand a value of one point;

(d2) if a card bears indicia representative of a rank selected from a group of ranks consisting of two, three, four, five, six, seven, eight, nine, and ten, assigning to said card a value of the number of points that corresponds to the numerical-face value of said card;

(d3) if a card bears indicia representative of the rank of jack, assigning to said card a value of eleven points;

(d4) if a card bears indicia representative of the rank of queen, assigning to said card a value of twelve points;

(d5) if a card bears indicia representative of the rank of king, assigning to said card a value of thirteen points;

(d6) if a card bears indicia representative of the rank of joker, selecting the value assigned to said card wherein:

(d6-i) if a first card dealt to a hand selected from a group consisting of the player's hand and the dealer's hand is a joker, assigning to said joker a value of zero points;

(d6-ii) if a second card dealt to a hand selected from a group consisting of the player's hand and the dealer's hand is a joker, assigning to said joker a value equal to the number of points required to make the hand total of said hand equal to twenty-seven points;

(d6-iii) if a hand selected from a group consisting of the player's hand and the dealer's hand consists of at least three cards, and if said hand includes at least one joker, assigning to each joker in said hand a value of zero points.

4. Method of claim 1 further comprising the step of said predetermined set of game rules including a predetermined set of five-card-poker-hand-ranking rules wherein said step is practiced by:

(a) specifying ten categories of five-card-poker hand and assigning a rank to each so that when arranged in order from lowest ranking to highest ranking the ten categories of five-card-poker hand are high card, one pair, two pair, three-of-a-kind, straight, flush, full house, four-of-a-kind, straight-flush, and five-of-a-kind;

(b) further specifying the use of the suits of individual cards to determine whether a five-card hand belongs to a category of five-card-poker hand selected from a group consisting of a flush, and a straight-flush;

(c) further specifying assign a rank to each individual card so that when ordered from lowest ranking to highest ranking the individual cards are two, three, four, five, six, seven, eight, nine, ten, jack, queen, king, and ace;

(d) further specifying an ace can appear as the lowest ranking card as when part of a hand selected from a group consisting of an Ace-2-3-4-5 straight, and an Ace-2-3-4-5 straight-flush;

(e) further specifying the use of the ranks assigned to the individual cards to rank five-card-poker hands that are in the same category;

(f) further specifying if a five-card hand includes at least one joker, assign a wild-card value to each joker in said five-card hand, so that the point value assigned to each joker remains zero points, and so that each joker becomes an individual card capable of performing a function selected from a group consisting of represent an ace, complete a straight, complete a flush, and complete a straight-flush.

5. Method of claim 1 wherein step (f) is practiced by:

(f1) the dealer dealing a first card of a player's initial hand, so that said first card is dealt to said one of at least one player position, and so that the said first card is displayed face up;

(f2) the dealer dealing a first card of a dealer's initial hand, so that said first card is dealt to said one of at least one dealer position, and so that the said first card is displayed face down;

(f3) the dealer dealing a second card of the player's initial hand, so that said second card is dealt to said one of at least one player position, and so that said second card is displayed face up;

(f4) the dealer dealing a second card of the dealer's initial hand so that said second card is dealt to said one of at least one dealer position, and so that said second card is displayed face up;

(f5) if the second card dealt to the dealer's initial hand is a joker, the dealer arranging the first card dealt to the dealer's initial hand so that said first card is displayed face up;

(f6) if the second card dealt to the dealer's initial hand is an ace, the dealer offering the player the opportunity to place an insurance-side bet equal in value to one half the value of the game wager wherein:

(f6-i) if the player does not opt to place said insurance-side bet, proceeding to step (f7);

(f6-ii) if the player does opt to place said insurance-side bet, the dealer accepting, from the player, said insurance-side bet, so that said insurance-side bet corresponds to said one of at least one player position;

(f7) if the second card dealt to the dealer's initial hand is a card selected from a group of cards consisting of an ace and a king, the dealer determining whether the dealer's initial hand consists of an ace and a king without revealing to the player any information about the indicia appearing on the front side of the first card dealt to the dealer's initial hand;

(f8) if the dealer's initial hand does consist of an ace and a king, the dealer arranging the first card dealt to the dealer's initial hand so that said first card is displayed face up;

(f9) if the dealer did accept, from the player, said insurance-side bet, the dealer resolving said insurance-side bet wherein:

(f9-i) if the dealer's initial hand does consist of an ace and a king, the dealer paying the player eleven to one odds on the insurance-side bet;

(f9-ii) if the dealer's initial hand does not consist of an ace and a king, the dealer collecting the insurance-side bet.

6. Method of claim 1 wherein step (g) is practiced by:

(g1) the dealer examining initial hands in search of a predetermined-winning-complete hand wherein:

(g1-i) if the player's initial hand consists of a pair of jokers, the dealer finding the player's initial hand is a predetermined-winning-complete hand, and proceeding to step (h);

(g1-ii) if the player's initial hand consists of an ace and a king, the dealer finding the player's initial hand is a predetermined-winning-complete hand, and proceeding to step (h);

(g1-iii) if the second card dealt to the player's initial hand is a joker, the dealer finding the player's initial hand is a predetermined-winning-complete hand, and proceeding to step (h);

(g1-iv) if the dealer's initial hand consists of a pair of jokers, the dealer finding the dealer's initial hand is a predetermined-winning-complete hand, and proceeding to step (h);

(g1-v) if the dealer's initial hand consists of an ace and a king, the dealer finding the dealer's initial hand is a predetermined-winning-complete hand, and proceeding to step (h);

(g1-vi) if the second card dealt to the dealer's initial hand is a joker, the dealer finding the dealer's initial hand is a predetermined-winning-complete hand, and proceeding to step (h);

(g2) the dealer determining the number of cards in the player's hand wherein:

(g2-i) if the player's hand consists of less than five cards, proceeding to step (g3);

(g2-ii) if the player's hand does consist of five cards, the player's hand being complete, the dealer requiring the player to stand, the dealer determining the player's hand total, and proceeding to step (g4);

(g3) the dealer determining the player's hand total wherein:

(g3-i) if the player's hand total is less than a hand total selected from a group consisting of hard fifteen and soft twenty-four, the dealer requiring the player to draw one additional card to the player's hand, the dealer arranging said one additional card so that said one additional card is displayed face up, and repeating step (g2);

(g3-ii) if the player's hand total is at least equal to a hand total selected from a group consisting of hard fifteen and soft twenty-four, and if the player's hand total is less than a hand total selected from a group consisting of hard twenty-five and soft twenty-seven, the dealer consulting with the player for a decision on how to play the player's hand wherein:

(g3-ii-a) if the player does choose to stand, the player's hand being complete, and the dealer proceeding to step (g4);

(g3-ii-b) if the player does not choose to stand, the dealer requiring the player to draw one additional card to the player's hand, the dealer arranging said one additional card so that said one additional card is displayed face up, and repeating step (g2);

(g3-iv) if the player's hand total is at least equal to a hand total selected from a group consisting of hard twenty-five and soft twenty-seven, the player's hand being complete, the dealer requiring the player to stand, and proceeding to step (g4);

(g4) the dealer arranging the first card dealt to the dealer's hand so that said card is displayed face up;

(g5) the dealer examining the player's complete hand in search of a hand selected from a group consisting of a predetermined-winning-complete hand and a predetermined-losing-complete hand wherein:

(g5-i) if the player's hand total is equal to twenty-seven points, the dealer finding the player's complete hand is a predetermined-winning-complete hand, and proceeding to step (h);

(g5-ii) if the player's hand total does exceed hard twenty-seven, the dealer finding the player's complete hand is a predetermined-losing-complete hand and proceeding to step (h);

(g6) the dealer determining the number of cards in the dealer's hand wherein:

(g6-i) if the dealer's hand consists of less than five cards, the dealer proceeding to step (g7);

(g6-ii) if the dealer's hand consists of five cards, the dealer's hand being complete, the dealer standing, the dealer determining the dealer's hand total, and proceeding to step (g8);

(g7) the dealer determining the dealer's hand total wherein:

(g7-i) if the dealer's hand total is less than a hand total selected from a group consisting of hard twenty-three and soft twenty-five, the dealer drawing one additional card to the dealer's hand, the dealer arranging said one additional card so that said one additional card is displayed face up, and repeating step (g6);

(g7-ii) if the dealer's hand total is at least equal to a hand total selected from a group consisting of hard twenty-three and soft twenty-five, the dealer's hand being complete, the dealer standing, and proceeding to step (g8);

(g8) the dealer examining complete hands in search of a hand that includes a qualifying-five-card-poker hand wherein:

(g8-i) if the player's complete hand does consist of five cards, and if the dealer's complete hand does consist of less than five cards, the dealer using said predetermined set of hand-ranking rules to identify the highest-ranking-five-card-poker hand that can be made from the five cards in the player's complete hand, finding the player's complete hand does include a qualifying-five-card-poker hand consisting of said highest-ranking-five-card-poker hand, and proceeding to step (g9);

(g8-ii) if the player's complete hand does consist of less than five cards, if the dealer's complete hand does consist of five cards, the dealer using said predetermined set of hand-ranking rules to identify the highest-ranking-five-card-poker hand that can be made from the five cards in the dealer's complete hand, finding the dealer's complete hand does include a qualifying-five-card-poker hand consisting of said highest-ranking-five-card-poker hand, and proceeding to step (g9);

(g8-iii) if the player's complete hand does consist of five cards, and if the dealer's complete hand does consist of five cards, the dealer using memory of said predetermined set of five-card-poker-hand-ranking rules to identify the highest-ranking-five-card-poker hand that can be made from the five cards in each hand wherein:

(g8-iii-a) if the highest-ranking-five-card-poker hand that can be made from the five cards in the player's complete hand does outrank the highest-ranking-five-card-poker hand that can be made from the five cards in the dealer's complete hand, the dealer finding the player's hand includes a qualifying-five-card-poker hand consisting of the highest-ranking-five-card-poker hand that can be made from the five cards in the player's complete hand, and proceeding to step (g9);

(g8-iii-b) if the highest-ranking-five-card-poker hand that can be made from the five cards in the player's complete hand does not outrank the highest-ranking-five-card-poker hand that can be made from the five cards in the dealer's complete hand, the dealer finding the dealer's hand includes a qualifying-five-card-poker hand consisting of the highest-ranking-five-card-poker hand that can be made from the five cards in the dealer's complete hand, and proceeding to step (g9);

(g9) the dealer examining complete hands in search of a predetermined-winning-complete hand wherein:

(g9-i) if the player's hand total is less than twenty-eight points, and if the player's complete hand does include a qualifying-five-card-poker hand, the dealer finding the player's complete hand is a predetermined-winning-complete hand, and proceeding to step (h);

(g9-ii) if the dealer's hand total is less than twenty-eight points, and if the dealer's complete hand does include a qualifying-five-card-poker hand, the dealer finding the dealer's complete hand is a predetermined-winning-complete hand, and proceeding to step (h);

(g10) the dealer examining the dealer's complete hand in search of a predetermined-losing-complete hand wherein:

(g10-i) if the dealer's hand total does exceed hard twenty-seven, the dealer finding the dealer's hand is a predetermined-losing-complete hand, and proceeding to step (h).

7. Method of claim 1 wherein step (h) is practiced by:

(h1) if the player's hand is a predetermined-winning-complete hand, the dealer determining the outcome of the game is the player's hand wins, and proceeding to step (i);

(h2) if the player's hand is a predetermined-losing-complete hand, the dealer determining the outcome of the game is the dealer's hand wins, and proceeding to step (i);

(h3) if the dealer's hand is a predetermined-winning-complete hand, the dealer determining the outcome of the game is the dealer's hand wins, and proceeding to step (i);

(h4) if the dealer's hand is a predetermined-losing-complete hand, the dealer determining the outcome of the game is the player's hand wins, and proceeding to step (i);

(h5) if the player's hand total is closer to twenty-seven points than is the dealer's hand total, the dealer determining the outcome of the game is the player's hand wins;

(h6) if the dealer's hand total is closer to twenty-seven points than is the player's hand total, the dealer determining the outcome of the game is the dealer's hand wins;

(h7) if the player's hand total is as close to twenty-seven points as is the dealer's hand total, the dealer determining the outcome of the game is a stalemate.

8. Method of claim 1 wherein said step (i) is practiced by:

(i1) if the outcome of the game is the player's hand wins, the dealer paying the player one to one odds on the game wager;

(i2) if the outcome of the game is a stalemate, the dealer returning the game wager to the player;

(i3) if the outcome of the game is the dealer's hand wins, the dealer collecting the game wager;

(i4) if the outcome of the game is the player's hand wins, the dealer examining the player's hand in search of a predetermined combination of cards wherein:

(i4-i) if the player's initial hand does consist of an ace and a king, the dealer finding the player's hand does include a predetermined combination of cards;

(i4-ii) if the player's initial hand does consist of a pair of jokers, the dealer finding the player's hand does include a predetermined combination of cards;

(i4-iii) if the player's complete hand does consist of a card assigned a value of eight points, a card assigned a value of nine points, and a card assigned a value of ten points, the dealer finding the player's hand does include a predetermined combination of cards;

(i4-iv) if the player's complete hand does consist of three cards, and if each of said three cards is a card assigned a value of nine points, the dealer finding the player's hand does include a predetermined combination of cards;

(i5) if the outcome of the game is the player's hand wins, and if the player's hand does include the predetermined combination of cards, the dealer paying the player a bonus.

9. Method of claim 8 wherein the predetermined combinations of cards and bonus payouts are:

TBL Predetermined Combination of Cards Bonus Payout an ace and a king 1 to 2 odds on the game wager a pair of jokers 1 to 1 odds on the game wager 8-9-10 of mixed suits 1 to 2 odds on the game wager 8-9-10 same suit in hearts, clubs, or diamonds 1 to 1 odds on the game wager 8-9-10 same suit in spades 2 to 1 odds on the game wager 9-9-9 of mixed suits 9 times the table minimum 9-9-9 same suit 99 times the table minimum any 9-9-9 and 9-9 dealer's initial hand 999 times the table minimum.

10. Method of claim 1 wherein the method is performed by an electronic gaming device.

11. Method of claim 1 wherein the method is played using a gaming table.

12. Method of claim 1 wherein the method is played over the Internet.

* * * * *